US008177216B2

(12) United States Patent
Watase et al.

(10) Patent No.: US 8,177,216 B2
(45) Date of Patent: May 15, 2012

(54) SHEET CONVEYING DEVICE WITH HOLD AND TRANSFER UNIT

(75) Inventors: Hiroyuki Watase, Kanagawa (JP); Masayuki Ueda, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 317 days.

(21) Appl. No.: 12/071,660

(22) Filed: Feb. 25, 2008

(65) Prior Publication Data

US 2008/0203649 A1 Aug. 28, 2008

(30) Foreign Application Priority Data

Feb. 26, 2007 (JP) ..... 2007-046215

(51) Int. Cl.
*B65H 3/44* (2006.01)

(52) U.S. Cl. ..... 271/9.13; 271/10.1

(58) Field of Classification Search ..... 271/9.01–9.12, 271/10.1, 12, 13, 16, 17, 10.07, 10.15, 4.09, 271/272; 399/391, 392
See application file for complete search history.

(56) References Cited

U.S. PATENT DOCUMENTS

| | | | | |
|---|---|---|---|---|
| 2,410,611 | A | 5/1945 | Pratt et al. | |
| 3,894,732 | A | 7/1975 | Müller | |
| 4,518,158 | A * | 5/1985 | Goi | 271/9.13 |
| 4,826,148 | A * | 5/1989 | Coons, Jr. | 271/245 |
| 4,966,357 | A * | 10/1990 | Burger | 271/9.12 |
| 5,421,699 | A * | 6/1995 | Guiles et al. | 414/788 |
| 6,739,589 | B2 | 5/2004 | Hiramatsu | |
| 7,407,160 | B2 | 8/2008 | Peulen et al. | |
| 7,681,874 | B2 * | 3/2010 | Kusumi | 271/6 |
| 7,690,639 | B2 * | 4/2010 | Kusumi | 271/4.01 |
| 2001/0024013 | A1 * | 9/2001 | Horikoshi et al. | 271/272 |
| 2004/0067081 | A1 | 4/2004 | Kasahara | |
| 2006/0164491 | A1 | 7/2006 | Sakuma et al. | |
| 2007/0018381 | A1 | 1/2007 | Gotoh | |
| 2007/0296144 | A1 | 12/2007 | Dobrindt | |

FOREIGN PATENT DOCUMENTS

| | | |
|---|---|---|
| DE | 10 2004 013 898 | 10/2005 |
| EP | 0 556 922 | 8/1993 |
| EP | 1 172 222 | 1/2002 |
| EP | 1 191 406 | 3/2002 |

(Continued)

OTHER PUBLICATIONS

Extended European Search Report dated May 27, 2010 for corresponding application.

(Continued)

*Primary Examiner* — Jeremy R Severson
(74) *Attorney, Agent, or Firm* — Harness, Dickey & Pierce, P.L.C.

(57) ABSTRACT

A sheet conveying device, that can be included in an image forming apparatus, includes a first sheet conveying path, a second sheet conveying path, a third conveying path, and a belt-type sheet conveying unit. The first sheet conveying path has a curved portion, and feeds and conveys a sheet therethrough. The second sheet conveying path has a curved portion and different from the first sheet conveying path, and feeds and conveys the sheet therethrough. The third sheet conveying path is provided from a confluence of the first sheet conveying path and the second sheet conveying path. The belt-type sheet conveying unit is disposed on one side of the third sheet conveying path corresponding to an outer side of the curved portion of the first sheet conveying path and an inner side of the curved portion of the second sheet conveying path.

9 Claims, 35 Drawing Sheets

FOREIGN PATENT DOCUMENTS

| | | | |
|---|---|---|---|
| EP | 1 238 812 | | 9/2002 |
| JP | 61162441 | A * | 7/1986 |
| JP | 01-220656 | | 9/1989 |
| JP | 02-119467 | | 9/1990 |
| JP | 08-259008 | | 10/1996 |
| JP | 08-259009 | | 10/1996 |
| JP | 10-129883 | | 5/1998 |
| JP | 10-265070 | | 10/1998 |
| JP | 2002-274702 | | 9/2002 |
| JP | 3410848 | | 3/2003 |
| JP | 3423469 | | 4/2003 |
| JP | 2004-338923 | | 12/2004 |
| JP | 2005-001771 | | 1/2005 |
| JP | 2005-089008 | | 4/2005 |
| WO | WO 2004/048239 | | 6/2004 |

OTHER PUBLICATIONS

European Office Action dated Nov. 11, 2009 for corresponding application.

Japanese Office Action dated Aug. 3, 2010.

Communication from Chinese Patent Office for corresponding Chinese Patent Application No. 200810082539 mailed on Nov. 15, 2010.

* cited by examiner

SHEET CONVEYING DEVICE WITH HOLD AND TRANSFER UNIT

PRIORITY STATEMENT

The present patent application claims priority under 35 U.S.C. §119 from Japanese Patent Application No. 2007-046215 filed on Feb. 26, 2007 in the Japan Patent Office, the contents and disclosure of which are hereby incorporated by reference herein in their entirety.

BACKGROUND

1. Field

Example embodiments of the present patent application generally relate to a sheet conveying device effectively conveying various types of sheets, an image forming apparatus such as a copier, a facsimile machine, a printer, a printing machine, an inkjet recording device, a scanner provided with the sheet conveying device, and/or a multifunctional machine combining functions of at least two of the above.

2. Discussion of the Related Art

In order to reduce the overall sizes and dimensions of related-art image forming apparatuses including copiers such as a plain paper copier or PPC and an electrophotographic copier, facsimile machines, printers, printing machines, and inkjet recording devices, the sizes of conveying or feeding units provided therein also tend to be reduced.

Specifically, a conveying unit is used for conveying a recording medium or a sheet-type recording medium onto which an image is formed (hereinafter, referred to as "sheet"). The sheet is fed from a sheet storing unit or a sheet accommodating unit in which sheets are stacked and is conveyed to a main body of an image forming apparatus.

Related-art image forming apparatuses may include or be connected to one or more sheet feeding sections or units and a sheet conveying device for the sheet feeding section(s). A known sheet conveying device includes multiple sheet conveying paths, for example, a first sheet conveying path, a second sheet conveying path, a common conveying path, and the like.

The first sheet conveying path may be a route to convey a sheet therethrough. The second sheet conveying path may be another route to convey a sheet so that the sheet can pass through a different route. The common conveying path may be yet another route starting from a confluence of the first sheet conveying path and the second sheet conveying path.

The first sheet conveying path is generally provided in a sheet conveying device having multiple stages of sheet feeding units, which is also called a paper bank, and disposed on the main body side of the image forming apparatus.

The second sheet conveying path is, for example, provided between the main body of the image forming apparatus and a manual sheet feeding device to transfer a relatively small number of various types of sheets or between the main body of the image forming apparatus and a high-capacity sheet feeding device to feed and transfer a large number of sheets.

The common conveying path is generally provided in an image forming apparatus having the above-described configuration in order to reduce a width of the image forming apparatus, or a lateral direction as seen from a user facing the front side of the image forming apparatus. With this configuration, the user can smoothly perform various operations including a sheet loading or a sheet feeding operation.

Example operations of an image forming apparatus and a sheet storing unit provided in the image forming apparatus are described with reference to FIG. 1.

FIG. 1 shows an example of a known monochrome copier 100 serving as an image forming apparatus.

The copier 100 in FIG. 1 includes a main body 102 thereof, a sheet feeding device 103 on which the main body 102 of the copier 100 is mounted, an image scanning device 104 attached on the main body 102 of the copier 100, a sheet eject tray 109, a fixing device 111, a transfer device 113, and a sheet reversing device 142.

The main body 102 of the copier 100 includes an image forming section for performing a given image forming process based on a scanned original image.

The sheet feeding device 103 supplies one sheet S at a time to the main body 102 of the copier 100. The sheet feeding device 103 includes a sheet conveying device 105. The sheet conveying device 105 includes a first conveying unit 106 and a second conveying unit 107 and is configured to feed and convey the sheets S stored in sheet feeding cassettes 151 of the sheet feeding device 103.

The image scanning device 104 scans an original image and sends information of the original image to the main body 102 of the copier 100.

The sheet eject tray 109 receives and holds/stacks sheets that have passed through the main body 102 of the copier 100.

The fixing device 111 fixes a transferred toner image onto a sheet.

The transfer device 113 transfers a toner image from a circumferential surface of a photoconductor 110A of an image forming device 110 onto a sheet, and conveys the sheet, on which an unfixed toner image is formed, to the downstream side of a sheet conveying path Ra of the sheet reversing device 142.

The sheet reversing device 142 conveys a sheet back and forth along the sheet conveying path Ra and/or a manual sheet conveying path Rb and a reverse conveying path Rc to reverse the sides of the sheet S.

In the copier 100 of FIG. 1, a pickup roller 160 picks up a sheet S placed on top of a stack of sheet stacked and stored in one of the sheet feeding cassettes 151. When two or more sheets S are picked up by the pickup roller 160, one sheet in contact with a feed roller 161 of the first conveying unit 106 is separated from the other sheet(s) in contact with a reverse roller 162 of the first conveying unit 106. Then, the sheet S separated and fed by the feed roller 161 is conveyed to a pair of grip rollers 181 of the second conveying unit 107 disposed in a downstream side of the first conveying unit 106. The sheet S conveyed to the pair of grip rollers 181 abuts a leading edge thereof against a position immediately before a nip contact of a pair of registration rollers 121 disposed at a downstream side in a travel direction of the sheet S. When the leading edge of the sheet S abuts against the above-described position, the sheet S stops to change or adjust its position so that a given bend can be provided at the leading edge thereof and skew or positional instability thereof can be prevented. At a given timing in synchronization with a completion of an image forming operation on the photoconductor 110A, the pair of registration rollers 121 again starts to convey the sheet S to the transfer device 113.

The copier 100 of FIG. 1 employs a feed reverse roller (FRR) sheet separation mechanism, which uses a return separating method. However, a mechanism of separating and feeding a sheet at a separation position is not limited to the FRR sheet separation mechanism. For example, a sheet separation mechanism using a frictionally resisting member or a friction pad sheet separation mechanism that has a simple and inexpensive configuration can be applied to the sheet separation mechanism for the copier 100 of FIG. 1.

To reduce a time period from the sheet S is fed from the sheet feeding cassette 151 to the sheet S is ejected to the sheet eject tray 109, the sheet conveying path Ra extending from the sheet feeding device 103 to the fixing device 111 is directed to a substantially vertically upward direction or a direction substantially perpendicular to a horizontal direction.

A common conveying path is also provided so that the reversed sheet S can be conveyed through the reverse conveying path Rc of the sheet revering device 142 to the pair of registration rollers 121.

Further, a manual sheet feeding tray 167 serving as a manual sheet feeding device is provided outside the main body 102 of the copier 100, below the reverse conveying path Rc. The manual sheet feeding tray 167 includes manual sheet feeding members such as a sheet feeding roller 167A and separating rollers 167B and 167C. The sheet S fed from the manual sheet feeding tray 167 is conveyed via the manual sheet conveying path Rb toward the pair of grip rollers 181 provided in the vicinity of the upper sheet feeding cassettes 151. Accordingly, the common conveying path is provided before the pair of grip rollers 181 of the upper sheet feeding cassettes 151.

The above-described technique related to the copier 100 is called a first technique.

Furthermore, there is another technique for handling sheets. For example, the related-art image forming apparatuses generally accommodate sheets having various sizes. In such a related-art image forming apparatus, sheets of different sizes (or referred to as a "sheet size") and different types (or referred to as a "sheet type") are previously stored in multiple sheet storing units corresponding to respective sizes and types. A sheet may be fed from the sheet storing unit selected manually by a user or automatically by an image forming apparatus. In such a configuration, each sheet storage unit occupies a large space in the related-art image forming apparatus, and therefore, it is particularly necessary to reduce the size of the related-art conveying unit.

One approach is to have a sheet conveying path, provided between the sheet storing unit and a main body of a related-art image forming apparatus, to considerably bend or change its direction midway depending on the relative positions of the sheet storing unit and the main body, so as to reduce the space occupied by the sheet conveying path. Thus, the sheet conveying path is provided with a curved section in order to change the sheet conveying direction in a continuous and smooth manner. The curved section includes a relatively small curvature radius so as to convey a regular-sized recording sheet normally used in the related-art image forming apparatus.

In this technique or a second technique used in a sheet conveying device of a related-art image forming apparatus, sheet feed trays serving as sheet storing units are arranged beneath a main body of the related-art image forming apparatus. Given numbers of sheets of given sheet sizes and sheet types are stacked in the sheet storing units. In between the sheet storing units and the main body of the related-art image forming apparatus, a sheet conveying unit is provided for extracting a sheet in a substantially horizontal direction from the selected sheet storing unit and feeding the extracted sheet in an upward direction toward the main body of the image forming apparatus disposed above.

A sheet in a sheet storing unit is separated from the stack of sheets by a related-art feed reverse roller (FRR) sheet separation mechanism, and is sent to the main body of the related-art image forming unit through a sheet conveying path provided with a curved section including an upper guide plate and a lower guide plate, each of which serves as a guide member for fixing a curved section. As the sheet is conveyed or travels further on, the sheet is pressed from above by the upper guide plate. The sheet is conveyed by an elastically deformable guide piece positioned at the outlet end of the lower guide plate and reaches a pair of conveying rollers. Hereinafter, the upper guide plate and the lower guide plate are also referred to as the "curve fixing guide member."

However, in the sheet conveying device with the above-described configuration, the following problem arises when conveying a specific type of sheet with high rigidity, such as a cardboard recording paper or an envelope. That is, when the sheet bends and moves along the curved section, such a highly rigid recording paper or special paper encounters much greater resistance compared to a regular sheet such as plain paper used for copying because the curved section in the sheet conveying path has a small radius. As a result, the highly rigid sheet cannot move smoothly along the sheet conveying path, causing a paper jam or a conveyance failure. Thus, the sheet feeding operation cannot be reliably performed.

In order to facilitate the understanding of the related art and its problems, a more detailed description is now given of the above-described conveyance operation.

When the leading edge of the sheet in the sheet conveying direction reaches the curve fixing guide member configured with the upper guide plate and the lower guide plate, the front half of the sheet including the leading edge of the sheet curves or bends in its thickness direction. Accordingly, when a highly rigid sheet is conveyed, a large force resists this bending action and obstructs the sheet conveying operation. As a result, the leading edge of the highly rigid sheet may not reach the pair of conveying rollers at the downstream side of the sheet conveying direction, with the result that the sheet may be conveyed only by a pair of rollers on the upstream side thereof. However, when the sheet is bent by the guide member, the conveying force of the pair of rollers alone may be insufficient for conveying the highly rigid sheet against the resistance caused by the bending action. As a result, the sheet may be moved obliquely because the center-line of the highly rigid sheet is not aligned with the center-line of the sheet conveying path, or a paper jam occurs because the highly rigid sheet is caught inside the guide member and stops moving.

Accordingly, the above-described sheet conveying device with the second technique has been proposed, in which a sheet is sent out from a first conveying member and then conveyed to a second conveying member disposed downstream of the first conveying member in the conveying direction and substantially vertically above the first conveying member. A pair of linear guide members is provided between the first conveying member and the second conveying member, and the sheet is conveyed while guided by these linear guide members. In this sheet conveying device, the guide members are not curved shapes but linear, and therefore the conveyance load can be maintained at a low level. That is, the conveyance load can be prevented from rising abruptly, thus enabling such conveyance failures such as paper jams or oblique movements to be prevented.

That is, according to the above-described sheet conveying device, the conveyed sheet is not deformed or bent only at one position, but is deformed at two positions, i.e., near the upstream, or front end, and downstream, or back, end of the linear guide members in the sheet conveying direction. Furthermore, the linear guide members are disposed obliquely at substantially intermediate angles, so that the sheet may bend by the same amount at the above-described two positions. Therefore, the conveyance load may be prevented from rising abruptly. Specifically, the sheet may change its traveling direction by bending at the two positions, namely, when the sheet is passed from the pair of rollers located at the upstream side of the sheet conveying or travel direction to the linear guide member, and when the sheet is passed from the linear guide member to the pair of rollers located at the downstream side of the sheet travel direction. Thus, the sheet bends less at these two positions than when the sheet abruptly bends at one position only, and therefore the resistance caused by the bending action of the sheet can be reduced at each of the two positions, thereby preventing the conveyance load from rising abruptly.

Another type of sheet conveying device with a first conveying member and a second conveying member having substantially the same configurations as the above-described sheet conveying device employing the second technique includes a reverse guide member provided at an incline between the first conveying member and the second conveying member, and configured to move toward the second conveying member.

In this sheet conveying device, when the trailing edge of the sheet contacts the reverse guide member, the reverse guide member shifts its position in a direction substantially according to the trailing edge of the sheet. This shift makes it possible to absorb the shock or impact caused when the trailing edge of the sheet contacts the reverse guide member. Hence, a flipping noise can be reduced.

Yet another type of sheet conveying device with third technique different from the first and second techniques has been proposed that includes multiple sheet storing units for storing sheets, and each of the sheet storing units is provided with a sheet conveying path and a sheet conveying unit. The ends of the sheet conveying paths merge into a common conveying path. Each of the sheet conveying paths has a curved section at the end thereof, at which each sheet conveying path merges with the common conveying path. At least one of the sheet conveying paths provided for a sheet storing unit that stores or accommodates highly rigid sheets has a first curved section with a larger curvature radius than those of the other sheet conveying paths.

Therefore, in this sheet conveying device, highly rigid sheets are bent more moderately compared to plain paper sheets. A highly rigid sheet moves along the sheet conveying path and passes via the first curved section having a large curvature radius, so that the sheet may not bend as much as a plain paper sheet passing via a curved section having a smaller curvature radius. Accordingly, it is possible to reduce the resistance while conveying a highly rigid sheet, so that the sheet can be conveyed to the common conveying path without being suspended or stopped.

A sheet reversing unit employing another technique and provided in a related-art image forming apparatus is now described.

The sheet reversing unit includes a pair of reverse rollers and a reverse conveying path for conveying and guiding a sheet received from the pair of reverse rollers. The reverse conveying path includes a redirection section for changing the direction of conveying a sheet. Rotatable members or rollers are arranged inside the redirection section in a direction orthogonal or perpendicular to the sheet conveying direction, so that a sheet sent into the reverse conveying path can be sent out while abutting the rollers.

According to this sheet reversing unit, when a sheet is sent inside, it is ensured that the portion of the sheet inside the redirection section contacts the rollers, and the rollers are caused to rotate by or following the movement of the sheet in the sheet conveying direction. Thus, compared to a related-art guiding plate, the conveying resistance can be reduced. Specifically, it is possible to eliminate a frictional resistance occurring between a fixed guide member and the moving sheet while changing the conveying direction of the sheet at the redirection section.

However, the first technique shown in FIG. 1 cannot respond to recent demands for a further width-size reduction of an image forming apparatus and for stable quality in transferring various sheets having different sizes from the first sheet conveying path and the second sheet conveying path.

However, the sheet conveying device using the second technique merely provides a fixed guide member for guiding a conveyed sheet, and thus does not eliminate the speed difference between the moving conveyed sheet and the fixed guide member. Accordingly, regardless of the shape or position of the guide member, resistance occurs in such a direction as to obstruct the sheet from being conveyed, which generating a conveyance load.

That is, this related-art configuration is insufficient for preventing conveyance failures or paper jams. Although the linear guide member can reduce the conveyance load from rising abruptly, a conveyance load is generated nonetheless. Particularly when conveying a highly rigid sheet, such as a cardboard recording paper or an envelope, conveyance failures and paper jams frequently occur and flipping noises made by the trailing edge of the sheet increase considerably.

Furthermore, as described with reference to the sheet conveying device with the second technique, the reverse guide member can shift or change its position in a direction according to the trailing edge of the sheet contacting the reverse guide member. However, the reverse guide member merely functions as a fixed guide member in terms of changing the direction of the sheet. Accordingly, as with the related-art configuration described above, this related-art technique does not eliminate the relative speed difference between the sheet and the reverse guide member when changing the direction of the sheet and guiding the sheet, thus generating a conveyance load. Particularly when conveying a highly rigid sheet, such as a cardboard recording paper or an envelope, conveyance failures and paper jams frequently occur and flipping noises caused by the trailing edge of the sheet increase considerably.

Furthermore, as described in reference to the sheet conveying device with the third technique, the sheet conveying path with a large curvature radius dedicated to highly rigid sheets makes it possible for sheets traveling therethrough to bend moderately so as to reduce the conveyance resistance applied by the sheet conveying path to the sheet. However, a conveyance load is still generated nonetheless, and therefore, particularly when conveying a highly rigid sheet, such as a cardboard recording paper or an envelope, conveyance failures and paper jams frequently occur.

Furthermore, as described in reference to the sheet reversing unit with the fourth technique, movable members such as rollers are provided at given positions inside the redirection section of the sheet conveying path. Therefore, in the process of conveying the sheet, the frictional resistance between the sheet and the guiding member can be effectively reduced while the internal rollers are supporting the middle portion of the sheet between the leading edge and the trailing edge. However, there are no measures provided for reducing the conveyance load before and after the sheet is supported by the internal rollers, i.e., when the sheet is in contact with the sheet conveying path outside the redirection section. Furthermore, no particular description is made of movements of the leading edge and the trailing edge of the sheet while being conveyed. Particularly when conveying a highly rigid sheet such as a cardboard recording paper or an envelope, conveyance failures and paper jams frequently occur and flipping noises caused by the trailing edge of the sheet increase considerably.

In light of the foregoing, the inventors of the present patent application have previously proposed to provide a sheet conveying device and an image forming apparatus including a sheet conveying device that can eliminate the drawbacks of the above-described techniques, specifically, by providing a sheet conveying device that is compact and space-saving, that includes a simple configuration achieved at low cost, and that can handle various types of sheets, and an image forming apparatus that includes such sheet conveying device.

SUMMARY

In light of the foregoing, the inventors of the present application propose to provide, in at least one embodiment, a sheet conveying device and an image forming apparatus including a sheet conveying device that can reduce or even eliminate at least one of the drawbacks of the above-described techniques. In at least one embodiment, a sheet conveying device is provided that is compact and space-saving, that includes a simple configuration achieved at low cost, that can handle various types of sheets, and that can convey various types of sheets in a stable transfer quality and increase flexibility of the design thereof, and an image forming apparatus that includes such sheet conveying device.

One or more embodiments of the present patent application have been made, taking the above-described circumstances into consideration.

An embodiment of the present patent application provides a sheet conveying device that includes a first sheet conveying path, having a curved portion, to feed and convey a sheet therethrough, a second sheet conveying path, having a curved portion different from the first sheet conveying path, to feed and convey the sheet therethrough, a third sheet conveying path provided from a confluence of the first sheet conveying path and the second sheet conveying path, and a belt-type sheet conveying unit disposed on one side of the third sheet conveying path corresponding to an outer side of the curved portion of the first sheet conveying path and an inner side of the curved portion of the second sheet conveying path.

The above-described sheet conveying device may further include a first sheet feeding member, disposed upstream of the first sheet conveying path, to feed the sheet, a second sheet feeding member, disposed upstream of the second sheet conveying path, to feed the sheet, and a hold and transfer unit, disposed at an upstream side of the third sheet conveying path, including a holding section to hold and transfer the sheet. With the above-described configuration, when a constant interval in a width direction of the sheet conveying device is provided between the first sheet feeding member and the second sheet feeding member, a curvature radius of the second sheet conveying path may be greater with the belt-type sheet conveying unit provided than without the belt-type sheet conveying unit provided.

The above-described sheet conveying device may further include a hold and transfer unit, disposed at a downstream side of the third sheet conveying path, including a sheet holding section to hold and transfer the sheet. The hold and transfer unit may further include the belt-type sheet conveying unit and a rotary feed driving member to rotate to transmit a driving force. The belt-type sheet conveying unit may be disposed facing the rotary feed driving member and provided with a belt to rotate with the rotary feed driving member and to contact a surface of the sheet conveyed from the second sheet conveying path toward the holding section of the hold and transfer unit to increase a conveying force on the sheet.

The belt-type sheet conveying unit may be disposed to give the first sheet conveying path a curvature radius smaller than a curvature radius of the second sheet conveying path.

The belt-type sheet conveying unit may be disposed to guide the sheet conveyed thereto via the first sheet conveying path to bend back along a sheet travel direction.

The first sheet conveying path may include a guide member to guide a leading edge of the sheet to approach the belt-type sheet conveying unit at an acute angle.

The above-described sheet conveying device may further include a hold and transfer unit, disposed at a downstream side of the third sheet conveying path, including a sheet holding section to hold and transfer the sheet. The hold and transfer unit may further include the belt-type sheet conveying unit and a rotary feed driving member to rotate to transmit a driving force. The belt-type sheet conveying unit may be disposed facing the rotary feed driving member and provided with a belt extended around a first rotary belt holding member and at least one second rotary belt holding member, to rotate with the rotary feed driving member and to contact a surface of the sheet to increase a conveying force on the sheet. The first rotary belt holding member may rotate with the rotary feed driving member disposed opposite the first rotary belt holding member via the belt. The at least one second rotary belt holding member may be disposed upstream of the first rotary belt holding member in the sheet travel direction. The second sheet conveying path has an inner portion formed by a guide member having a guide surface to guide the sheet. A rotary sheet feeding member may be disposed upstream from the at least one second rotary belt holding member along the second sheet conveying path, and feed the sheet. The guide surface may be more medially located than a tangent line connecting a distal end of the first rotary belt holding member and a distal end of the at least one second rotary belt holding member and a tangent line connecting the distal end of the at least one second rotary belt holding member and a distal end of the sheet feeding member.

The at least one second rotary belt holding member may be located to cause an angle formed by a distal end of the at least one second rotary belt holding member and the guide surface to form an obtuse angle.

At least one embodiment of the present patent application provides a sheet conveying device that includes a hold and transfer unit, disposed at a downstream side of a sheet conveying path formed in a curved manner to feed a sheet, including a sheet holding section to hold and transfer the sheet. The hold and transfer unit may include a rotary feed driving member to rotate to transmit a driving force, and a belt-type sheet conveying unit, disposed facing the rotary feed driving member and at an inner portion of the sheet feeding path, provided with a belt to rotate with the rotary feed driving member and to contact a surface of the sheet to increase a conveying force on the sheet. At least a part of the sheet feeding path may include the belt-type sheet conveying unit and a guide member disposed facing the belt-type sheet conveying unit.

At least one embodiment of the present patent application provides an image forming apparatus that includes a main body to perform an image forming operation, and a sheet conveying device to feed and transfer a sheet thereto. The sheet conveying device includes at least one sheet feeding path.

The at least one sheet feeding path may include a first sheet conveying path, having a curved portion, to feed and convey a sheet therethrough, a second sheet conveying path, having a curved portion and different from the first sheet conveying path, to feed and convey to feed and convey the sheet therethrough, and a third sheet conveying path provided from a confluence of the first sheet conveying path and the second sheet conveying path. The sheet conveying device may further include a belt-type sheet conveying unit disposed on one side of the third sheet conveying path corresponding to an outer side of the curved portion of the first sheet conveying path and an inner side of the curved portion of the second sheet conveying path.

The above-described image forming apparatus may further include a manual sheet conveying device, mounted on one side of the above-described image forming apparatus, to feed the sheet loaded therein to the main body thereof. The manual sheet conveying device may be disposed on a side of the above-described image forming apparatus where the second sheet conveying path is provided.

The above-described image forming apparatus may further include an image forming device, provided in the main body at a downstream side of the belt-type sheet conveying unit, to form an image on the sheet conveyed via the belt-type sheet conveying unit, and a reverse conveying path to reverse surfaces of the sheet having the image formed thereon by the image forming device. The reverse conveying path may merge with the second sheet conveying path.

The belt-type sheet conveying unit may be disposed to guide the sheet conveyed thereto via the first sheet conveying path to bend back along a sheet travel direction.

The above-described image forming apparatus may further include an image forming device provided in the main body at a downstream side of the belt-type sheet conveying unit to form an image on the sheet conveyed via the belt-type sheet conveying unit, and a reverse conveying path to reverse surfaces of the sheet having the image formed thereon by the image forming device. The reverse conveying path may merge with the third sheet conveying path provided downstream of the belt-type sheet conveying unit.

The above-described image forming apparatus may further include a high-capacity sheet conveying device, disposed on one side of the above-described image forming apparatus, to feed the sheet therefrom to the image forming apparatus. The high-capacity sheet conveying device may be provided on a side of the above-described image forming apparatus where the second sheet conveying path is provided.

The sheet conveying device may further include a hold and transfer unit, disposed at a downstream side of a sheet feeding path formed in a curved manner to feed a sheet, including a holding section to hold and transfer the sheet. The hold and transfer unit may include a rotary feed driving member to rotate to transmit a driving force, and a belt-type sheet conveying unit disposed facing the rotary feed driving member and at an inner portion of the sheet feeding path and provided with a belt to rotate with the rotary feed driving member and to contact a surface of the sheet to increase a conveying force on the sheet. At least a part of the sheet feeding path including the belt-type sheet conveying unit and a guide member disposed facing the belt-type sheet conveying unit.

BRIEF DESCRIPTION OF THE DRAWINGS

The accompanying drawings are intended to depict example embodiments of the present patent application and should not be interpreted to limit the scope thereof. The accompanying drawings are not to be considered as drawn to scale unless explicitly noted.

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF EXAMPLE EMBODIMENTS

Figure 1:
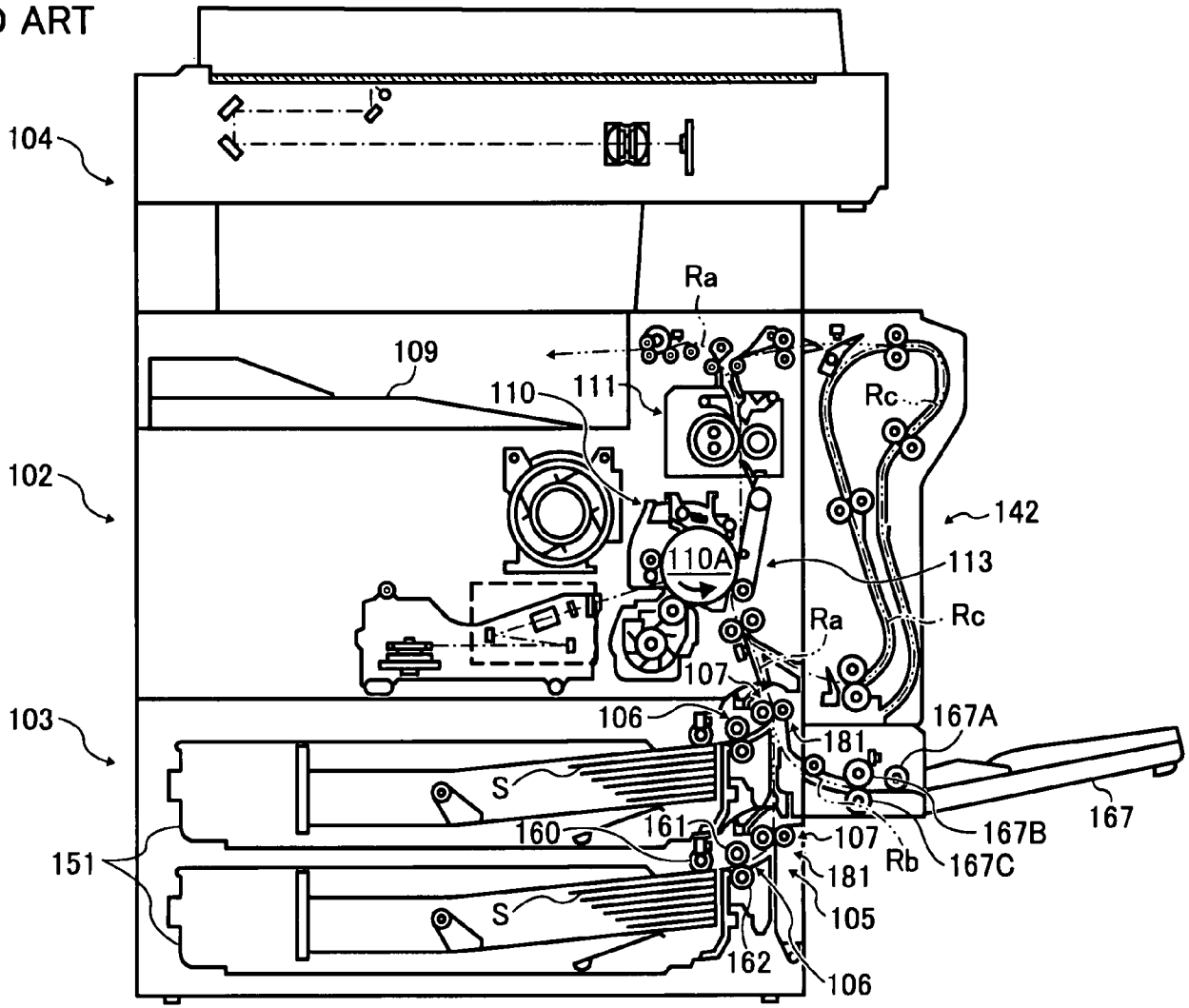
FIG. 1 BACKGROUND ART
FIG. 1 is a cross-sectional view of a schematic entire configuration of a related-art image forming apparatus.

It will be understood that if an element or layer is referred to as being "on", "against", "connected to" or "coupled to" another element or layer, then it may be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" may encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present patent application.

The terminology used herein is for the purpose of describing example embodiments only and is not intended to be limiting of the present patent application. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this patent application is not intended to be limited to the specific terminology so selected and it is to be understood that each specific element includes all technical equivalents that operate in a similar manner.

Referring now to the drawings, wherein like reference numerals designate identical or corresponding parts throughout the several views, example embodiments of the present patent application are described.

Now, example embodiments of the present patent application are described in detail below with reference to the accompanying drawings.

Descriptions are given, with reference to the accompanying drawings, of examples, example embodiments, modification of example embodiments, etc., of a sheet conveying device according to the present patent application, and an image forming apparatus including the same. Elements having the same functions and shapes are denoted by the same reference numerals throughout the patent application and redundant descriptions are omitted. Elements that do not require descriptions may be omitted from the drawings as a matter of convenience. Reference numerals of elements extracted from the patent publications are in parentheses so as to be distinguished from those of example embodiments of the present application.

FIGS. 2 through 13 show schematic configurations and functions of examples of sheet conveying devices to which the present patent application is applied, and an image forming apparatus including the same.

Figure 2:
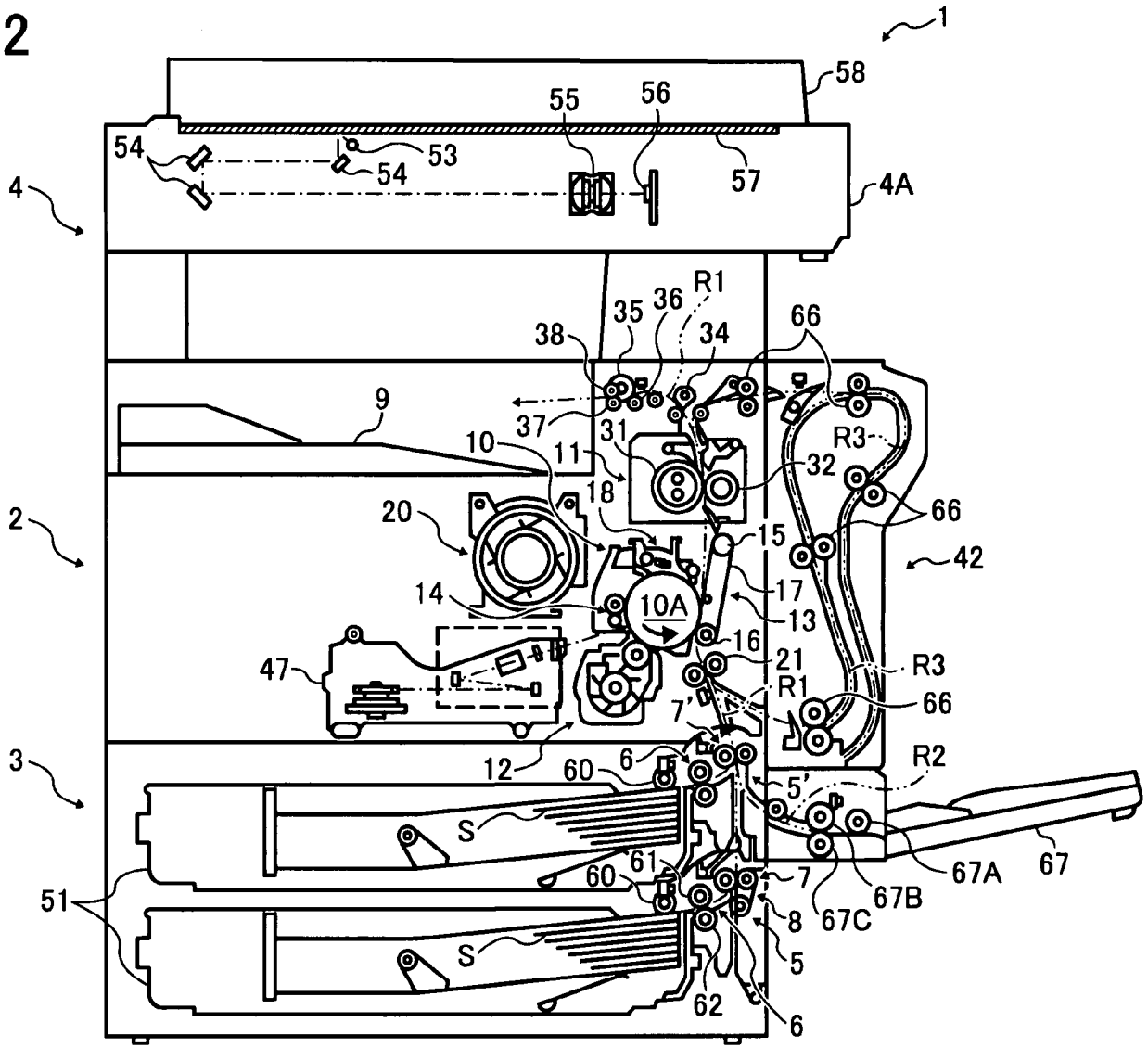
FIG. 2 is a cross-sectional view of a schematic entire configuration of an image forming apparatus, according to an example embodiment of the prevent invention.

Referring to FIG. 2, an overall configuration of a copier 1 serving as an image forming apparatus is described according to an example of the present patent application.

The copier 1 is a monochrome copier that scans an image from a face of an original document and forms a copied image onto various sheet-type recording media such as recording paper, transfer paper, paper sheets, and overhead projector (OHP) transparencies. Hereinafter, a recording medium is referred to as a "sheet."

The copier 1 includes a main body 2 thereof, a sheet feeding device 3 on which the main body 2 of the copier 1 is mounted, and an image scanning device 4 attached on the main body 2 of the copier 1.

The main body 2 of the copier 1 includes an image forming section or image forming unit for performing a given image forming process based on a scanned original image.

The sheet feeding device 3 supplies one sheet S at a time to the main body 2 of the copier 1.

The image scanning device 4 scans an original image and sends information of the original image to the main body 2 of the copier 1.

A sheet eject tray 9 is provided at the upper portion of the main body 2 of the copier 1, forming a space beneath the image scanning device 4. Sheets that have passed through the main body 2 of the copier 1 are ejected to and stacked on the sheet eject tray 9.

A sheet conveying path R1 extends from the sheet feeding device 3 to the sheet eject tray 9. A large proportion of the sheet conveying path R1 may extend between the sheet feeding device 3 and the upper portion of the main body 2 in a substantially vertical direction with respect to a substantially horizontal direction.

Sheet conveying units including pairs of conveying rollers and pairs of subordinate rollers may be provided along the sheet conveying path R1 with given intervals therebetween determined according to the smallest size of sheet S. Some of these sheet conveying units may be configured to sandwich or hold the sheet S to ensure that the sheet S continues to be conveyed along the sheet conveying path R1.

Furthermore, the sheet feeding device 3 includes a sheet conveying device 5 configured to feed and convey the sheets S stored in paper trays of the sheet feeding device 3 to a pair of registration rollers 21 disposed in the sheet conveying path R1.

Inside the main body 2 of the copier 1 in FIG. 2, a photoconductor unit 10 serving as an image forming device and a fixing device 11 serving as an image fixing device, both of which are included in the image forming section, are disposed in this order from the upstream side toward the downstream side of the sheet conveying path R1. As the sheet S is conveyed from the upstream side toward the downstream side of the sheet conveying path R1, the photoconductor unit 10 may transfer a toner image that is generated onto the sheet S and the fixing device 11 may fix the transferred toner image onto the sheet. S. The sheet S on which the fixed toner image is formed may be ejected onto the eject tray 9 that is disposed at the end of the sheet conveying path R1.

The photoconductor unit 10 includes a single drum-type photoconductor 10A serving as an image carrier. The photoconductor 10A is supported by a side panel, not shown, inside the main body 2 of the copier 1 so as to rotate around a substantially horizontal axis.

The photoconductor 10A may have a cylindrical shape of a given diameter and a generally known configuration. The photoconductor 10A may receive a rotational driving force from a driving source such as a motor provided on one end of the photoconductor 10A, either on the photoconductor unit 10 side or on the main body 2 of the copier 1. Accordingly, the photoconductor 10A may rotate in a direction indicated by an arrow shown in FIG. 2 at a steady and constant speed.

Around the photoconductor 10A, image forming elements are disposed in the following order in the direction indicated by the arrow, which is an order of a developing device 12, a transfer device 13, a photoconductor cleaning device 18, a discharging device, not shown, and a charging device 14. Within a range corresponding to one rotation period of the photoconductor 10A in the counterclockwise direction, given operation positions such as a developing position of the developing device 12, a transferring position of the transfer device 13, a cleaning position of the photoconductor cleaning device 18, a discharging position of the discharging device, and a charging position of the charging device may be determined from upstream to downstream positions.

Between the charging position and the developing position, there is a latent image forming position. An exposing device 47 is provided at a position somewhat spaced apart from and diagonally downward from the photoconductor 10A. At the latent image forming position, the exposing device 47 may emit a given laser beam to irradiate the photoconductor 10A so as to form an invisible latent image thereon according to image data. In synchronization with the rotation of the photoconductor 10A in the counterclockwise direction, the above-described image forming components and the exposing device 47 may perform interlinked operations so as to execute a sequence of an image forming process in cooperation with each other.

The developing device 12 has an appropriate, generally known configuration including a developing roller for generating a toner brush by causing toner particles to stand erect on the surface of the developing device 12 in a radial direction. The developing device 12 may cause the toner particles at the tips of the toner brush to adhere onto the latent image formed on a given position on the surface of the photoconductor 10A; as the latent image moves in a circumferential direction of the photoconductor 10A and pass through the developing position in accordance with the rotation of the photoconductor 10A. Accordingly, the invisible latent image may be turned into a visible and monochrome toner image.

The transfer device 13 in FIG. 2 includes two supporting rollers 15 and 16 spaced apart from each other in a substantially vertical direction and a transfer belt 17, which is an endless belt stretched around the supporting rollers 15 and 16. The transfer device 13 may transfer the toner image from the circumferential surface of the photoconductor 10A onto the sheet S, and convey the sheet S onto which an unfixed toner image is transferred to the downstream side of the sheet conveying path R1. Specifically, a portion of the lower supporting roller 16 where the transfer belt 17 may be stretched around may be pressed against a substantially diagonally downward right portion of the photoconductor 10A, and the transferring position may correspond to a position at which the surface of the photoconductor 10A and the surface of the transfer belt 17 contact to each other. The upper supporting roller 15 may be disposed in front of the inlet of the fixing device 11.

The photoconductor cleaning device 18 may include either one or both of a blade, not shown, and a rotating brush, not shown. The blade may have a blade edge at the tip thereof that abuts against the cleaning position on the photoconductor 10A while maintaining a given pressure level. The rotating brush may contact the cleaning position and be caused to rotate following the rotation of the photoconductor 10A. The photoconductor cleaning device 18 may remove toner or foreign materials remaining on the surface of the photoconductor 10A after the transfer operation.

The discharge device is primarily configured with a lamp that can emit a light beam of a given light intensity. This lamp may emit a light beam used for the discharging operation onto the discharging position to neutralize the charged surface of the photoconductor 10A passing by the discharging position. Accordingly, the discharge device can initialize the surface potential of the photoconductor 10A that had passed by the transferring portion.

The fixing device 11 includes a heating roller 31 with a built-in electrothermal heater serving as a heat source and a pressing roller 32 facing and pressed against the heating roller 31 in a substantially horizontal direction. When the heating roller 31 is rotated by a driving source, not shown, such as a motor, the pressing roller 32 in contact with the heating roller 31 may be caused to rotate following the rotation of the heating roller 31. At the same time, the portion at which the heating roller 31 and the pressing roller 32 contact with each other along a width direction perpendicular to the sheet travel direction may have a given heating temperature and given pressure so as to function as a nip contact for fixing the toner image onto the sheet.

In FIG. 2, the main body 2 of the copier 1 further includes a toner storing container 20, which is a toner bottle storing unused toner and/or new toner. A toner conveying path, not shown, may extend from the toner storing container 20 to the developing device 12. When the developing device 12 has consumed the toner provided therein and there is a toner shortage, the newly replenished toner may be supplied from the toner storing container 20 into the developing device 12.

The sheet feeding device 3 is provided beneath the main body 2 of the copier 1, so that the sheet size can be chosen automatically or according to a user's manual input. The sheet feeding device 3 of FIG. 2 includes multiple sheet feeding cassettes 51 serving as sheet storing units arranged in multiple stages. Each of the sheet feeding cassettes 51 can be individually pulled outside of the sheet feeding device 3 so that an appropriate number of sheets having a size according to the individual sheet feeding cassette 51 can be replenished. Different types of sheets S that are of various sheet sizes and oriented in vertical or horizontal directions with respect to the sheet conveying direction are stacked and/or stored in the sheet feeding cassettes 51.

Further, a manual sheet feeding tray 67 is provided outside the body of the copier 1, below a reverse conveying path R3. The manual sheet feeding tray 67 serving as a manual sheet feeding device includes a sheet feeding roller 67A, and separating rollers 67B and 67C, each serving a manual sheet feeding member forming a manual sheet feeding mechanism or unit. The sheet S fed from the manual sheet feeding tray 67 is conveyed via a manual sheet conveying path R2 toward a reference body of the copier 1. The reference body of the copier 1 includes the main body 2 and the sheet feeding device 3.

Further, the main body 2 of the copier 1 of FIG. 2 further includes a sheet reversing device 42 that is provided with the reverse conveying path R3 through which a sheet having an image formed and fixed on one surface thereof is conveyed and reversed. The sheet reversing device 42 includes multiple pairs of rollers 66 rotated by a driving mechanism, not shown, and conveying guide members disposed facing each other. A downstream end of the reverse conveying path R3 meets and merges with the sheet conveying path R1 provided between the pair of registration rollers 21 and an upper second conveying unit 7', which is a known conveying unit including a pairs of grip rollers that is not shown. Accordingly, the sheet conveying path R1 may include a common conveying path that corresponds to a part of the sheet conveying path R1 and is formed from the merged portion or confluence of the sheet conveying path R1 and the reverse conveying path R3 and toward the downstream side thereof.

A detailed description of the manual sheet conveying path R2 will be given later. It is, however, noted that the sheet conveying path R1, the manual sheet conveying path R2, and the reverse conveying path R3 have respective structures each of which including conveying guide members disposed facing each other and spaced apart by a given distance to form a path.

The image scanning device 4 includes a main body 4A thereof serving as a framework of the image scanning device 4. On top of the main body 4A, an exposure glass 57 is disposed across a given range. A scanning unit may be housed inside the main body 4A of the image scanning device 4 for optically scanning an original image by scanning the given range of the exposure glass 57. The scanning unit primarily includes at least a first moving member 53, second moving members 54, and an image forming lens 55, and a scanning sensor 56 such as a CCD.

The image scanning device 4 includes a platen cover 58 configured to open and close between a closed position covering the exposure glass 57 and an open position. The platen cover 58 is disposed on the top surfaced of the main body 4A of the image scanning device 4. The platen cover 58 has larger length/width sizes than those of the exposure glass 57, and one side thereof is fixed to the top surface of the main body 4A of the image scanning device 4 so as to freely open and close.

On the basis of the above-described configuration, the copier 1 may be operated as described below.

First, in order to make a copy of an original document with the copier 1, a user manually opens the platen cover 58 of the image scanning device 4 from the closed position to the open position, places and sets the original document on the exposure glass 57, and then manually brings the platen cover 58 to the closed position, so that the platen cover 58 can press the original document set on the exposure glass 57 from above. Accordingly, the original document spreads out in a planar manner in close contact with the exposure glass 57 so that the original document face can be scanned accurately, and the original document can be fixed on the exposure glass 57.

As the user presses a start key of an operation panel section, not shown, initially provided in the copier 1, a scanning operation of the image scanning device 4 immediately starts, and a driving mechanism, not shown, causes the first moving member 53 and the second moving member 54 to travel. A light beam from a light source of the first moving member 53 may be emitted toward the original document, and the light beam may be reflected from a surface of the original document and is directed toward the second moving member 54.

The light beam may then be reflected by a mirror of the second moving member 54, and the light beam may enter the scanning sensor 56 via the imaging lens 55. As a result, the image of the original document can photo-electrically be converted and scanned by the scanning sensor 56.

When the start key is pressed, the photoconductor 10A of the photoconductor unit 10 starts rotating and an operation starts for forming a toner image on the photoconductor 10A based on the scanned original image. Specifically, as the photoconductor 10A rotates, a given position on the circumferential surface of the photoconductor 10A may sequentially pass by the respective positions between the charging device 14, the exposing device 47, the developing device 12, the transfer device 13, the photoconductor cleaning device 18, and the discharging device. Accordingly, the given position on the photoconductor 10A may be charged to a given charged status, a latent image may be generated thereon, and the latent image may be turned into a visible toner image. The toner image may then be transferred onto the sheet S, residual toner may be removed from the photoconductor 10A, and the charged status may be cancelled. Thus, one cycle of operations may be completed in the above-described order of the developing device 12, the transfer device 13, the photoconductor cleaning device 18, the charging device, and the charging device 14. The above-described cycle of the image forming operation may be continued until the toner image is created in an area of a given size on the circumferential surface of the photoconductor 10A in the rotational direction, according to the size of the image to be formed.

When the start key is pressed, one sheet S may be extracted from the sheet feeding cassette 51 in the sheet feeding device 3 corresponding to the sheet feeding stage storing the type of sheet S selected automatically or manually, and the extracted sheet S may be fed to the sheet conveying path R1 via a given sheet conveying path, which may be a branch of the sheet conveying path R1, by the sheet conveying device 5 attached to the corresponding sheet feeding stage of the sheet feeding device 3. This sheet S may be conveyed in a substantially vertically upward direction through the sheet conveying path R1 in the main body 2 of the copier 1 by conveying rollers, and may temporarily be stopped when the leading edge of the sheet S abuts against the pair of registration rollers 21 that serves as a registration unit to correct a positional condition of a sheet.

When performing a manual sheet feeding operation, the sheet S may set on the manual sheet feeding tray 67, and may be rolled out by the rotation of the sheet feeding roller 67A provided for the manual sheet feeding tray 67. When multiple sheets S are stacked and set on the manual sheet feeding tray 67, the separating rollers 67B and 67C may separate the sheets S one by one. The sheet S may travel via the manual sheet conveying path R2 and the sheet conveying path R1 in this order, and temporarily stop when the leading edge of the sheet S abuts against the pair of registration rollers 21.

The pair of registration rollers 21 may start rotating at an accurate timing in synchronization with the relative movement of the toner image on the rotating photoconductor 10A so as to convey the sheet S, which has temporarily been stopped, into the transferring position. As a result, the toner image may be transferred onto the sheet S by the transfer device 13.

The sheet S, onto which an unfixed monochrome toner image is transferred, may then be conveyed to the fixing device 11 by the transfer belt 17 of the transfer device 13 serving as part of the sheet conveying path R1. The sheet S may pass through a nip contact of the fixing device 11. The nip contact may apply given heat and pressure onto the sheet S so that the image can be fixed onto the sheet S. The sheet S with the fixed image may be guided by a switching claw 34 to the sheet conveying path R1 that extends to the sheet eject tray 9, be ejected onto the sheet eject tray 9 by eject rollers 35, 36, 37, and 38, and be stacked on the sheet eject tray 9. The user can retrieve or take out the sheet S stacked on the sheet eject tray 9 through an opening, which is located between the sheet eject tray 9 and the image scanning device 4 facing the front of the copier 1.

When a double-sided copy mode is selected by a user input, the sheet S with an image fixed on one side thereof may be guided by the switching claw 34 to be conveyed toward the sheet reversing device 42. The multiple pairs of rollers 66 and guiding members, not shown, disposed inside the sheet reversing device 42 may convey the sheet S back and forth along the reverse conveying path R3 to reverse the faces or sides of the sheet S. Then, the sheet S may be conveyed from a position in front of the photoconductor unit 10 back to the sheet conveying path R1 through the pair of registration rollers 21. The sheet S may be conveyed upward along the sheet conveying path R1 and be guided to the transferring position once again, at which an image is transferred and fixed this time onto the backside or the other side of the sheet S. Finally, the sheet S may be ejected onto the sheet eject tray 9 by the eject rollers 35, 36, 37, and 38.

The pair of registration rollers 21 serves as a registration unit to correct and align the sheet S conveyed via the second conveying units 7 and 7', the manual sheet feeding tray 67, and the sheet reversing device 42. Then, the sheet S may be moved and guided to the image forming section of the copier 1.

Now, detailed configuration and functions of the sheet conveying device 5 are described according to an example of the present patent application, with reference to FIGS. 3 through 8.

Figure 3:
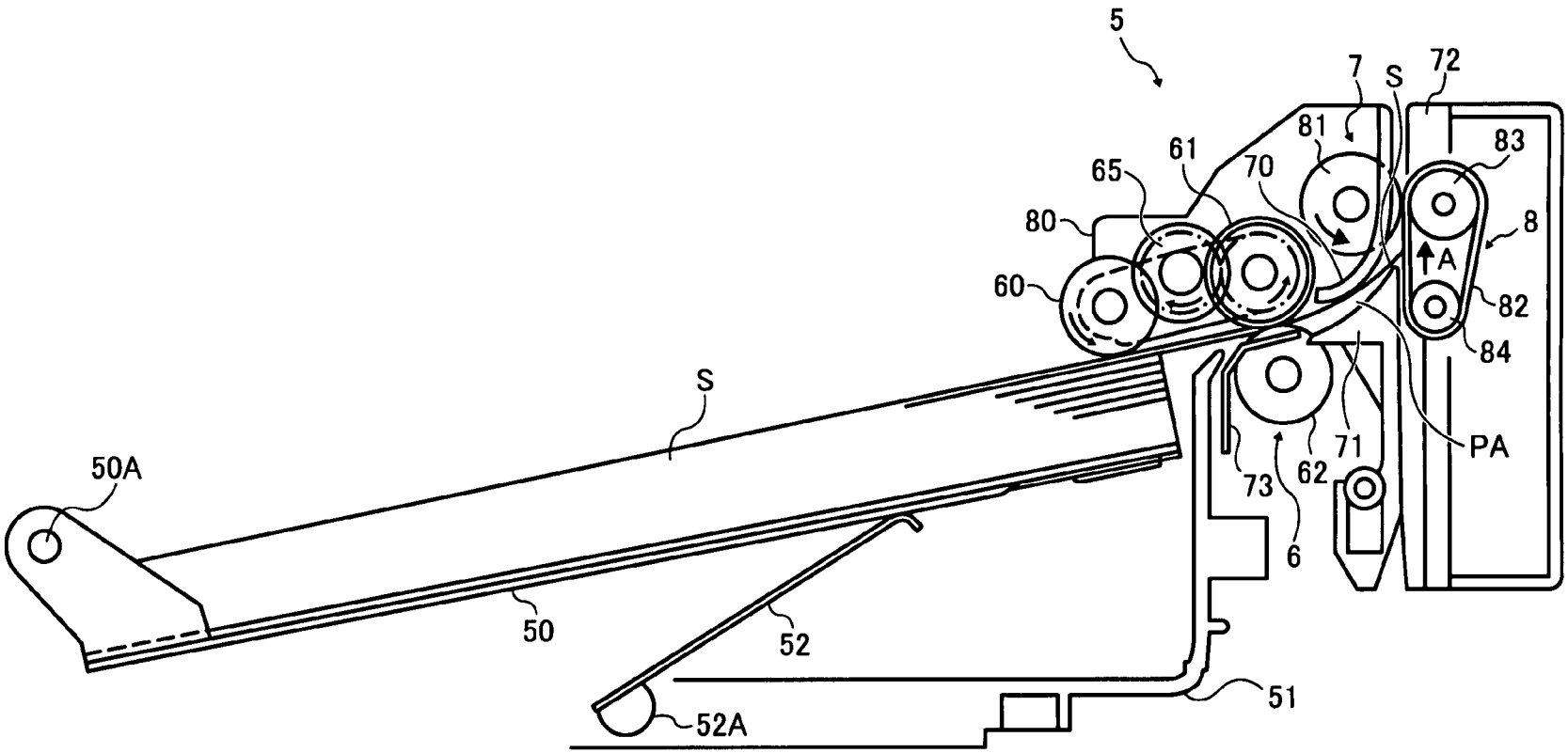
FIG. 3 is an enlarged cross-sectional view of a sheet conveying device, according to an example embodiment of the present patent application, of the image forming apparatus of FIG. 2.
Figure 4:
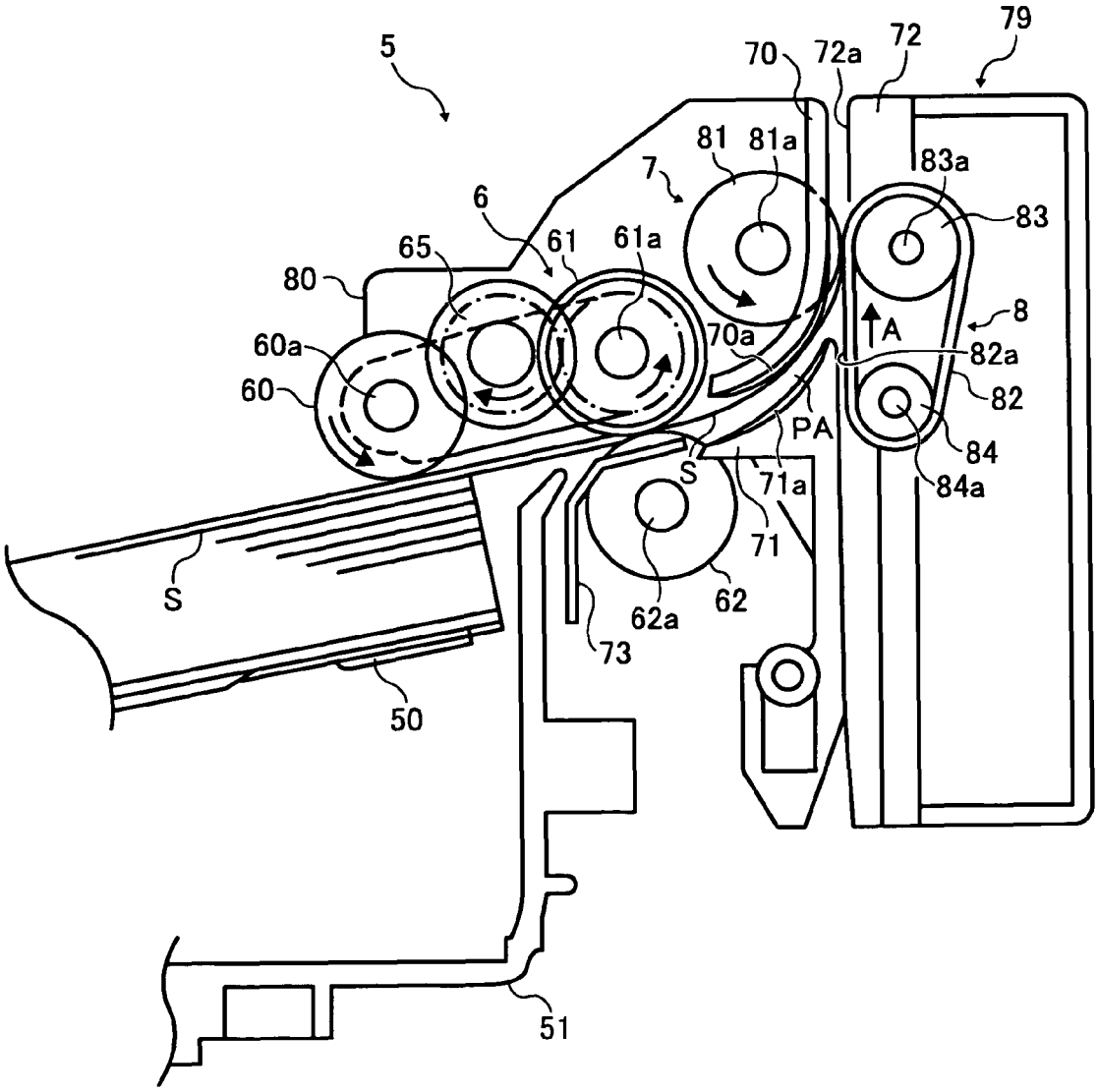
FIG. 4 is an enlarged cross-sectional view of the sheet conveying device of FIG. 3.

As shown in FIGS. 3 and 4, the sheet conveying device 5 according to this example of the present patent application may extract one sheet S from the stack of sheets S accommodated or stored in the sheet feeding cassette 51 of a given stage (in this example, the lower stage) in the sheet feeding device 3 shown in FIG. 2, change the sheet conveying direction of the fed sheet S, and convey the sheet S in a direction perpendicular to a substantially horizontal direction or a substantially vertically upward direction to the pair of registration rollers 21 disposed in the main body 2 of the copier 1.

The sheet conveying device 5 primarily includes a first conveying unit 6, a second conveying unit 7, and a first sheet conveying path PA.

The first-conveying unit 6 employs the FRR sheet separation mechanism for conveying the sheet S one by one.

The second conveying unit 7 is disposed on a downstream side of the first conveying unit 6 in the sheet conveying direction. The second conveying unit 7 forms a sheet holding section or nip contact to convey the sheet S received from the first conveying unit 6 in a sheet conveying direction different from the sheet conveying direction of the first conveying unit 6.

The first sheet conveying path PA may include a curved section and be provided between the first conveying unit 6 and the second conveying unit 7.

In the sheet conveying device 5, both the first conveying unit 6 and the second conveying unit 7 serve as a hold and transfer unit to hold and transfer the sheet S with a pair of rotary conveyance members.

Specifically, the first conveying unit 6 includes two rotary conveyance members disposed facing each other, namely a feed roller 61 and a reverse roller 62, and serve as a first pair of rotary conveyance members.

The second conveying unit 7 includes two rotary conveyance members disposed facing each other, namely a grip roller 81 and a conveyor belt 82 stretched around a roller-type pulley 83 and a roller-type pulley 84, and serve as a second pair of rotary conveyance members.

At least one of the first conveying unit 6 and the second conveying unit 7 includes a belt-type conveying unit 8 serving as a belt-type sheet conveying unit provided with the conveyor belt 82 to move and guide (convey) the sheet S toward the sheet holding section or nip contact of the second conveying unit 7 while keeping the leading edge of the sheet S in contact with the conveyor belt 82. A conveying surface 82*a* (see FIG. 4), which is a belt traveling surface on the conveyor belt 82 of the belt-type conveying unit 8, is disposed along an outer side of the first sheet conveying path PA.

As described above, the sheet conveying direction of the first pair of rotary conveyance members including the feed roller 61 and the reverse roller 62 is different from the sheet conveying direction of the second pair of rotary conveyance members including the grip roller 81 and the conveyor belt 82. Specifically, the sheet conveying direction of the first pair of rotary conveyance members is substantially horizontal and directed to a diagonally upward right position, whereas the sheet conveying direction of the second pair of rotary conveyance members is directed in a substantially vertically upward direction, as viewed in FIGS. 3 and 4. Accordingly, the first sheet conveying path PA provided between the first conveying unit 6 and the second conveying unit 7 includes a curved section with a small radius, which can cause the sheet conveying direction to change abruptly in the first sheet conveying path PA.

Figure 5:
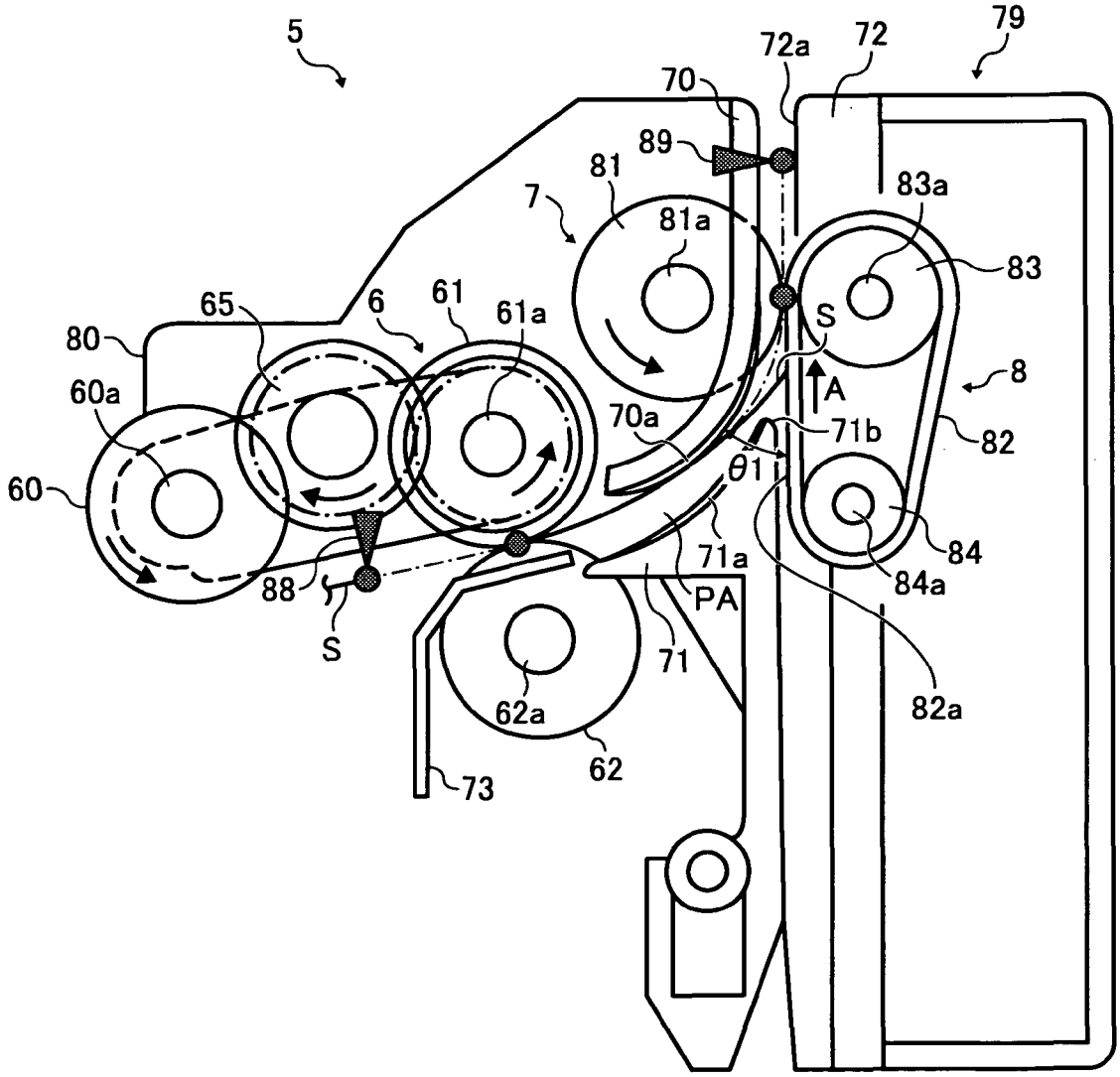
FIG. 5 is an enlarged cross-sectional view of relevant parts, with one conveying path, of the sheet conveying device of FIG. 3.

A more specific description is given of the sheet conveying directions of the first and second conveying units 6 and 7 with reference to FIG. 5.

As shown in FIG. 5, the sheet conveying direction orthogonally intersecting the center of the nip contact of the first conveying unit 6 is substantially horizontal with respect to a line connecting three points, which are the rotational center of the feed roller 61, the rotational center of reverse roller 62, and the sheet holding section (also referred to as "nip contact") of the feed roller 61 and the reverse roller 62.

Similarly, the sheet conveying direction orthogonally intersecting the center of the nip contact of the second conveying unit 7 is substantially vertical with respect to a line connecting three points, which are the rotational center of the grip roller 81, the rotational center of the roller-type pulley 83, and the sheet holding section or the nip contact of the grip roller 81 and the conveyor belt 82.

That is, the sheet travel direction may change in the first sheet conveying path PA provided between the first conveying unit 6 and the second conveying unit 7. The first sheet conveying path PA includes two opposite surfaces that define the orientation of the conveyed sheet S in the thickness direction of the sheet S. When the sheet S is sent out from the first conveying unit 6, the leading edge of the sheet S may abut against a conveying guide surface, which is one of the above-described two surfaces. The conveying guide surface may move continuously and constantly within a given range, starting at least from the position at which the sheet S abuts against the conveying guide surface, along the lengthwise direction of the sheet conveying direction, toward the sheet holding section of the second conveying unit 7. This conveying and guiding surface corresponds to the belt traveling surface or the conveying surface 82*a* of the conveyor belt 82 of the belt-type conveying unit 8. In the example embodiment of the present patent application, the area surrounded by an extended line along the sheet travel direction of the first conveying unit 6 and an extended line along the sheet travel direction of the second conveying unit 7 may be referred to as an "inner area." The rest of the areas may be referred to as an "outer-area." In addition, "inner side" and "outer side" refer to a side closer toward the inner area and a side closer toward the outer area, respectively. The conveying surface 82*a* of the conveyor belt 82, which is the planar belt traveling surface used for conveying a sheet, may be disposed along the outer edge of the inner area, and substantially intersect the sheet travel direction.

As shown in FIGS. 4 and 5, the belt-type conveying unit 8 primarily includes the conveyor belt 82, and the roller-type pulley 83, and the roller-type pulley 84. The pulleys 83 and 84 may be a pair of rotary belt holding members for rotatably holding the conveyor belt 82.

The roller-type pulley 83 serves as a first rotary belt holding member. The roller-type pulley 83 may be disposed opposite to the sheet holding section or nip contact formed between the grip roller 81 and the conveyor belt 82, so as to movably retain and span the conveyor belt 82.

The roller-type pulley 84 serves as a second rotary belt holding member. The roller-type pulley 84 may be disposed opposite to the roller-type pulley 83 and at an upstream side of the sheet conveying direction of the second conveying unit 7. In this example of the present patent application, the second rotary belt holding member is disposed in a single unit. However, the second rotary belt holding member is not limited in a single unit. That is, a plurality of second rotary belt holding members can be applied to the present patent application.

It may be useful that the belt-type conveying unit 8 is disposed in such a manner that the leading edge of the sheet S conveyed from the first conveying unit 6 abuts against or contacts the conveying surface 82*a* of the conveyor belt 82, at portions of the conveying surface 82*a* other than portions at which the conveyor belt 82 is held by the roller-type pulley 83 and the roller-type pulley 84. As shown in FIG. 4, the belt-type conveying unit 8 is disposed in such a manner that the axial center of the roller-type pulley 84 or a center of a pulley shaft 84*a* is disposed above the bottom edge of the reverse roller 62 and beneath the height of a downstream end 71*b* of a guide surface 71*a* of a conveying guide member 71. Accordingly, the leading edge of the sheet S may collide with the abdominal portion (i.e., an "effective conveying portion") of the conveyor belt 82, where the conveyor belt 82 constantly and appropriately becomes elastically displaced and/or deformed (when colliding with the sheet S), so that the leading edge of the sheet S does not bounce back. Hence, it is ensured that the leading edge of the sheet S is kept in abutment with the conveying surface 82*a* (also referred to as "belt conveying surface 82*a*") of the conveyor belt 82, so that the effects described below can be achieved.

By contrast, in a case in which the belt-type conveying unit 8 is disposed in such a manner that the leading edge of the sheet S abuts or contacts the conveyor belt 82 at the portions at which the conveyor belt 82 is held by or in contact with the roller-type pulley 83 and the roller-type pulley 84, the following inconvenience may occur. That is, the hardness of the portions at which the conveyor belt 82 is held by the roller-type pulley 83 and the roller-type pulley 84 may generally be greater than the abdominal portion of the conveyor belt 82, and thus the positions may not become elastically displaced and/or deformed as much as the abdominal portion. Hence, this arrangement is disadvantageous as the sheet S bounces back from the conveyor belt 82 because the conveyor belt 82 may not be constantly and appropriately become elastically displaced and/or deformed when the leading edge of the sheet S abuts against the portions at which the conveyor belt 82 is held by the roller-type pulleys 83 and 84. The same disadvantage may be applied to other examples and modified example according to the present patent application described below (hereinafter, also described as "the same disadvantage may be applied to other examples").

Furthermore, as shown in FIG. 5, it may be useful that the belt-type conveying unit 8 is disposed in such a manner that the leading edge of the sheet S conveyed from the first conveying unit 6 approaches the conveying surface 82*a* at an acute collision angle θ1. By arranging the belt-type conveying unit 8 in such a manner, the leading edge of the sheet S may constantly abut the abdominal portion of the conveyer belt 82. Accordingly, it is ensured that the leading edge of the sheet S is kept in contact with the conveying surface 82*a*, so that the effects described below can be achieved.

In a case in which the belt-type conveying unit 8 is disposed in such a manner that the leading edge of the sheet S approaches the conveying surface 82*a* at a substantially perpendicular or orthogonal collision angle, the leading edge of the sheet S may abut against the conveying surface 82*a* in an irregular manner. For example, the sheet S may bend in the opposite direction to which the conveyor belt 82 is moving or the sheet S may bounce back from the conveyer belt 82. Hence, this arrangement is disadvantageous and the same disadvantage may be applied to other examples.

Each of the sheet feeding cassettes 51 in the stages of the sheet feeding device 3 may have a planar shape large enough to store the maximum size of the sheet S used in the copier 1. Each of the sheet feeding cassettes 51 is a substantially flat box with an upper opening and a bottom plate 50 provided at the bottom thereof serves as a sheet stacking unit. The rear end of the bottom plate 50, which is located on the left side as viewed in FIG. 3, is fixed to a horizontal shaft 50A supported by the sheet feeding cassette 51 so that the bottom plate 50 can freely rotate within a given angle range, i.e., so as to pivot back and forth or to oscillate. The free end of the bottom plate 50, which is located on the right side as viewed in FIG. 3, can pivot back and forth about the horizontal shaft 50A inside the sheet feeding cassette 51.

At the bottom of the sheet feeding cassette 51, there is a hollow section of a given shape. A rising arm 52 is provided in the hollow section. The rear end of the rising arm 52 is fixed to a horizontal shaft 52A so that the rising arm 52 can freely rotate within a given angle range, i.e., so as to pivot back and forth, in the hollow section. The horizontal shaft 52A may receive a driving force from a rotational driving source, not shown, causing the horizontal shaft 52A to rotate in arbitrary directions. As the horizontal shaft 52A rotates, the rising arm 52 may be caused to pivot about the horizontal shaft 52A to come to a given tilted position. Accordingly, the free end of the rising arm 52 may push up the bottom plate 50 so that one edge of the topmost face of the sheet S stacked on the bottom plate 50 can be maintained at a given height.

As described above, the sheet feeding cassette 51 stacks or stores the sheets S on the bottom plate 50 and stored therein. Furthermore, the free end of the bottom plate 50 on the right side as shown in FIG. 3 may rise so that the bottom plate 50 may tilt and the sheet S stacked thereon can be pushed up. Therefore, even if the sheets S are fed out one by one and the number of stacked sheet decreases, the topmost surface of the sheets S can constantly be maintained at a given height.

As described above, the sheet feeding cassette 51 can be freely attached to or detached from the main unit of the sheet feeding device 3, namely, the sheet feeding cassette 51 can be inserted in or removed from the main unit of the sheet feeding device 3. For example, the sheet feeding cassette 51 can be set at an inserted position in the main unit of the sheet feeding device 3 as shown in FIG. 2 so that the sheet feeding can be performed. The sheet feeding cassette 51 can be pulled out and detached from the main unit of the sheet feeding device 3 toward the front as shown in FIG. 2 to a detached position, so that sheets S can be supplied or sheets S can be replaced with sheets S of a different size.

At least the first conveying unit 6, the second conveying unit 7, and the first sheet conveying path PA formed between the first conveying unit 6 and the second conveying unit 7 may remain in the main body 2 of the copier 1 even when the sheet feeding cassette 51 is pulled out. The copier 1 serving as an image forming apparatus of an example is an in-body paper eject type (i.e., the sheet eject tray 9 is located within the main body 2 of the copier 1). However, when the belt-type conveying unit 8 serving as the belt-type sheet conveying unit is provided, the curved section of the sheet conveying path of this example can be kept equal to or less than that employing a general technique. Hence, the width of the image forming apparatus or the copier 1 does not need to be increased, so that the advantage of the in-body paper eject type may not be diminished.

A pickup roller 60, which is shown in FIGS. 3 through 7, is axially rotatably supported by a housing 80, shown in FIGS. 3 through 5, which includes the outer shape of a structure provided on the main unit of the sheet feeding device 3, in such a manner that the pickup roller 60 contacts the topmost face of the sheets S raised to the given height. On an extended line along the direction to which the pickup roller 60 extracts the sheet S, a sheet separation mechanism may be provided for separating one sheet S from the stack of sheets S and for feeding out the separated sheet S. In the sheet separation mechanism, the feed roller 61 and the reverse roller 62 may contact each other by a given pressure level to form a nip contact therebetween.

As illustrated in FIG. 4, the pickup roller 60 may be a known roller that is integrally fixed around a shaft 60*a* that is integrally formed with a cored bar, not shown, and is supported together with the shaft 60*a* so as to freely rotate. Alternatively, a one-way clutch, not shown, can be provided between the shaft 60*a* and the cored bar, and the pickup roller 60 can be supported so as to freely rotate with respect to the shaft 60*a* when the pickup roller 60 is not driven. The circumferential section of the pickup roller 60 including its circumferential surface is made of a soft and highly frictional material such as rubber, which has a high frictional coefficient with respect to the sheet S, so as to easily pick up the sheet S by contacting the sheet S. Furthermore, in order to increase the frictional resistance, substantially sawtooth-shaped projections can be formed over the entire circumferential surface of the pickup roller 60.

There are various sheet separation mechanisms for separating a sheet S from a stack of sheets S to prevent multi-feeding of sheets, i.e., to prevent plural sheets from being sent out at once. In this example, the FRR sheet separation mechanism, which is a return separating method, is employed. Specifically, when two or more sheets S are picked up by the pickup roller 60, one sheet in contact with the feed roller 61 may be separated from the other sheet in contact with the reverse roller 62. The feed roller 61 may continue to send the sheet S in contact therewith in the sheet conveying direction while the reverse roller 62 returns the other sheet in the opposite direction to the sheet conveying direction, back to the original position on the stack of sheets. Furthermore, the reverse roller 62 may be disposed not to obstruct the sheet conveying operation performed by the feed roller 61.

Figure 6:
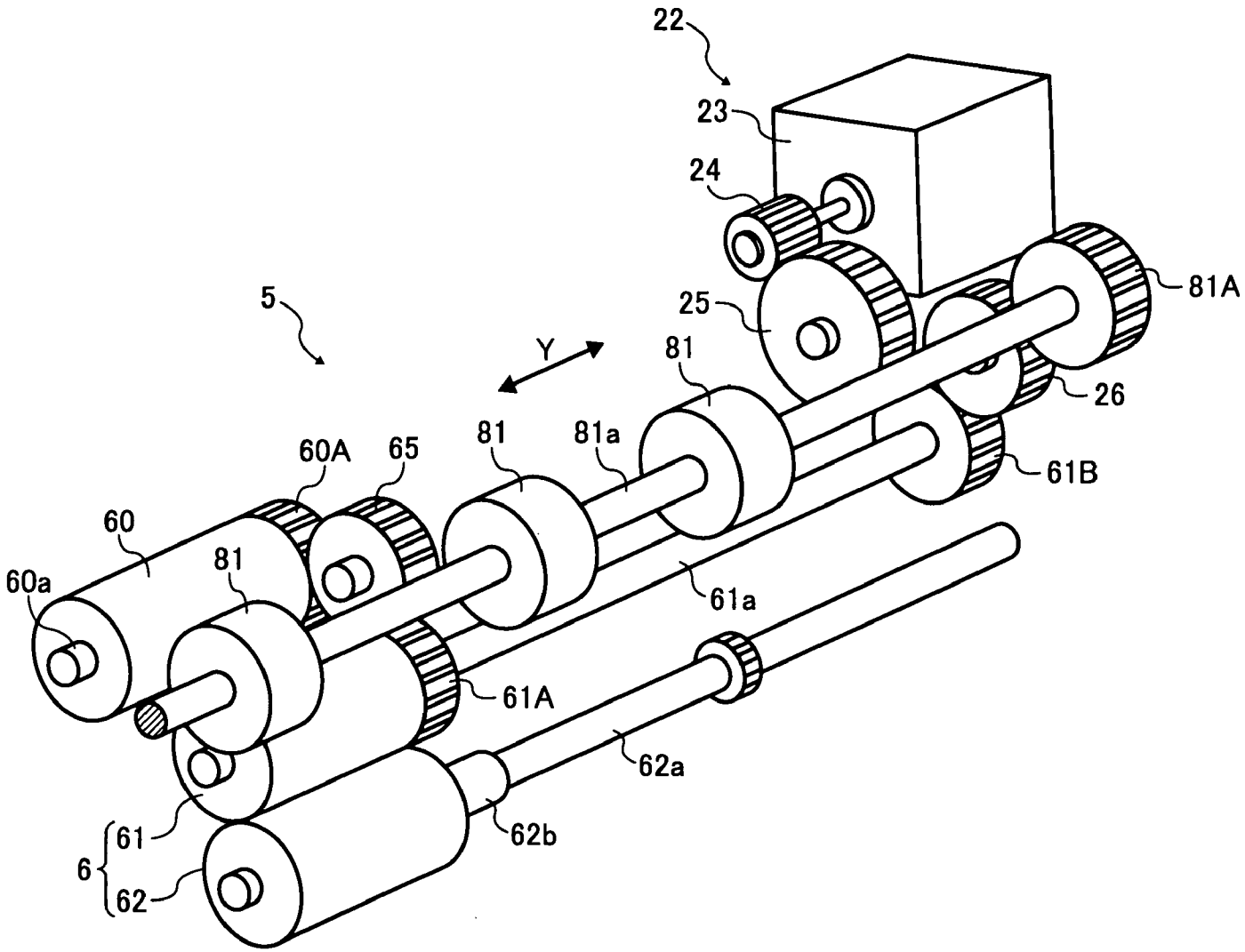
FIG. 6 is a schematic perspective view of a driving mechanism of the sheet conveying device of FIG. 3.

For example, the FRR sheet separation mechanism as a sheet separating mechanism includes the feed roller 61 that is rotated in the forward direction of the sheet conveying direction and the reverse roller 62 that is rotated in the reverse direction by receiving a rotational driving force in the reverse direction via a torque limiter, which may correspond to a torque limiter 62*b* shown in FIG. 6. The feed roller 61 may contact the top face of the topmost sheet S fed out from the bottom plate 50, while the reverse roller 62 contacts the bottom face of at least one sheet S under the feed roller 61.

The feed roller 61 can be a roller that is integrally fixed around a shaft 61*a* that is integrally formed with a cored bar, not shown, and is supported together with the shaft 61*a* so as to freely rotate. Alternatively, the feed roller 61 can be supported in a similar manner to the pickup roller 60.

Similarly to the pickup roller 60, the circumferential section of the feed roller 61, including its circumferential surface, is made of a soft and highly frictional material such as rubber, which has a high frictional coefficient with respect to the sheet S, so as to easily convey the sheet S in the sheet travel direction by contacting the sheet S. Furthermore, in order to increase the frictional resistance, substantially sawtooth-shaped projections can be formed over the entire circumferential surface of the feed roller 61.

The reverse roller 62 is integrally formed with a cored bar, not shown, and is supported together with a reverse roller driving shaft 62*a* by the housing 80 so as to freely rotate by receiving a rotational driving force via the torque limiter 62*b* (see FIG. 6).

In the FRR sheet separation mechanism, the reverse roller 62 may receive a low level of torque in a direction opposite to that of the rotational direction of the feed roller 61 via the torque limiter 62*b*. Therefore, when the reverse roller 62 is held in contact with the feed roller 61, or when one sheet S enters in between the feed roller 61 and the reverse roller 62, the reverse roller 62 may rotate following the rotation of the feed roller 61. That is, the function of the torque limiter 62*b* may cause the reverse roller 62 to slip on the reverse roller driving shaft 62*a*, so that the reverse roller 62 can rotate in a forward direction of the sheet feeding direction, similarly to the feed roller 61. Conversely, when the reverse roller 62 is separated from the feed roller 61 or when two or more sheets S enter in between the feed roller 61 and the reverse roller 62, the reverse roller 62 may rotate in the opposite direction. Therefore, when more than one sheet S enters in between the feed roller 61 and the reverse roller 62, the reverse roller 62 may return the sheet S other than the topmost sheet S in contact with the feed roller 61, i.e., the sheets S in contact with the reverse roller 62, toward the upstream side of the sheet conveying direction. Accordingly, it is possible to prevent multi-feeding of sheets S or feeding more than one sheet S at once.

Therefore, the conveying force applied from the reverse roller 62 to the sheet S in contact therewith is large enough in the reverse direction for returning the sheet S to its original position on the stack of sheets S. However, this conveying force is sufficiently smaller than the conveying force applied from the feed roller 61 to the sheet S for conveying the sheet S in the forward direction, so as not to obstruct the feed roller 61 from conveying the sheet S in the forward direction. Due to the above-described configuration, the conveying force applied from the feed roller 61 to the sheet S can be reduced by the opposite conveying force applied from the reverse roller 62 to the sheet S.

As shown in FIGS. 3 through 7, the sheet conveying device 5 further includes an idler gear 65 that is joined to a driving shaft that outputs a rotational driving force from a driving source provided in the main unit of the sheet feeding device 3. The idler gear 65 may distribute and transmit a rotational driving force supplied from the sheet feeding device 3 through the engagement of gears or through a belt to the pickup roller 60 and the feed roller 61 to rotate then at given speeds.

At a diagonally upper position of the feed roller 61, the grip roller 81 is provided as the other rotary conveyance member of the second pair of rotary conveyance members including the second conveying unit 7. The grip roller 81 is rotatably supported by the housing 80 via a rotational driving shaft 81*a* integrally provided with the grip roller 81. Similarly to the feed roller 61, the circumferential section of the grip roller 81 including its circumferential surface is made of a soft and highly frictional material such as rubber, which has a high frictional coefficient with respect to the sheet S, so as to easily convey the sheet S in the sheet conveying direction by contacting the sheet S.

The pulley 83 is provided in the vicinity of the grip roller 81. The pulley 83 is axially rotatably supported by the housing 80 so as to contact the circumferential surface of the grip roller 81 via the conveyor belt 82, facing the grip roller 81 in a horizontal direction.

The pulley 83 is integrally formed with a pulley shaft 83*a*, and is rotatably supported together with the pulley shaft 83*a* by the housing 80. The pulley 84 is disposed at a diagonally downward left position of the pulley 83, and is axially rotatably supported by the housing 80. The pulley 84 is integrally formed with the pulley shaft 84*a*, and is rotatably supported and held together with the pulley shaft 84*a* by the housing 80. The pulleys 83 and 84 serve as the first and second rotary belt holding members for rotatably holding the conveyor belt 82.

The arrangement of the belt-type conveying unit 8 is not limited to the above-described descriptions. The belt-type conveying unit 8 can be arranged as follows. For example, as shown in FIGS. 4 and 5, the sheet conveying device 5 further includes an opening and closing guide 79 that opens and closes with respect to the housing 80, as a part of the sheet conveying device 5, as shown in FIGS. 8A and 8B.

Figure 8A:
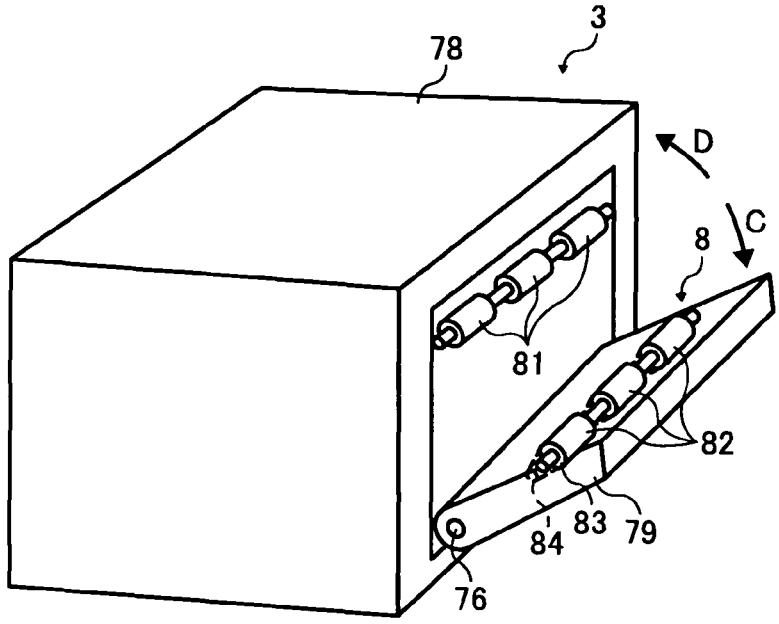
FIG. 8A is a perspective view of a sheet feeding device including the sheet conveying device of FIG. 3.
Figure 8B:
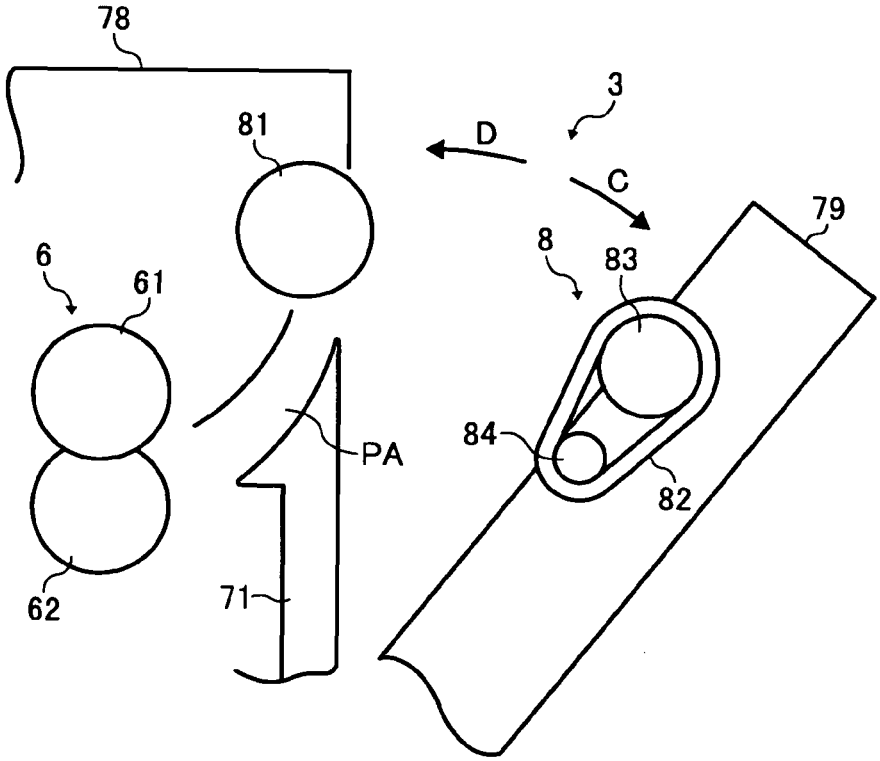
FIG. 8B is a partial cross-sectional view of the sheet feeding device of FIG. 8A.

As shown in FIGS. 8A and 8B, the sheet feeding device 3 includes a main body 78 having the opening and closing guide 79 serving as an opening and closing unit. The opening and closing guide 79 may separate a vertical conveying path directing vertically upward, which serves as a common conveying path corresponding to the second sheet conveying path PB shown in FIGS. 10 and 13 according to the following examples to be described later. The opening and closing guide 79 may then cause the opening and closing guide 79 to open and close with respect to the main body 78 in respective directions indicated by arrows C and D in FIGS. 8A and 8B by pivoting around a fulcrum shaft 76 disposed below the main body 78. Therefore, the opening and closing guide 79 of the sheet feeding device 3 having the configuration shown in FIGS. 8A and 8B may make it easier for a user to resolve a paper jam in the first sheet conveying path PA or the vertical conveying path extending substantially upward and can effectively remove a jammed paper or papers therefrom.

The opening and closing guide 79 may provide a function as an opening and closing unit integrally mounted by the belt-type conveying unit 8, a conveying guide member 72, and so forth.

The pulleys 83 and 84 and their respective pulley shafts 83*a* and 84*a* are rotatably supported by the opening and closing guide 79 when the sheet conveying device 5 of the copier 1 is provided with the opening and closing guide 79.

The opening and closing guide 79 shown in FIGS. 6, 8A, and 8B is provided with the belt-type conveying units 8 including the grip rollers 81 and the conveyor belts 82. The grip rollers 81 are arranged as three separate grip rollers 81 in a continuous or discontinuous manner along a sheet width direction Y, and the conveyor belts 82 are also arranged as three separate conveyor belts 82 in a continuous or discontinuous manner along the sheet width direction so as to contact the entire width or at least both width ends of the sheet S.

An alternative configuration will be described later, in which the main body 78 and the opening and closing guide 79 may include a single grip roller 81 and a single conveyor belt 82 may be arranged along the maximum sheet width direction so as to contact the entire width or at least both width ends of the sheet S.

Each of the conveyor belts 82 is formed as an endless belt stretched around the pulleys 83 and 84, as described above. The axes of the pulleys 83 and 84 are spaced apart by a given distance. The linear belt traveling surface or the conveying surface 82*a* of the conveyor belt 82 between the pulleys 83 and 84 is disposed at a position to ensure that the linear belt traveling surface thereof is caused to contact the leading edge of the sheet S sent out from the first conveying unit 6. As described above, the circumferential surface, which is the conveying surface 82*a*, of the conveyor belt 82 stretched around the circumferential surface of the pulley 83 may directly contact the circumferential surface of the grip roller 81 at a given pressure level. The portion at which the conveyor belt 82 contacts the grip roller 81 corresponds to the sheet holding section or nip contact. For example, a pressing member, not shown, may be attached to a bearing member or supporting member, not shown, for supporting the pulley shaft 83*a*. This forcing unit may press the conveyor belt 82 against the grip roller 81.

The conveyor belt 82 is made of an elastic material such as rubber. The frictional coefficient of the surface of the conveyor belt 82 may be specified at a given value with respect to the conveyed sheets S. The frictional coefficient is defined by characteristics of the material of the conveyor belt 82 itself or by treating the surface with an appropriate process. For example, the frictional coefficient may be specified to ensure that an outer circumferential surface or the conveying surface 82*a* of the conveyor belt 82 may transmit a conveying and propelling force to the face of the sheet S in contact with the conveyor belt 82, without allowing the sheet face to slip along the conveying surface 82*a* of the conveyor belt 82.

The belt width of the conveyor belt 82 in a sheet width direction perpendicular or orthogonal to the sheet conveying direction may be at least substantially equal to the width of a maximum size sheet to be conveyed. That is, the belt width of the conveyor belt 82 may substantially be equal to or wider than the width of a maximum size sheet to be conveyed. The sizes in the sheet width direction or axial lengthwise direction of the pulleys 83 and 84 around which the conveyor belt 82 is stretched and the grip roller 81 facing and contacting the conveyor belt 82 are equal to or larger than the above-described belt width of the conveyor belt 82. Hence, it is ensured that the entire width of the sheet S sent out from the first conveying unit 6 contacts the conveyor belt 82, so that the contact area therebetween can be increased. Accordingly, it is possible to increase the conveying and propelling force for conveying the sheet S in conveying direction. The conveying and propelling force may constantly be transmitted to the sheet S from the conveyor belt 82 moving in the sheet travel direction.

A rotational driving source, not shown, such as an electric motor provided specifically for rotating the grip roller 81 is connected to the rotational driving shaft 81*a* of the grip roller 81 via a driving force transmitting unit, not shown, such as a gear or a belt. The grip roller 81 may be rotated by receiving a rotational driving force of a given rotational speed from the rotational driving source via the driving force transmitting unit. Accordingly, the grip roller 81 serves as a rotary feed driving roller, while the conveyor belt 82 in contact with the grip roller 81 may act as a subordinate belt that is caused to move following the rotation of the grip roller 81 serving as the rotary feed driving roller, and the pulley 83 supporting the contact portion between the conveyor belt 82 and the grip roller 81 from inside the belt may act as a subordinate roller that is caused to rotate via the subordinate belt or the conveyor belt 82. As a matter of course, the pulley 84 may also act as a subordinate roller that is caused to rotate via the subordinate belt or the conveyor belt 82.

In FIG. 6, as a matter of convenience in describing a driving mechanism 22 of the sheet conveying device 5, the grip rollers 81 are purposely arranged with irregular intervals in the direction of the rotational driving shaft 81*a*. However, in reality, the grip rollers 81 are equally spaced apart at positions facing the conveyor belt 82 and the pulleys 83, as a matter of course.

Figure 7:
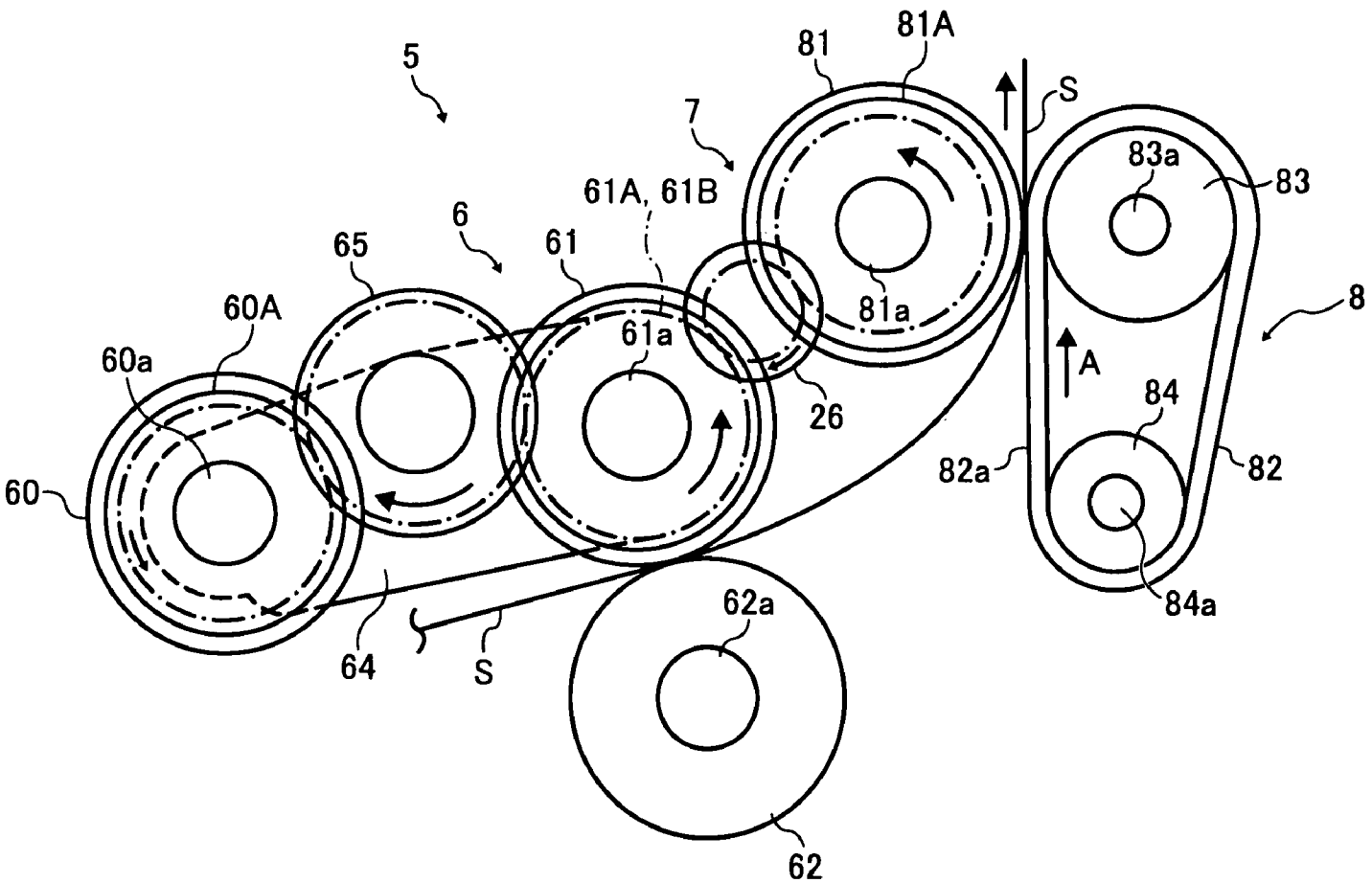
FIG. 7 is a schematic front view of relevant parts of the driving mechanism of FIG. 6.

As shown in FIGS. 6 and 7, the sheet conveying device 5 further includes the driving mechanism 22 that drives the grip roller 81. The driving mechanism 22 primarily includes a sheet feeding motor 23, a motor gear 24, an idler gear 25, a feed roller driving gear 61B, an idler gear 26, a grip roller driving gear 81A, a feed roller gear 61A, the idler gear 65, and a pickup roller gear 60A.

The sheet feeding motor 23 is a stepping motor serving as the single driving source or driving unit.

The motor gear 24 is fixed on an output shaft of the sheet feeding motor 23.

The idler gear 25 is engaged with the motor gear 24.

The feed roller driving gear 61B is engaged with the idler gear 25 and fixed to one end of the shaft 61*a* of the feed roller 61.

The idler gear 26 is engaged with the feed roller driving gear 61B.

The grip roller driving gear 81A is engaged with the idler gear 26 and fixed to one end of the rotational driving shaft 81*a* of the grip rollers 81.

The feed roller gear 61A is fixed to the other end of the shaft 61*a* near the feed roller 61.

The idler gear 65 is engaged with the feed roller gear 61A.

The pickup roller gear 60A in engagement with the idler gear 65 and fixed to the other end of the shaft 60*a* near the pickup roller 60.

The sheet feeding motor 23 is fixed to the housing 80. The idler gears 25, 26, and 65 are rotatably supported by the housing 80.

As described above, the sheet conveying device 5 according this example may be compact and space-saving by making the first sheet conveying path PA have a curved section of a relatively small curvature radius as later described example embodiments. The sheet feeding motor 23 is the single driving source provided for driving both the first conveying unit 6 and the second conveying unit 7, which also contributes in reducing the size of the device.

The reverse roller 62 may be driven by a different system including, for example, a solenoid for releasing pressure from the feed roller 61.

As shown in FIG. 6, the sheet conveying device 5 further includes the torque limiter 62*b*.

In this example shown in FIGS. 2 through 5, the rotating and driving relationship between the pickup roller 60 and the feed roller 61 is described only briefly. In reality, as shown in an enlarged view of FIG. 7, the respective shafts 60*a* and 61*a* of the pickup roller 60 and the feed roller 61, respectively, may be connected by a pickup arm member 64. Accordingly, for the pickup action, a combination of a solenoid, not shown, and a spring, not shown, causes the pickup roller 60 to pivot or move about the shaft 61*a* of the feed roller 61 via the pickup arm member 64.

In the actual driving mechanism 22, there are many driving force transmitting members such as gears and timing belts disposed between the sheet feeding motor 23 and the feed roller 61. However, the example configuration of the driving mechanism 22 is shown only schematically in FIGS. 6 and 7 for the sake of clearly indicating that the grip rollers 81 serve as rotary conveyance driving members.

In the example of FIG. 6, as a matter of convenience in describing a driving mechanism 22 of the sheet conveying device 5, the grip rollers 81 are purposely arranged with irregular intervals in the direction of the rotational driving shaft 81*a*. However, in reality, the grip rollers 81 are equally spaced apart at positions facing the conveyor belt 82 and the pulleys 83, as a matter of course.

In addition, the conveyor belt 82 of the belt-type conveying unit 8 directly contacts the grip roller 81 serving a rotary feed driving member that is rotated by the driving mechanism 22, so that the conveyor belt 82 can rotate following the rotation of the grip roller 81. Variations in the linear velocity of the conveyor belt 82 can be further reduced by driving the grip roller 81, compared to the case in which the conveyor belt 82 is driven. Therefore, the following advantages can be achieved by arranging the conveyor belt 82 along the outer side of the turning or curved section of the first sheet conveying path PA. The conveyor belt 82 may rotate toward the sheet holding section of the second conveying unit 7. That is, it is possible to enhance sheet conveying properties for conveying relatively rigid sheets such as a cardboard recording paper at the turning section of the first sheet conveying path PA. Furthermore, by causing the conveyor belt 82 to rotate following the rotation of the grip roller 81 that faces and directly contacts the conveyor belt 82, the sheet S can be conveyed at a steady linear velocity beyond the second conveying unit 7.

For example, when driving the grip roller 81 to rotate, the linear velocity of the grip roller 81 may depend only on the outer diameter and speed of revolution of the grip roller 81. By contrast, when driving the conveyor belt 82 to rotate, it is general to use the pulley 83, which is a belt driving roller or main pulley, disposed in contact with an inner surface of the conveyor belt 82.

In this case, the linear velocity of the conveyor belt 82 may depend on the outer diameter and speed of revolution of the pulley 83, the variations in thickness of the conveyor belt 82 due to variation of component, the changes in thickness of the conveyor belt 82 due to abrasion, or the slipping or sliding of the pulley 83 on the conveyor belt 82. Accordingly, it is more effective to drive the grip roller 81 than the conveyor belt 82 to reduce the linear velocity of the conveyor belt 82.

Alternatively, a rotary conveyance driving unit of a driving mechanism can be removed to leave the grip roller 81 to serve as a subordinate roller and a different driving unit can be provided to drive the conveyor belt 82.

As shown in FIGS. 3 through 5, a conveying guide member 70 is positioned in the inner area of the sheet conveying device 5, including a curved guide surface 70*a* (FIGS. 4 and 5) swelling in a substantially downward direction with which the sheet S comes in contact. The conveying guide member 71 is positioned in the outer area of the sheet conveying device 5, including the guide surface 71*a* curved in a caved-in or concave shape in accordance with the conveying guiding member 70. Furthermore, the conveying guide member 71 is spaced apart with a given gap from the guide surface 70*a* of the conveying guiding member 70. The conveying guiding members 70 and 71 are both fixed to the housing 80. Accordingly, the first sheet conveying path PA is formed between the first conveying unit 6 and the second conveying unit 7, by arranging the guide surface 70*a* of the conveying guide member 70, the guide surface 71*a* of the conveying guide member 71 facing the conveying guiding member 70, and the conveying surface 82*a* of the conveyor belt 82 as described above.

As shown in FIGS. 3 through 5, the conveying guide member 72 is positioned along the outer side of the vertical conveying path extending substantially upward from the second conveying unit 7. The conveying guide member 72 includes a guide surface 72*a*. A conveying guide member 73 may provide a sheet conveying path from the sheet feeding cassette 51 to the sheet holding section or nip contact between the feed roller 61 and the reverse roller 62, and provide an inlet for guiding the sheet S into the nip contact. Accordingly, the vertical conveying path communicating with or connected to the sheet conveying path R1 is formed by the vertical conveying guide surface 72*a* of the conveying guide member 72 and the guide surface 70*a* of the conveying guiding member 70. The curved surface or guide surface 70*a* of the conveying guiding member 70 may swell in a substantially downward direction (toward the conveying guide member 71 provided on the outer side), beneath a line connecting the nip contacts of the first conveying unit 6 and the second conveying unit 7. The degree of swelling is defined so that the sheet S can moderately bend to ensure that the leading edge of the sheet S reaches the conveying surface 82*a* of the conveyor belt 82.

As shown in FIG. 2, the configuration of the upper stage of the sheet feeding device 3 is the same as that of a known technique. The difference from the lower stage described above is that a sheet conveying device 5' is employed instead of the sheet conveying device 5. The sheet conveying device 5' is different from the sheet conveying device 5 in that the sheet conveying device 5 employs the second conveying unit 7' instead of the second conveying unit 7. The second conveying unit 7' is different from the second conveying unit 7 in that the second pair of rotary conveyance members only includes the grip roller 81 and a subordinate roller that is caused to rotate following the rotation of the grip roller 81, which is practically the same size and shape as the pulley 83. The sheet feeding cassette 51 of the upper stage and the sheet conveying device 5' can be used for sheets S of a relatively low rigidity such as plain paper and not for sheets S of a relatively high rigidity such as cardboard recording papers or envelopes.

Next, a description is given of a sheet feeding operation of feeding a sheet S from a given stage in the sheet feeding device 3 and a conveying operation of conveying the sheet S of the sheet conveying device 5 that starts in conjunction with the sheet feeding operation.

As shown in FIG. 3, the sheets S stacked on the bottom plate 50 may be raised by the pivoting and rising movement of the rising arm 52 so that the topmost face can be located at a given height. First, the pickup roller 60 rotates to extract the topmost sheet S, and sends the topmost sheet S to the sheet separation mechanism including the feed roller 61 and the reverse roller 62. In the sheet separation mechanism, the feed roller 61 and the reverse roller 62 may cooperate with each other to separate only the topmost sheet from the others. The separated sheet S may be conveyed to the downstream side of the sheet conveying path. As shown in FIGS. 3 and 4, the leading edge of the sheet S may be guided and moved as the conveyor belt 82 travels in the direction indicated by the arrow while being kept in contact with the belt conveying surface 82*a*. When the leading edge of the sheet S reaches the nip contact between the grip roller 81 and the conveyor belt 82, the grip roller 81 and the conveyor belt 82 may hold the sheet S and convey the sheet S further vertically upward, and finally send out the sheet S in a vertical manner.

For example, the leading edge of the sheet S is held by the nip contact of the feed roller 61 and the reverse roller 62, sent out from the nip contact, and then reaches and contacts the belt conveying surface 82*a* of the conveyor belt 82 as shown in FIG. 3.

As shown in FIG. 4, as the conveying surface 82*a* of the conveyor belt 82 may move in the sheet travel direction by the movement of the conveyor belt 82 in the direction indicated by an arrow "A", the sheet S may gradually bend starting from the leading edge thereof. As the sheet S bends further, the contact area between the belt conveying surface 82*a* and the face of the sheet S may become larger. Hence, even if the sheet S is a highly rigid sheet, a sufficient amount of conveying and propelling force can be applied from the belt conveying surface 82*a* to the face of the sheet S in order to convey the sheet S in the sheet travel direction. When conveyance resistance is generated while the highly rigid sheet S is being conveyed and considerably bent, the conveying and propelling force applied to the sheet S by the first conveying unit 6 alone may be insufficient for conveying the sheet S. This insufficiency can be thoroughly compensated for by the conveying and propelling force applied to the sheet S from the belt-type conveying unit 8. Thus, it is possible to prevent conveyance failures of the sheet S at least between the first conveying unit 6 and the second conveying unit 7 so that the leading edge of the sheet S can reach the nip contact of the second conveying unit 7.

The conveying surface 82*a* of the conveyor belt 82 may continuously extend to the nip contact of the second conveying unit 7, thus ensuring that the leading edge of the sheet S in contact with the conveying surface 82*a* smoothly and constantly reaches the sheet holding section or nip contact. In other words, a highly rigid sheet S being conveyed by the first conveying unit 6 may be caused to bend moderately so that the leading edge of the sheet S may be more reliably contact the belt conveying surface 82*a*. The belt conveying surface 82*a* may apply an active conveying and guiding effect to the leading edge of the sheet S in contact thereto. Accordingly, the sheet S may receive a second conveying and propelling force from the belt conveying surface 82*a* for moving in the sheet conveying direction. Subsequently, the sheet S may be caused to bend even further so as to reach the sheet holding section of the second conveying unit 7.

After the leading edge of the sheet S has reached the second conveying unit 7, the sheet S is held and conveyed by both the first conveying unit 6 and the second conveying unit 7. Thus, a sufficient amount of conveying force may be applied to the sheet S from both the first conveying unit 6 and the second conveying unit 7. Therefore, it is possible to continue to convey the highly rigid sheet S in a smooth manner. After the trailing edge of the sheet S has been separated from the first conveying unit 6, the sheet S can no longer receive a conveying force from the first conveying unit 6. However, this loss may be compensated for by the conveying and propelling force from the belt conveying surface 82*a* applied once again to the sheet S, depending on how the sheet S is contacting the belt conveying surface 82*a* between the sheet holding section of the second conveying unit 7 and the trailing edge of the sheet S.

Furthermore, the sheet S may gradually become less bent. Therefore, it is possible to continue to convey the sheet S even after the trailing edge of the sheet S has been separated from the first conveying unit 6. Accordingly, in the sheet conveying device 5, it may be more reliable that the sheet S from the first conveying unit 6 is steadily sent to the second conveying unit 7 and then to the downstream sheet conveying path, regardless of the rigidity of the sheet S.

As described above, the belt-type conveying unit 8 is disposed along the outer side of the first sheet conveying path PA formed between the first conveying unit 6 and the second conveying unit 7. The belt-type conveying unit 8 may serve as the belt-type sheet conveying unit for moving and guiding the sheet S toward the second conveying unit 7 while keeping the leading edge of the sheet S in contact with the belt.

In this example, the belt-type conveying unit 8 serving as the belt-type sheet conveying unit may also have a function of changing, with the conveyor belt 82, the traveling direction of the sheet S into a direction toward the sheet holding section or nip contact of the second conveying unit 7.

Figure 9:
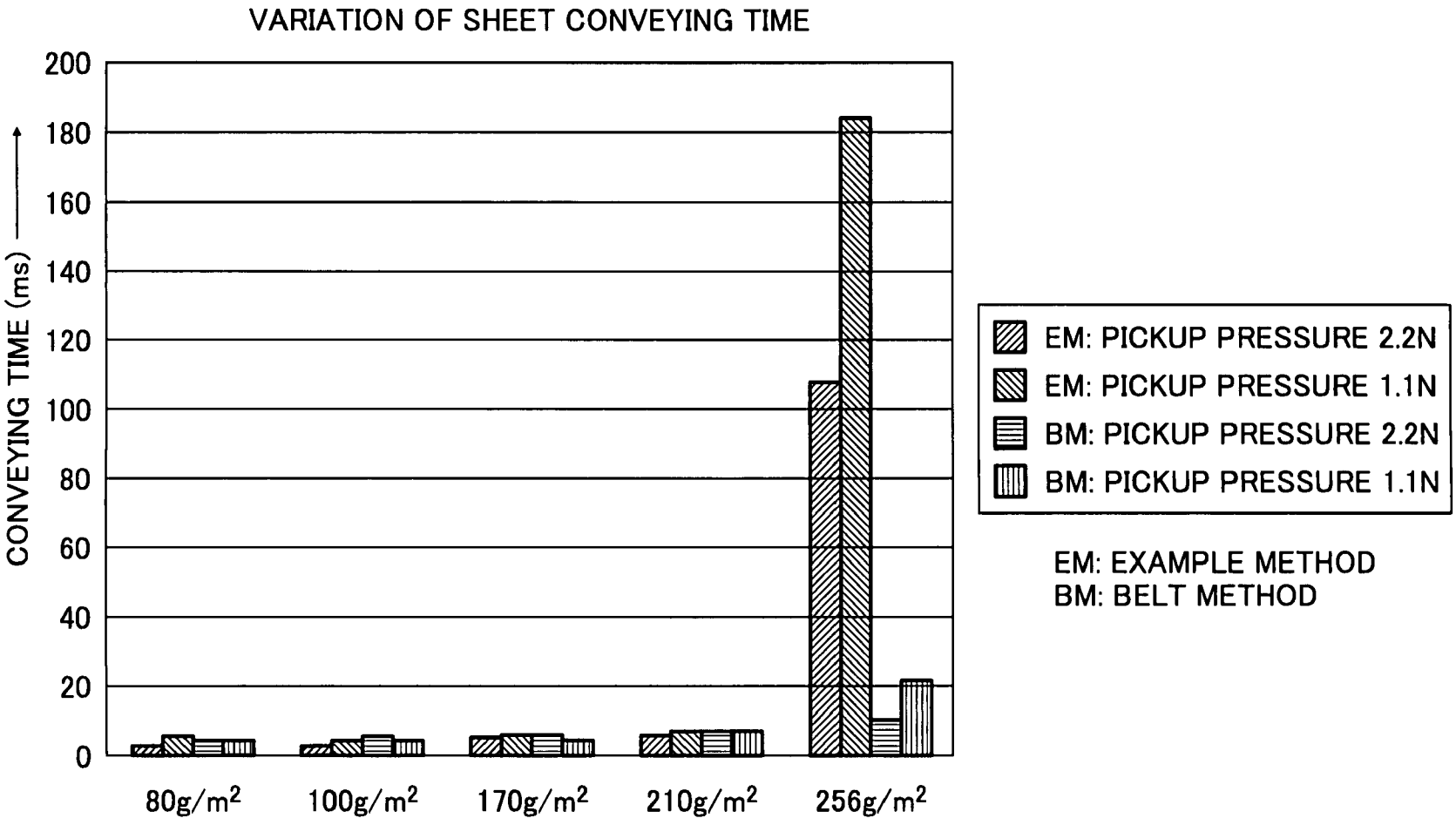
FIG. 9 is a graph showing test results indicating the variation in conveying time with the sheet conveying device of FIG. 3.

Next, with reference to FIG. 9, results of a comparative test on an example of the present patent application with reference to FIGS. 2 through 5 is described.

A comparative test was conducted to compare the sheet conveying or passing properties of a copier according to this example to which the present patent application is applied (indicated as "BELT METHOD" in Table 1) and a copier according to a known method (indicated as "EXAMPLE METHOD" in Table 1).

Among the components of "imagio Neo453" manufactured by RICOH, only a sheet feeding device was modified to be used for the "BELT METHOD" of this comparative test. The modified sheet feeding device used for the "BELT METHOD" basically has the same configurations and specifications as that of the sheet conveying device 5 of the sheet feeding device 3 shown in FIGS. 2 through 4.

For the "EXAMPLE METHOD", "imagio Neo453" manufactured by RICOH including a sheet feeding device with a known sheet conveying device was used. Specifically, the known sheet conveying device corresponds to the sheet conveying device 5' of the sheet feeding device 3 shown in FIG. 2. That is, the sheet conveying device for "EXAMPLE METHOD" is different from the sheet conveying device for "BELT METHOD" according to the above-described example embodiment with reference to FIGS. 2 through 4, and includes the roller-type pulley 83 to be the only rotary conveyance member facing and contacting the grip roller 81 and does not include the conveyor belt 82 and the roller-type pulley 84.

Details of the belt-type conveying unit 8 and peripheral components used for this comparative test in the belt method are described below (components commonly applied to the example method can be included as well):

Material of the conveyor belt 82: ethylene propylene rubber (EPDM);

Hardness of the conveyor belt 82: JIS K6253 A type 40 degrees;

Frictional coefficient of the conveyor belt 82 with respect to sheet: 2.6;

Wall thickness of the conveyor belt 82: 1.5 mm;

Diameter of the roller-type pulley 83: 13 mm;

Diameter of the roller-type pulley 84: 7 mm;

Gap or distance between the roller-type pulleys 83 and 84: 13 mm (distance between axes of pulley shafts 83*a* and 84*a*);

Extension factor of the conveyor belt 82: 7%; and

Diameter of the rollers 60, 61, 62, and 81: all 20 mm.

As the basic test conditions, the weight of a sheet (meter basis weight or grams per square meter ($g/m^2$)) was employed to represent the stiffness (rigidity) of the sheet. Six types of sheets with different weights were passed through the above copies from sheet feeding trays corresponding to the same stages under an environment of normal temperature (23 degree Celsius, relative humidity 50%). Other test conditions described below with reference to FIG. 5 were also applied to test differences in conveying time between the different types of sheets. The test results indicating the differences in conveying time are shown in FIG. 9, and Table 1 indicates a summary of the sheet passing properties based on the test results shown in FIG. 9.

The sheet conveying device 5 shown in FIG. 5 further includes a sheet feeding sensor 88 and a vertical conveyance sensor 89. The sheet feeding sensor 88 detects the leading edge of the sheet S picked up by the pickup roller 60, and the vertical conveyance sensor 89 detects the leading edge of the sheet S conveyed by the second conveying unit 7 for "BELT METHOD" or the pair of the grip roller 81 and the roller-type pulley 83 for "EXAMPLE METHOD". The sheet feeding sensor 88 and the vertical conveyance sensor 89 are both reflection type photo-sensors.

The conveying path length (sheet conveying distance) between the positions at which the sheet feeding sensor 88 and the vertical conveyance sensor 89 are disposed is 57 mm for both in the belt method and the example method. The conveying path length between the position at which the sheet feeding sensor 88 is disposed and the nip contact between the feed roller 61 and the reverse roller 62 is 10 mm. The conveying path length between the nip contact between the feed roller 61 and the reverse roller 62 and the nip contact of the second conveying unit 7 for "BELT METHOD" or between the nip contact between the feed roller 61 and the reverse roller 62 and the nip contact between the grip roller 81 and the roller-type pulley 83 for "EXAMPLE METHOD" is 38 mm for both methods. And, the conveying path length between the nip contact of the second conveying unit 7 for "BELT METHOD" and the position where the vertical conveyance sensor 89 is disposed or between the nip contact between the grip roller 81 and the roller-type pulley 83 for "EXAMPLE METHOD" and the position where the vertical conveyance sensor 89 is disposed to 9 mm for both methods. Accordingly, the total conveying path length is 57 mm for both methods.

The curvature radius at the center of the curved sheet conveying path or first sheet conveying path PA between the first conveying unit 6 and the second conveying unit 7 of the sheet conveying device 5 is approximately 20 mm for both the belt method and the example method.

For both the belt method and the example method, tests were conducted for two different values of a parameter including the pickup pressure or sheet feeding pressure of the pickup roller 60, namely 1.1N and 2.2N. The linear speed of both the feed roller 61 on the driving side and the grip roller 81 on the driving side was 154 mm/s. The time required for the leading edge of the sheet S to be conveyed from the sheet feeding sensor 88 to the vertical conveyance sensor 89, corresponding to 57 mm of the conveying path, was measured for five different types of paper with an oscilloscope. Results indicating differences between the conveyance times between different types of paper are shown in the graph of FIG. 9.

The graph of the test results in FIG. 9 show that in the example method, if the sheet is 256 g/m$^2$ meter basis weight or more, the conveyance time considerably changes or becomes long or the amount of variations in the conveyance time is great, and the sheet is caused to slip considerably. Meanwhile, in the belt method to which the present patent application is applied, even if the sheet is 256 g/m$^2$ meter basis weight or more, the conveyance time changes only scarcely or does not become as long as the example method or the amount of variations in the conveyance time is small, and the sheet is caused to slip only scarcely. Furthermore, if the pickup pressure is reduced, the conveying force decreases. However, in the belt method to which the present patent application is applied, the conveying force may not be affected as much even if the pickup pressure is reduced. This means that the pickup pressure can be made smaller by employing the belt method to which the present patent application is applied, and therefore, the power of the driving motor can be reduced. As a result, the apparatus can be made compact.

Table 1 summarizes the sheet passing properties based on the test results shown in FIG. 9.

In Table 1, "meter basis weight" corresponds to the weight (grams) of a sheet per one square meter. In general, a sheet with a small meter basis weight is "light paper" or "thin paper", and a sheet with a large meter basis weight is "heavy paper" or "thick paper."

In the first test results shown in Table 1, "GOOD" indicates that "sheet passing property is good." Specifically, "GOOD" means that the leading edge of the sheet S reached the vertical conveyance sensor 89 within a given time after the sheet feeding sensor 88 had turned on and detected the leading edge of the sheet S. Conversely, "POOR" indicates that "sheet passing property is unacceptable." Specifically, "POOR" means that the leading edge of the sheet S did not reach the vertical conveyance sensor 89 within a given time after the sheet feeding sensor 88 had turned on and detected the leading edge of the sheet S.

TABLE 1

| METER BASIS WEIGHT | EXAMPLE METHOD | BELT METHOD |
|---|---|---|
| 80 g/m$^2$ | GOOD | GOOD |
| 100 g/m$^2$ | GOOD | GOOD |
| 170 g/m$^2$ | GOOD | GOOD |
| 210 g/m$^2$ | GOOD | GOOD |
| 256 g/m$^2$ | POOR | GOOD |
| 300 g/m$^2$ | POOR | GOOD |

GOOD: sheet passing good; and
POOR: sheet passing unacceptable.

In the first test results shown in Table 1, if the paper type is 256 g/m$^2$ meter basis weight or more, the results were "POOR" in the example method, whereas all of the results were "GOOD" in the belt method according to the this example to which the present patent application is applied shown in FIGS. 2 through 8A and 8B.

By comparing the sheet passing and conveying properties observed in the test, the inventors have found that, in the example method, if the paper type is 256 g/m$^2$ meter basis weight or more, the sheet may be too stiff to bend along the curved sheet conveying path. Hence, the leading edge of the sheet S may be disadvantageously crushed against the roller-type pulley 83 that faces and contacts the grip roller 81 (see FIGS. 2 through 5).

Furthermore, tests were conducted with sheets of 256 g/m$^2$ meter basis weight or more with coated surfaces and uncoated surfaces to observe whether it makes a difference in sheet passing and conveying properties. However, no particular results distinguishable from those of the first test shown in Table 1 were obtained.

The conclusions described below can be made from the tests results observed in the above-described example embodiment. That is, when a highly rigid sheet that is 256 g/m$^2$ meter basis weight or more is conveyed from the first conveying unit 6 to the conveying surface 82*a* of the belt-type conveying unit 8 via the first sheet conveying path PA, the following configuration can be achieved. For example, because the highly rigid sheet is capable of being conveyed in a rectilinear manner, various guiding members including the first sheet conveying path PA can be made to have simplified shapes so as to reduce the conveyance load resistance, or the various guiding members can be completely omitted.

Therefore, in the sheet conveying device dedicated for conveying the sheet S with a relatively high rigidity, the essential components are the first conveying unit 6, the second conveying unit 7, and the belt-type conveying unit 8 (moving and guiding unit) for guiding the sheet to the second conveying unit 7 while keeping the leading edge of the sheet S in contact with the belt-type conveying unit 8. The belt-type conveying unit 8 is disposed along the outer side of the first sheet conveying path PA (in this case, guiding members are unnecessary) formed between the first conveying unit 6 and the second conveying unit 7.

For the above-described reasons, the various guiding members forming the first sheet conveying path PA are necessary for conveying a sheet S with a relatively low rigidity, such as plain paper (PPC). As such a PPC sheet S cannot be conveyed in a rectilinear manner compared to the case of a highly rigid sheet S such as a cardboard recording paper, the various guiding members of the first sheet conveying path PA are necessary to compensate for this disadvantage in guiding the sheet S to the conveying surface 82*a* of the belt-type conveying unit 8. That is, as the rigidity of the sheet S becomes lower, the sheet S moves in a less rectilinear manner. Therefore, to assist the sheet S to move in a rectilinear manner, guiding surfaces of the various guiding members in the first sheet conveying path PA may need to have appropriate shapes so as to ensure that the leading edge of the sheet S abuts against the abdominal portion of the conveying surface 82*a* of the conveyor belt 82.

This means that the higher the rigidity of the sheet S (more meter basis weight) becomes, the more flexible the design of the shapes and positions of the various guide members including the sheet conveying path with a curved section of a relatively small curvature radius can be obtained.

The material of the conveyor belt 82 is not limited to that of the above-described comparative test. That is, the material can be, for example, chloroprene rubber, urethane rubber, or silicon rubber. The hardness of the rubber of the conveyor belt 82 can be JIS K6253 A type in a range from 40 degrees to 80 degrees (JIS: Japan Industrial Standard).

It is noted that the present patent application is not limited to show that a sheet having a great meter basis weight, which is a relatively rigid paper, can be transferred without causing any transfer failure. For example, Table 1 described in the present patent application proves that, by the use of the belt-type conveying unit 8, even a sheet having a great meter basis weight can be transferred.

According to the results of the above-described comparative test, the curvature radius of the first sheet conveying path PA can be formed relatively small. Therefore, the sheet conveying device 5 shown in FIGS. 2 through 8A and 8B and the copier 1 including the sheet conveying device 5 can provide a configuration thereof that is compact and space-saving in the width direction of main body 2 of the copier 1, simple, low-cost, and capable of conveying various sheet types. The basic configuration can be made by adding the belt-type conveying unit 8 provided with a conveyor belt stretched around rollers included in the second conveying unit 7, and a driving source dedicated to the belt-type conveying unit 8 can be omitted. Therefore, it is possible to realize a sheet conveying device or the sheet conveying device 5 in an image forming apparatus or the copier 1 that has a simple configuration that is thus low-cost.

In the configuration provided for a known sheet conveying device, a conveyance failure may occur when a highly rigid type of sheet is conveyed. The failure can be caused by a large conveyance resistance generated as the sheet contacts the conveying guiding member 70, or by a conveyance load in the first sheet conveying path PA between the first conveying unit 6 and the second conveying unit 7. However, the sheet conveying device 5 according to this example of the present patent application can convey highly rigid sheets without failures, and can thus convey various sheet types.

That is, the known configuration merely provides a fixed member for guiding a sheet, and thus does not eliminate the sheet difference between the conveyed sheet, which is a mobile object, and the fixed guiding member. As a result, a conveyance resistance is constantly generated.

By contrast, in the sheet conveying device 5 and the copier 1 according to this example with reference to FIGS. 2 through 8A and 8B of the present patent application, the conveyance resistance can be substantially completely eliminated. In addition, the sheet can be guided by actively applying a conveying and propelling force to move the sheet in the downstream direction or the conveying force of the second conveying unit 7 may be applied to the sheet in addition to the conveying force of the first conveying unit 6 so as to counter the conveyance load in the first sheet conveying path PA between the first conveying unit 6 and the second conveying unit 7 and move the sheet in the downstream direction.

In the sheet conveying device 5, the frictional resistance between the sheet S and the conveyor belt 82 may not obstruct the sheet S from being conveyed. Further, the frictional resistance may function as a negative resistance to apply a conveying and propelling force to the sheet S. That is, the frictional resistance may not obstruct the sheet S from being conveyed, but may be converted into an advantageous negative resistance to apply a conveying and propelling force to the sheet S.

Furthermore, in the conveying direction of the sheet S, as the leading edge of the sheet S abuts against the moving surface or conveying surface 82*a* of the conveyor belt 82 and is then conveyed forward by the conveyor belt 82, the leading edge of the sheet S gradually may overlap the outer circumferential surface 82*a* of the conveyor belt 82, even though there may be differences according to the rigidity of the sheet type. As a result, the area of the sheet in contact with the moving surface of the belt gradually can increase. Thus, the resistance between the sheet and the outer circumferential surface 82*a* of the conveyor belt 82 may increase as the contact area increases. Therefore, an even larger conveying and propelling force for moving the sheet S in the conveying direction can be applied from the conveyor belt 82 to the sheet S. Further, the conveyor belt 82 can change the direction of the sheet S in a direction toward the nip contact between the grip roller 81 and the conveyor belt 82. This configuration can ensure a steady increase of the conveying and propelling force transmitted from the outer circumferential surface or conveying surface 82*a* of the conveyor belt 82 to the sheet surface.

Therefore, even if the sheet S is highly rigid, it is possible to overcome this rigidity and appropriately deform or bend the sheet S in its thickness direction, and thereby ensuring that the sheet S is steadily conveyed toward the sheet holding section of the second conveying unit 7 in the downstream direction. In this manner, it is possible to address the factors of major conveyance failures caused by the fact that the sheet S is highly rigid. Therefore, it is ensured that the sheet S can be steadily conveyed after the leading edge of the sheet S reaches the sheet holding section of the second conveying unit 7. As a result, the sheet conveying device 5 can convey various types of sheets and achieve excellent sheet conveying properties.

Figure 10:
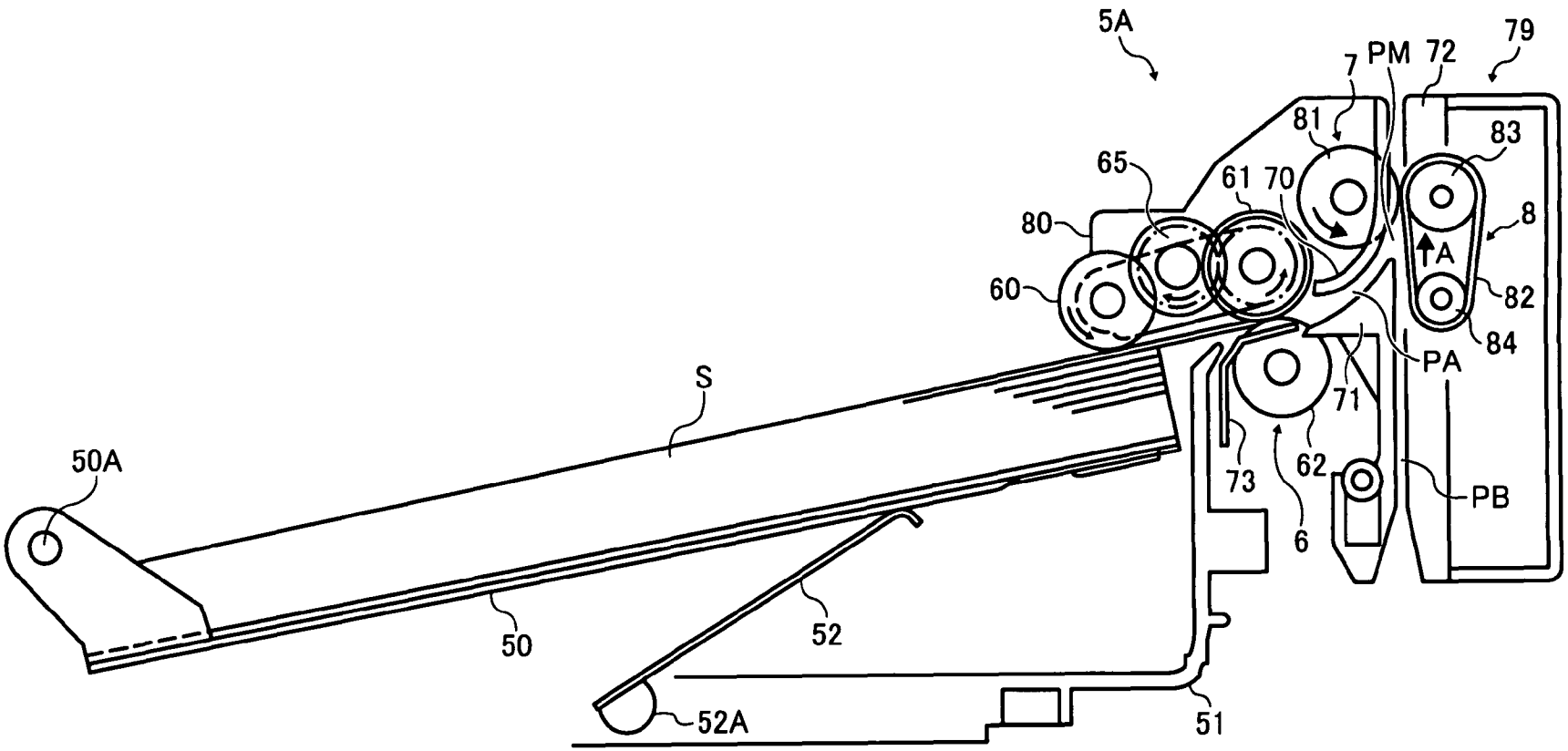
FIG. 10 is a cross-sectional view of another sheet conveying device according to an example embodiment of the present patent application.
Figure 11:
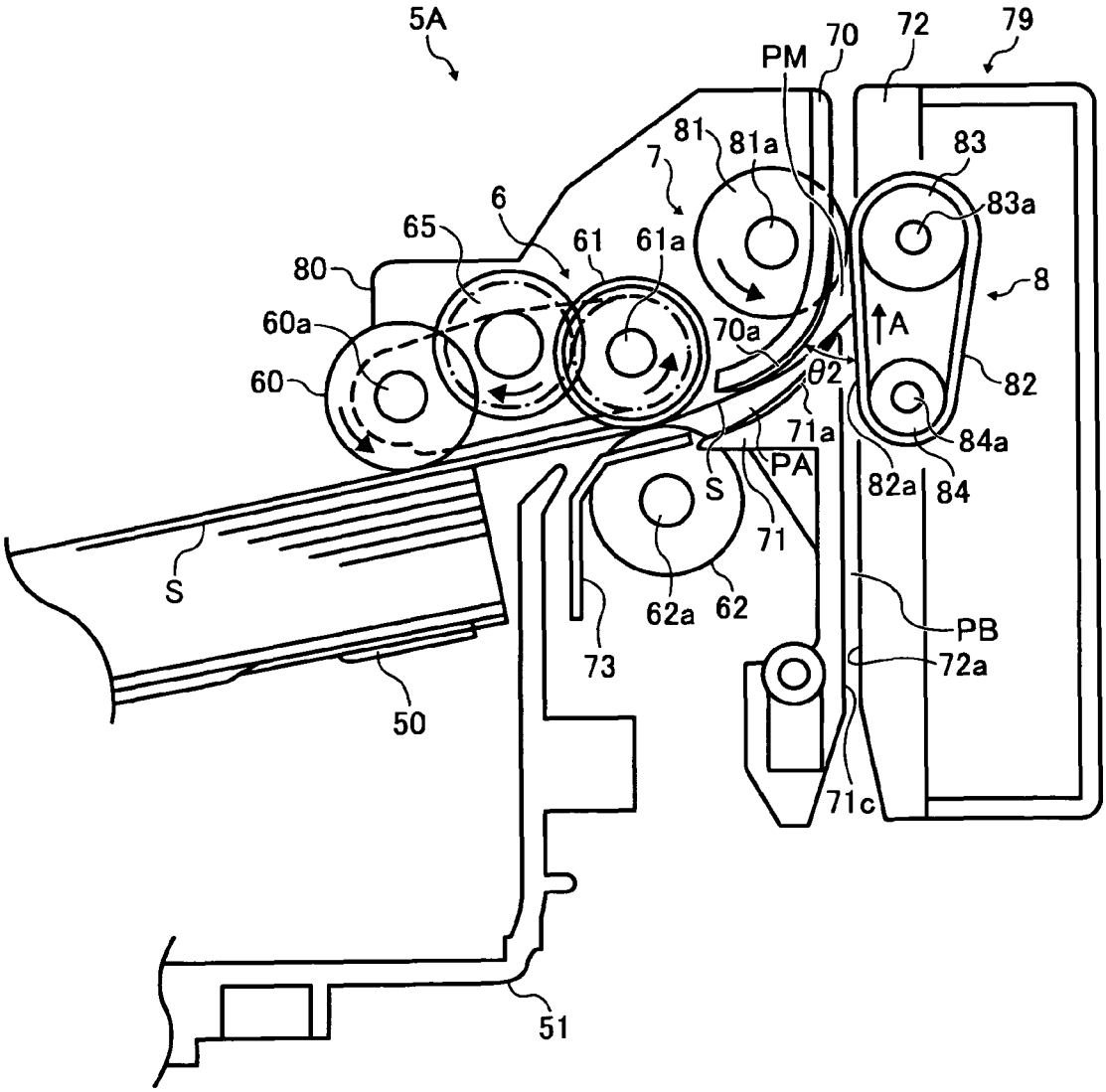
FIG. 11 is an enlarged cross-sectional view showing one state of the sheet conveying device of FIG. 10.
Figure 12:
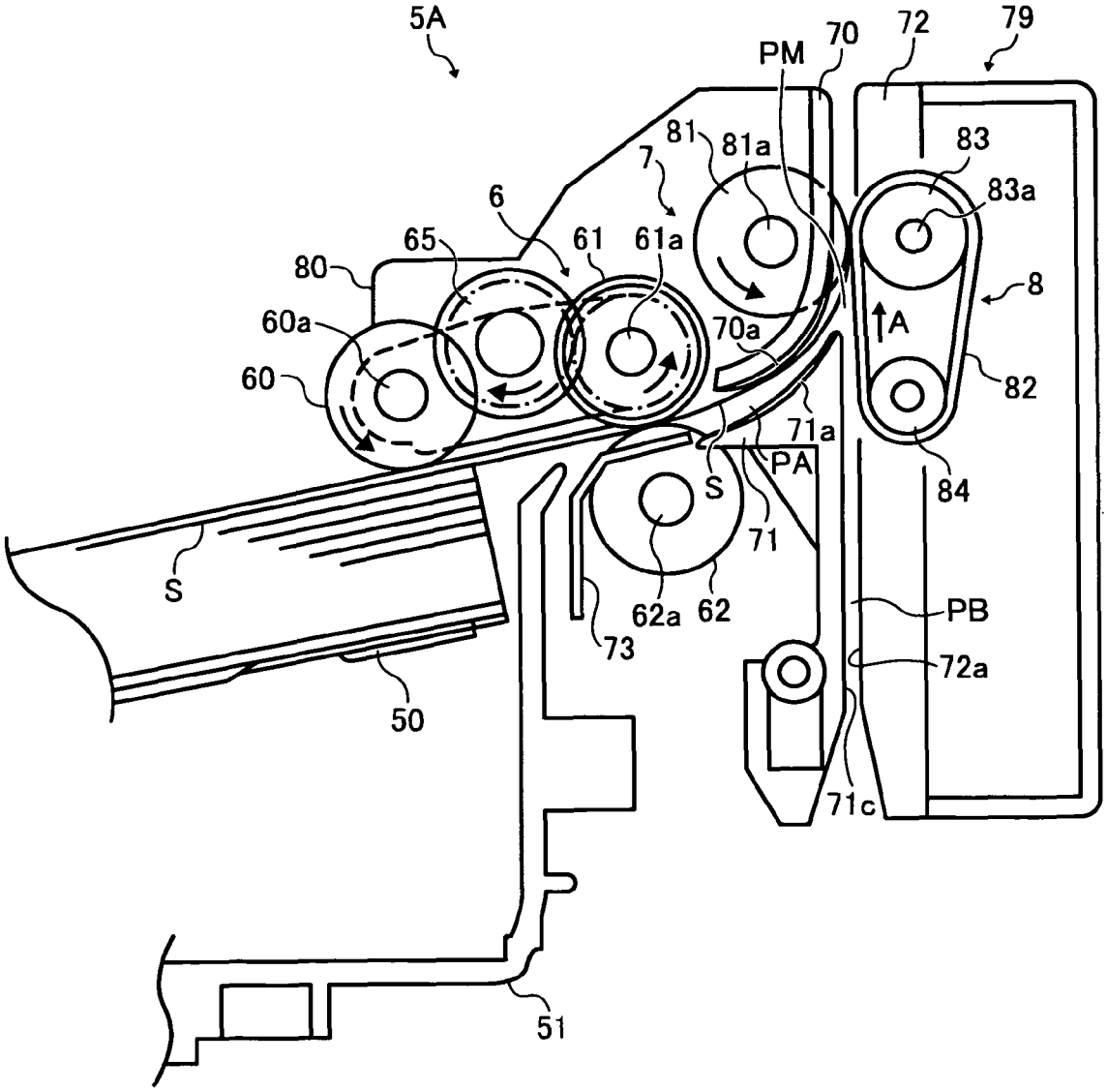
FIG. 12 is an enlarged cross-sectional view showing another state of the sheet conveying device of FIG. 10.

Next, referring to FIGS. 10 through 12, schematic configuration and functions of a sheet conveying device 5A according to an example of the present patent application is described.

Elements and members corresponding to those of the sheet conveying device 5 of the example shown in FIGS. 2 through 8A and 8B are denoted by the same reference numerals and descriptions thereof are omitted or summarized. Although not particularly described, configurations of the sheet conveying device 5A, etc., and operations that are not particularly described in this example are the same as those of the sheet conveying device 5 of the example previously described with reference to FIGS. 2 through 8A and 8B.

The main differences between the sheet conveying device 5 shown in FIGS. 2 through 8A and 8B according to the previously described example and the sheet conveying device 5A shown in FIGS. 10 through 12 according to this example are as follows.

In addition to the first sheet conveying path PA serving as a first sheet conveying path formed between the first conveying unit 6 and the second conveying unit 7, a second sheet conveying path PB serving as a second sheet conveying path is provided. The second sheet conveying path PB, which is different and separate from the first sheet conveying path PA, may be formed by a guide surface 71*c* of the conveying guide member 71 and the guide surface 72*a* of the conveying guide member 72 and extend from an upstream position of the second conveying unit 7 to the second conveying unit 7. The first sheet conveying path PA and the second sheet conveying path PB may merge at an upstream side of the second conveying unit 7, thereby forming a common conveying path PM. The belt-type conveying unit 8, which is one of the members of the second conveying unit 7, is disposed along the outer side of the first sheet conveying path PA and the second sheet conveying path PB. Apart from these differences, the sheet conveying device 5A according to the above-described example described with reference to FIGS. 10 through 12 is the same as the sheet conveying device 5 according to the previously described example with reference to FIGS. 2 through 8A and 8B.

That is, the pulley 84 around which the conveyor belt 82 is stretched in the belt-type conveying unit 8. The pulley 84 is one member of the pair of roller-type pulleys 83 and 84, axially rotatably supported by the housing 80, and disposed beneath the pulley 83 with a space therebetween. Therefore, it can be ensured that the leading edge of the sheet S conveyed by the first conveying unit 6 into the first sheet conveying path PA abuts against the conveying surface 82*a* of the conveyor belt 82, and that the sheet S conveyed along the second sheet conveying path PB by a conveying unit, not shown, is not obstructed from reaching the second conveying unit 7.

Next, the conveying operations of the sheet conveying device 5A according to the above-described example with reference to FIGS. 10 through 12 are described.

The sheet S may be extracted and conveyed from a stack of sheets stacked horizontally in the sheet feeding cassette 51. Therefore, the sheet conveying direction in the sheet feeding and separating mechanism of the first conveying unit 6 is a substantially horizontal direction. Subsequently, the sheet S is conveyed upward an image forming section of the main body 2 of the copier 1 positioned above. Therefore, the sheet S may need to be conveyed in a substantially vertical and upward direction, which is orthogonal or perpendicular to the substantially horizontal direction.

Thus, as shown in FIG. 11, after the sheets S have been separated one by one in the sheet feeding and separating mechanism, the sheet S may bend moderately while being conveyed to reduce the conveyance resistance, and then the leading edge of the sheet S may abut against the conveyor belt 82.

The conveyor belt 82 may move in a substantially vertically upward direction or substantially directly upward direction as indicated by arrow "A" in FIGS. 11 and 12. The leading edge of the sheet S abutting the conveyor belt 82 may be conveyed to the sheet holding section or nip contact between the grip roller 81 and the conveyor belt 82, and then be conveyed to the downstream side in the substantially directly upward direction by the grip roller 81 and the conveyor belt 82 while being held therebetween. As described above, a conveying and propelling force may be transmitted from the conveyor belt 82 to the sheet S for moving the sheet S in the conveying direction. Moreover, the conveyor belt 82 may change the direction of the sheet S toward the nip contact between the grip roller 81 and the conveyor belt 82. Accordingly, even a highly rigid sheet S can be steadily conveyed without causing conveyance failures.

With the above-described configuration and conveying operations, the sheet conveying device 5A provided with the common conveying path PM shown in FIGS. 10 through 12 can provide the same effects as those of the sheet conveying device 5 shown in FIGS. 2 through 8A and 8B. That is, a highly rigid sheet such as a cardboard recording paper can be steadily conveyed, and thereby achieving preferable sheet conveying properties. Moreover, the sheet conveying device 5A of this example may have multiple conveying paths, at least the first sheet conveying path PA and the second sheet conveying path PB, so as to be applied to a wider range of machine types.

Next, an example to which the present patent application is applied is described with reference to FIG. 13, which shows a schematic configuration of a sheet conveying device 5B.

Elements and members corresponding to those of the previously described examples with reference to FIGS. 3 through 8 and FIGS. 10 through 12 are denoted by the same reference numerals and descriptions thereof are omitted or summarized. Although not particularly described, configurations of the sheet conveying device 5B, etc. and operations that are not particularly described in this example are the same as those of the sheet conveying apparatus 5A of the previously described example with reference to FIGS. 10 through 12.

Figure 13:
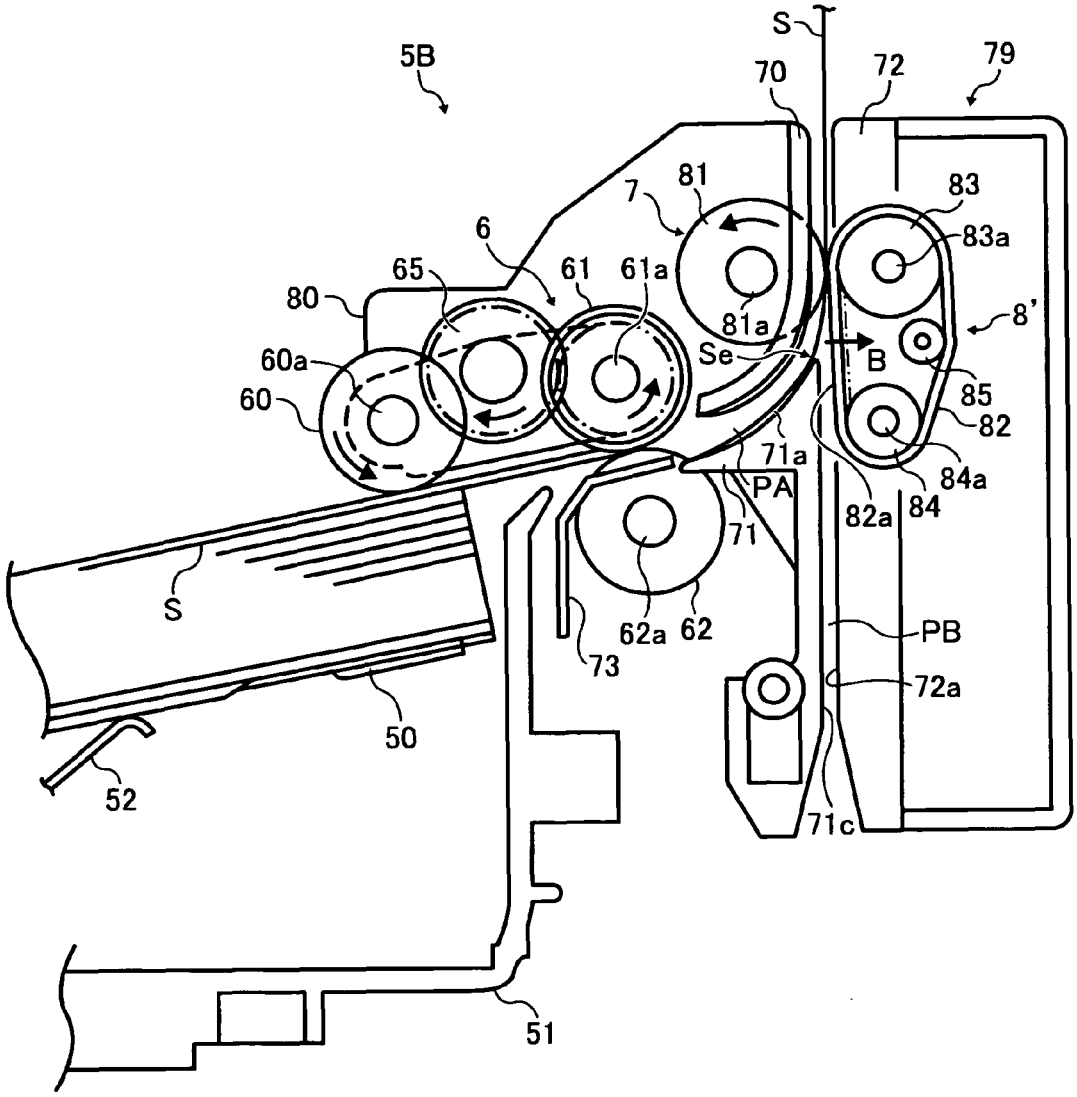
FIG. 13 is an enlarged cross-sectional view showing another state of the sheet conveying device of FIG. 10.

As shown in FIG. 13, when a trailing edge Se of the sheet S that is bent while being conveyed is released from the conveying guiding member 71, the reaction force of the bent sheet S may cause the trailing edge Se of the sheet S to move in a direction indicated by arrow B shown in FIG. 13, i.e., may cause a flipping phenomenon. Particularly if the sheet S is stiff or highly rigid such as a cardboard recording paper, the reaction force may be larger, and therefore, a sudden noise caused by this flipping phenomenon may become a problem.

For example, in the process of that the sheet S is conveyed, the sheet S is held at two or more supporting points and is forcibly bent. When the trailing edge Se of the sheet S is released from the sheet holding section of the first conveying unit 6 or the conveying guiding member 71 acting as one of the supporting points, the sheet S may be supported only at the leading edge. Thus, an elastic restoring force of the belt sheet S may cause the trailing edge of the sheet S to immediately collide against the conveying surface 82*a* of the conveyor belt 82. The impact of the collision may become larger as the rigidity of the sheet S becomes greater or higher.

Accordingly, the sudden noise, which is made when the trailing edge Se of the sheet S is caused to collide against the conveying belt 82 by the flipping phenomenon, may not only be unpleasant for the user but may also cause the user to have a misperception that a failure has occurred. That is, even if the sheets S are being conveyed normally, regardless of whether the sheet S is a regular type or a highly rigid type, the above-described sudden noises may give the wrong impression to the user that the copier 1 is malfunctioning.

To address this issue, as shown in a belt-type conveying unit 8' in FIG. 13, a tension roller 85 serving as a contacting member may be disposed away from the side of the conveying surface 82*a* of the conveyor belt 82. The tension roller 85 is a member that contacts the conveyor belt 82, together with the grip roller 81, the pair of roller-type pulleys 83 and 84 around which the conveyor belt 82 is stretched. Accordingly, the portion of the conveying surface 82*a* of the conveyor belt 82 may be made to have appropriate elasticity, so that the impact caused by the flipping phenomenon of the trailing edge Se of the sheet S can be absorbed by the elastic property of the conveyor belt 82. Thus, the sheet-conveying device 5B can remain silent even while a highly rigid sheet S such as a cardboard recording paper is being conveyed.

Among the two linear portions of the conveyor belt 82 stretched around the pair of roller-type pulleys 83 and 84, the tension roller 85 may not be arranged on the side of the conveying surface 82*a* of the conveyor belt 82, but on the opposite side and in contact with the inside perimeter of the conveyor belt 82. Furthermore, the tension roller 85 may axially be supported so as to be movable in an outward direction from inside the conveyor belt 82, and be pressed outward in the right direction as viewed in FIG. 13 by a forcing unit, not shown. Therefore, the tension roller 85 may be caused to rotate by the movement of the conveyor belt 82, and contact the inside perimeter of the conveyor belt 82 while constantly receiving a given pressing force in an outward direction, so that the conveyor belt 82 can maintain a fixed tension without slackening in its circumferential direction.

Accordingly, in the sheet conveying device 5B of the this example of the present patent application, the following advantage is achieved. That is, as the leading edge of the sheet S in the sheet travel direction is held and conveyed by the second conveying unit 7, the trailing edge Se of the sheet S may be released from being supported by the conveying guiding member 71 and may be made to collide against the conveying surface 82*a* of the conveyor belt 82. However, the conveying surface 82*a* of the conveyor belt 82 can elastically deform sufficiently and change its position in the direction of collision as indicated by the chain double-dashed line in FIG. 13. Accordingly, the impact caused by the flipping phenomenon of the trailing edge Se of the sheet S can be absorbed, and the noise caused by the impact can be reduced, so that abnormal noises can be reduced and mitigated during the operation of the sheet conveying device 5B.

As described above, in the sheet conveying device 5B of the example with reference to FIG. 13, as one of the contacting members to support the conveyor belt 82, the tension roller 85 may be provided in contact with the conveyor belt 82 where the trailing edge Se of the conveyed sheet S does not come in contact with the conveying surface 82*a* of the conveyor belt 82. When the sheet S that is bent to a given extent is conveyed and the trailing edge Se of the sheet S is released from either one of the nip contact of the first conveying unit 6 or the conveying guiding member 71, the trailing edge Se of the sheet S may collide against the conveying surface 82*a* of the conveyor belt 82. However, the portion of the conveyor belt 82 where this collision occurs may elastically bend sufficiently to absorb the impact of the collision. Therefore, the sudden noise or flipping noise caused by the collision can be reduced. That is, when the trailing edge Se of the sheet S contacts the conveying surface 82*a* of the conveyor belt 82, the contacting member, i.e., the tension roller 85, may not obstruct the deforming motion of the conveyor belt 82 where it is contacted by the trailing edge Se of the sheet S. Thus, the conveyor belt 82 may sufficiently bend in the same direction as the direction in which the trailing edge Se of the sheet S contacts the conveyor belt 82.

Particularly, when a highly rigid sheet S such as a cardboard recording paper is being conveyed and the trailing edge Se of the sheet S in the sheet travel direction strongly collides against the conveyor belt 82, the elastic deforming motion of the conveyor belt 82 may absorb and reduce the impact caused by the collision so that an impulsive noise can sufficiently be reduced.

Accordingly, as sudden noises is reduced while conveying the sheet S, the operations may be performed quietly so that unpleasant noises can be reduced or prevented, if possible, and misperceptions that a failure has occurred may not be created. This may result in advantageous usability of the sheet conveying device 5B.

In the process of conveying the sheet S, even if a sudden noise is not generated when the leading edge of the sheet S firstly contacts the conveying surface 82*a* of the conveyor belt 82, the above-described configuration may still have an advantageous effect. That is, as the conveyor belt 82 elastically deforms to some extent, the leading edge of the sheet S may be prevented from bouncing back from the conveying surface 82*a* of the conveyor belt 82. Instead, the leading edge of the sheet S softly may abut the conveying surface 82*a* and stay in contact with the conveying surface 82*a* of the conveyor belt 82. For example, when the leading edge of the sheet S conveyed by the first conveying unit 6 first abuts the conveying surface 82*a* of the conveyor belt 82 moving in the sheet conveying direction at an oblique collision angle θ2 (see FIG. 11), the leading edge of the sheet S may be prevented from bouncing back from the conveying surface 82*a* of the conveyor belt 82. Rather, the leading edge of the sheet S may be caused to follow the direction of movement of the conveying surface 82*a* of the conveyor belt 82 and change its direction to that of the conveyor belt 82.

This example with reference to FIG. 13 is not limited but can be applied to any other structure as long as the conveyor belt 82 can be deformed in such a manner that a sheet conveying device operates sufficiently quietly. For example, among the two substantially linear belt moving surfaces of the conveyor belt 82 stretched around the pair of roller-type pulleys 83 and 84 spaced apart in a given manner, the tension roller 85 is not limited to being provided on the linear surface opposite to the conveying side of the conveyor belt 82, i.e., the side not facing the first conveying unit 6. Alternatively, the tension roller 85 can be provided on the belt moving surface facing the first conveying unit 6. That is, regardless of the rigidity of the sheet S in its thickness direction, the trailing edge of the sheet S can constantly contact the substantially same position of the belt conveying surface. Accordingly, the tension roller 85 is to be arranged in contact with the conveyor belt 82 at a position sufficiently spaced apart from where the trailing edge Se of the sheet S contacts the belt conveying surface so as to allow the conveyor belt 85 to deform.

In the sheet conveying device 5B of this example with reference to FIG. 13, the tension roller 85 may be arranged at a position defined as above to apply a pressing force from inside to stretch the conveyor belt 82 outward. Conversely, the tension roller 85 can be arranged so as to apply a pressing force from outside the conveyor belt 85 to stretch the conveyor belt 82 inward.

In such a configuration, the tension roller 85 can also have a function of cleaning the outer circumferential surface or conveying surface 82*a* of the conveyor belt 82 in addition to the function of applying tension to the conveyor belt 82. With such a tension roller having functions of applying pressure to the conveyor belt 82 and cleaning the belt conveying surface, the belt conveying surface can be maintained in a clean condition, which may improve the image quality. Furthermore, at a position defined as above, a tension roller and a cleaning roller can be provided separately, or only a cleaning roller that primarily functions as a cleaning unit and does not primarily function as a tensioning unit can be provided.

Next, referring to FIGS. 14 through 22C, a schematic configuration of a sheet conveying device 500 according to an example embodiment of the present patent application is described.

Elements having the same functions and shapes are denoted by the same reference numerals throughout the specification and redundant descriptions are omitted.

Figure 14:
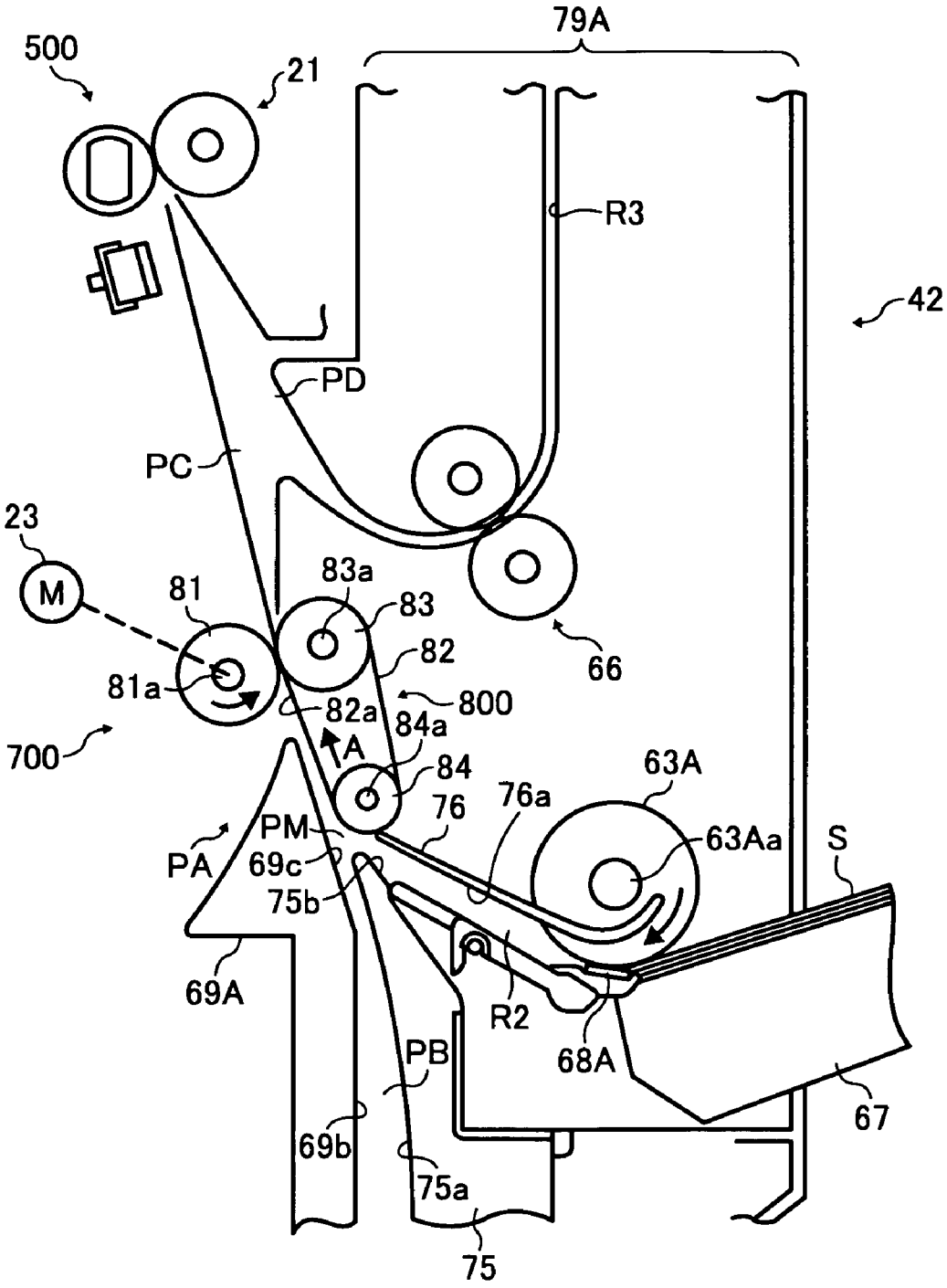
FIG. 14 is a cross-sectional view showing a schematic configuration of a sheet conveying device according to an example embodiment of the present patent application.

As shown in FIG. 14, the sheet conveying device 500 is disposed at a downstream side of the manual sheet conveying path R2, which is curved, serving as a second sheet conveying path and manual sheet conveying path. The sheet conveying device 500 includes a second conveying unit 700 serving as a hold and transfer unit that forms a holding section or a nip contact for holding and conveying a sheet.

The second conveying unit 700 includes a belt-type conveying unit 800 in which the grip roller 81 and the conveyor belt 82 are disposed facing to each other.

The belt-type conveying unit 800 is disposed along the inner side of the manual sheet conveying path R2 through which the sheet S fed from the manual sheet feeding tray 67 is conveyed.

The grip roller 81 serves as a rotary feed driving member applicable to transmit a rotational driving force thereof.

The conveyor belt 82 may cause to increase a conveying force to the sheet S by rotating with the grip roller 81 and contacting the surface of the sheet S. At least a part of the manual sheet conveying path R2 may be formed by the belt-type conveying unit 800 and a conveying guide member 69A disposed facing the belt-type conveying unit 800.

The conveyor belt 82 may have different functions from the functions provided to the above-described examples. However, it may also be regarded that the conveyor belt 82 of this example embodiment rotates with the grip roller 81 and contacts the surface of the sheet S so as to supportably move and guide (convey) the sheet S.

The sheet conveying device 500 according to this example embodiment shown in FIG. 14 is primarily different from the sheet conveying device 5 of the previously described example with reference to FIGS. 2 through 8A and 8B in the following points and subsequently described characteristics.

Instead of the second conveying unit 7' of the upper stage in the sheet feeding device 3 shown in FIG. 2, the second conveying unit 700 includes the belt-type conveying unit 800 having a different configuration described below. Instead of the conveying guide member 71, the conveying guide member 69A is provided to the sheet conveying device 500. The first conveying unit 6 on the upper side in the sheet feeding device 3 shown in FIG. 2 is disposed at an upstream side of the conveying guide member 69A, not shown. The downstream end of the manual sheet conveying path R2 is connected to the upstream side of the second conveying unit 700 to form a common conveying path. The sheet separation mechanism of a manual sheet feeding unit, i.e., the manual sheet feeding tray 67, is changed to the friction pad sheet separation mechanism. The second conveying unit 7', not shown in FIG. 14, includes the grip roller 81 and the pulley 83 instead of the second conveying unit 700 on the lower side in the sheet feeding device 3 shown in FIG. 2.

From another point of view, the sheet conveying device 500 according to this example embodiment is different from a sheet conveying device 510 (see FIG. 23) according to another example embodiment in the following points and subsequently described characteristics.

Figure 15:
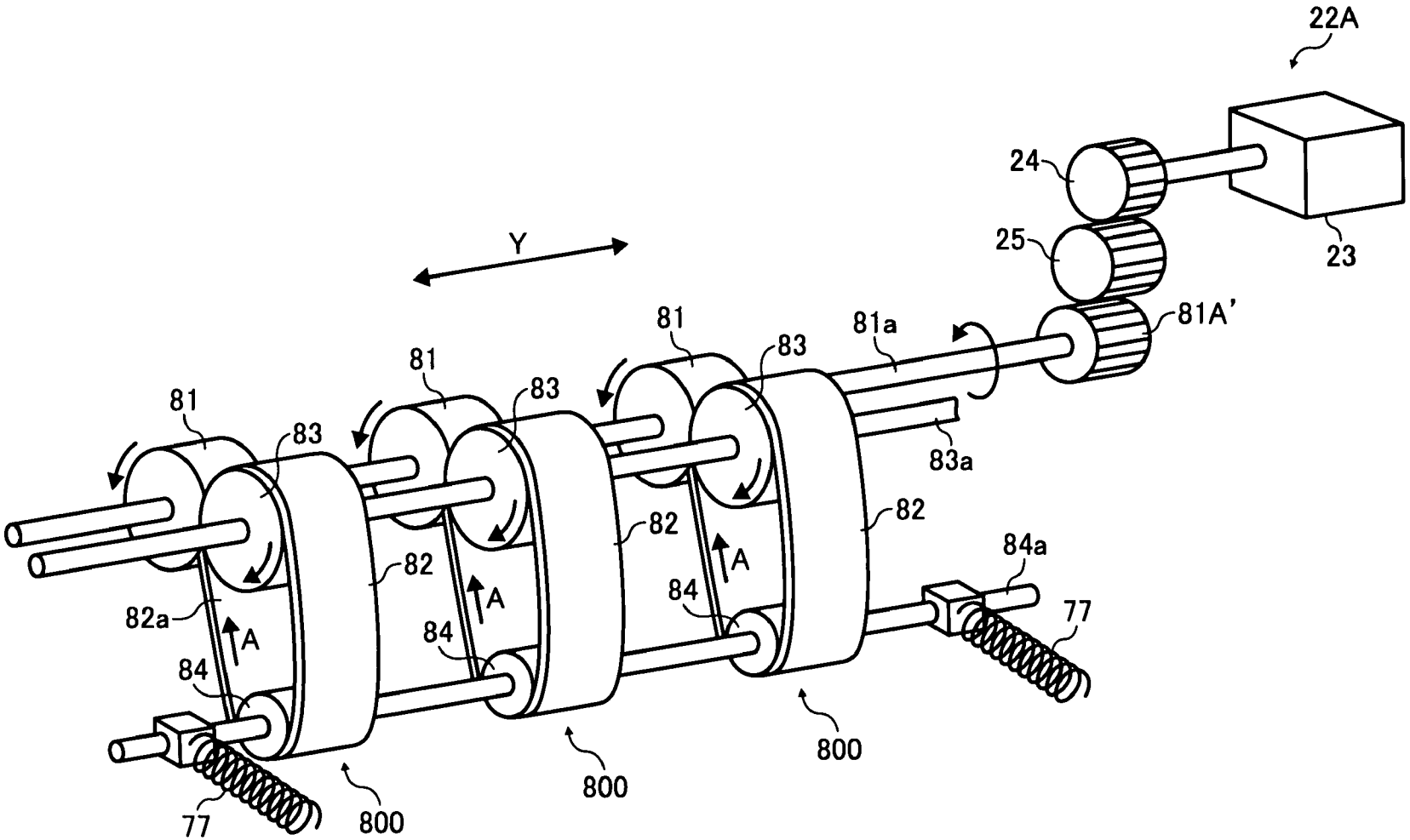
FIG. 15 is a schematic perspective view of a driving mechanism of the sheet conveying device according to an example embodiment of the present patent application.
Figure 23:
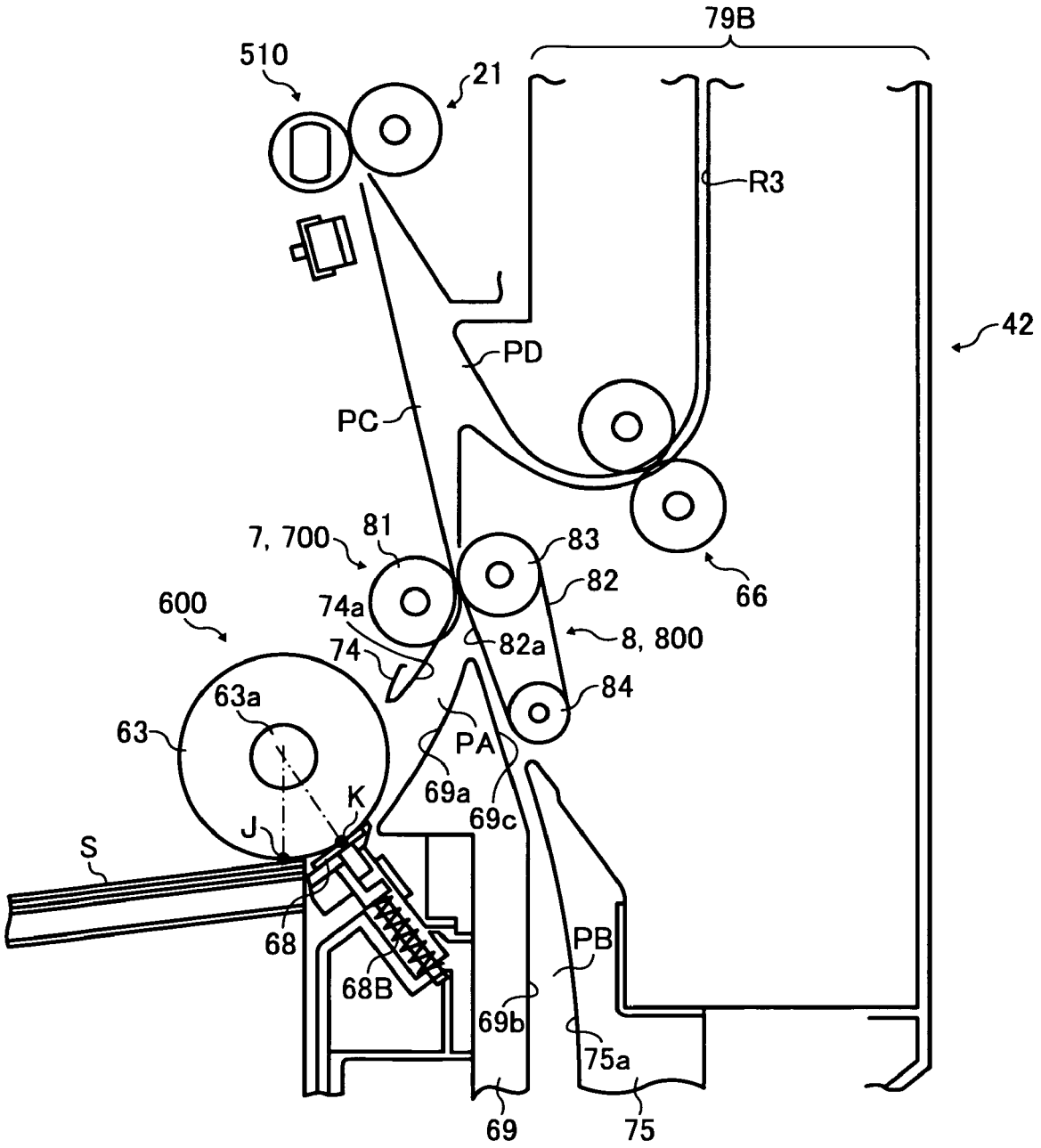
FIG. 23 is a cross-sectional view of another sheet conveying device according to an example embodiment of the present patent application.

While the sheet conveying device 510 according to an example embodiment shown in FIG. 23 includes the first conveying unit 6A on the upper stage of the sheet feeding device 3 shown in FIG. 23, the sheet conveying device 500 according to this example embodiment shown in FIGS. 14 and 15 has employed a conveying guide member 69A that is a partial modification of the conveying guide member 69. Further, the sheet conveying device 510 according to an example embodiment shown in FIG. 23 includes the driving mechanism while the sheet conveying device 500 according to this example embodiment shown in FIGS. 14 and 15 includes a driving mechanism 22A.

Specifically, the sheet conveying device 500 of this example embodiment shown in FIGS. 14 through 22C is primarily different from the sheet conveying device 5 of the above-described example with reference to FIGS. 2 through 8A and 8B in the following points and subsequently described characteristics.

As shown in FIGS. 14 and 15, the sheet conveying device 500 has changed a sheet separation method in the sheet feeding device 3, not shown in FIGS. 14 and 15, in the upper and lower sheet feeding cassettes 51, not shown in FIGS. 14 and 15, from the FRR sheet separation method to the friction pad sheet separation method.

The manual sheet feeding tray 67 also uses the friction pad sheet separation mechanism. This change has shifted the location of the manual sheet feeding tray 67 to a slightly more left side of the sheet feeding device 3 in FIG. 14 than in FIGS. 2 through 8A and 8B.

According to the above-described change, the width and space of the copier 1 in a range from left to right in FIG. 14 have been made smaller.

The location of the belt-type conveying unit 800 of the second conveying unit 700 has changed as shown in FIG. 14 so as to effectively feed various types of sheets, which includes a relatively rigid sheet S, from the manual sheet feeding tray 67.

The entire position of the belt-type conveying unit 800 (especially, the conveying surface 82*a* of the conveyor belt 82) and the sheet S may be arranged so as to convey the sheet S in a left oblique direction.

According to the above-described change or modification of the belt-type conveying unit 800, a third conveying path PC, which is a sheet conveying path, from the second conveying unit 700 including the belt-type conveying unit 800 to the pair of registration rollers 21 may be shifted to the left side in FIG. 14. Therefore, a fourth conveying path PD serving as a common conveying path that meets and merges with the reverse conveying path R3 of the sheet reversing device 42 may be shifted to the left side in FIG. 14.

The belt-type conveying unit 800 may be located such that the conveying surface 82*a* of the conveyor belt 82 is disposed along the inner side of the manual sheet conveying path R2 through which the sheet S fed from the manual sheet feeding tray 67 is conveyed.

This example embodiment of the present patent application has the configuration substantially same as the copier 1 including the sheet conveying device 5 of the example with reference to FIGS. 2 through 8A and 8B, except for the above-described differences.

The third conveying path PC and the fourth conveying path PD are respectively formed by conveying guide members facing to each other with a given interval.

The sheet conveying device 500 according to this example embodiment of the present patent application has changed the sheet separation method from the FRR sheet separation method to the friction pad sheet separation method. According to the above-described change, the sheet conveying device 500 has removed the sheet feeding roller 67A and the separation rollers 67B and 67C shown in FIGS. 2 and 37, and employed, as shown in FIG. 14, a feed roller 63A, a friction pad 68A, and a spring or compression spring, not shown.

The feed roller 63A serves as a rotary sheet feeding member and is rotatably supported by a shaft 63Aa in a sheet feeding direction. The feed roller 63A is rotated by a driving unit, not shown, such as a driving motor.

The friction pad 68A serves as a frictionally resisting member to abut against the feed roller 63A.

The spring serves as a biasing or pressing member to press the friction pad 68A to the feed roller 63A.

Here, the feed roller 63A acts as a manual sheet feeding member and a member opposed to the sheet S so as to convey the sheet S set on the manual sheet feeding tray 67 to the main body 2 via the manual sheet conveying path R2 that serves as a manual sheet conveying path. The manual sheet feeding tray 67, which serves as a manual sheet feeding device, includes the feeding roller 67A and the separation rollers 67B and 67C, which are not shown in FIG. 14. The manual sheet feeding tray 67, the feed roller 63A, and the friction pad 68A form a manual sheet feeding section.

The driving mechanism 22A shown in FIG. 15 is different from the driving mechanism 22 shown in FIG. 6 only in the following point. That is, a grip roller driving gear 81A' directly meshes with the idler gear 25 included in a gear array in the driving mechanism 22A of FIG. 15.

Alternatively, the driving mechanism 22A may include the single sheet feeding motor 23 to provide a configuration in which a driving force exerted by the driving mechanism 22A causes to rotate the feed roller 63A with the grip roller 81, which is same as the driving mechanism 22 shown in FIG. 6.

In FIG. 14, the conveying guide member 69A may include a guide surface 69*b* and a guide surface 69*c*.

The guide surface 69*b* may be a portion that forms the second sheet conveying path PB.

The guide surface 69*c* may be a portion that forms a common conveying path PM' at which the second sheet conveying path PB and the manual sheet conveying path R2 meet and merge and that runs or extends substantially parallel with the conveying surface 82*a* of the conveyor belt 82 with a given gap. A downstream end of the conveying guide member 69A, which is illustrated as upwardly directing in FIG. 14, is extendedly formed toward the grip roller 81 and disposed in the vicinity of the grip roller 81.

A conveying guide member 76 is disposed, in FIG. 14, along the inner side of the curved manual sheet conveying path R2 ranging from the feed roller 63A via the pulley 84 of the belt-type conveying unit 800 to the pulley 83 of the belt-type conveying unit 800. The conveying guide member 76 may includes a guide surface 76*a* that may be a portion forming the manual sheet conveying path R2.

Figure 27:
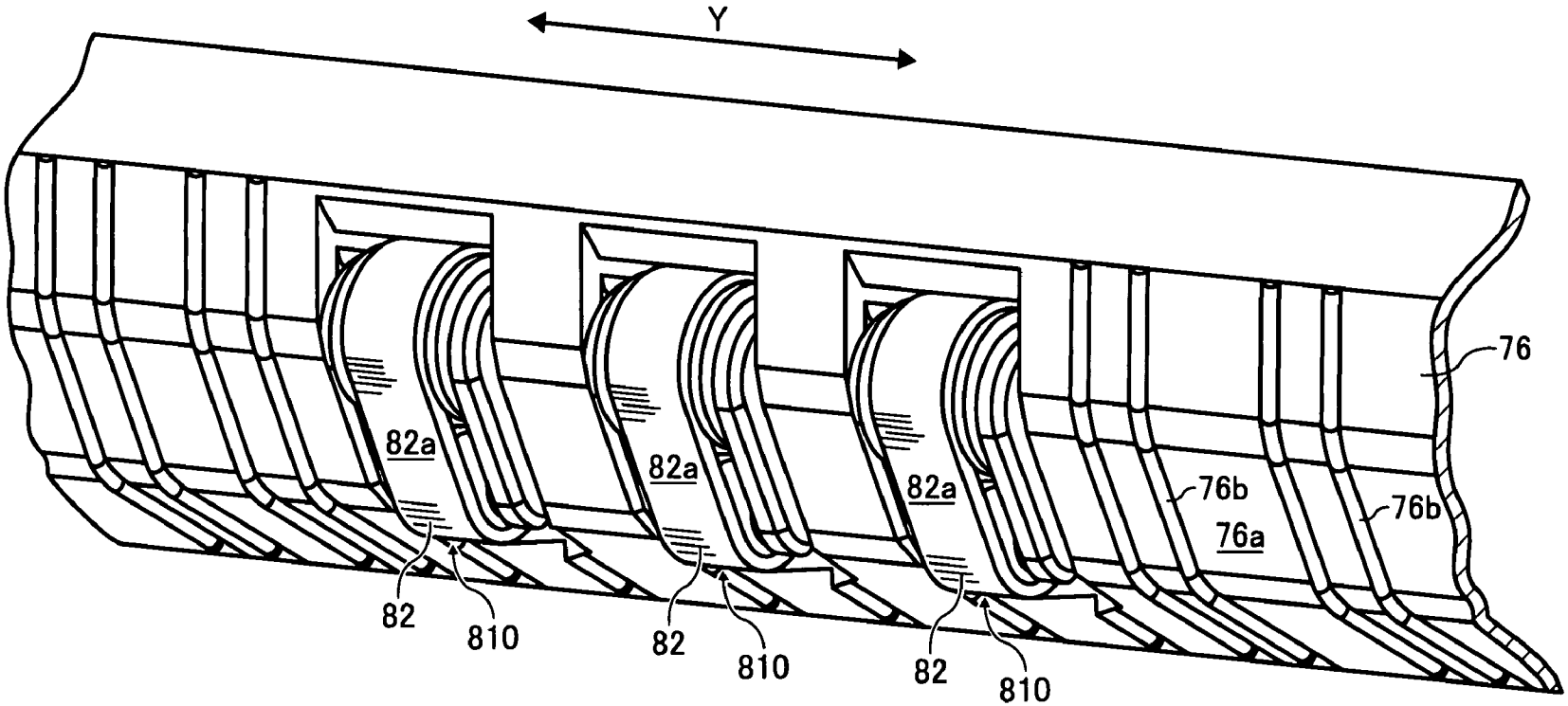
FIG. 27 is a perspective view of a belt unit of the sheet conveying device of FIG. 26.

The conveying guide member 76 shows its lower portion only in FIG. 14, and the detailed structure of the conveying guide member 76 is shown in FIG. 27.

The belt-type conveying unit 800 has a common structure to a belt-type conveying unit 810 as shown in FIG. 27. That is, the belt-type conveying unit 800 according to this example embodiment can be applied to and replaced with the conveying unit 810 shown in FIG. 27.

The conveying guide member 75 includes, in FIG. 14, a guide surface 75*a* and a guide surface 75*b*.

The guide surface 75*a* may be a portion that forms the second sheet conveying path PB with the guide surface 69*b* of the conveying guide member 69A opposite to the guide surface 75*a* in a substantially parallel manner. The guide surface 75*a* and the guide surface 69*b* forms the second sheet conveying path PB through which the sheet S transferred from the lower stage of the sheet feeding cassette 51, not shown in FIG. 14, is conveyed to the third conveying path PC via the conveying surface 82*a* of the conveyor belt 82.

The guide surface 75*b* may be a portion that forms the manual sheet conveying path R2 with the guide surface 76*a* of the conveying guide member 76 opposite to the guide surface 75*b* in a substantially parallel manner. The guide surface 75*b* and the guide surface 76*a* may form the manual sheet conveying path R2 through which the sheet S transferred from the manual sheet feeding tray 67 is conveyed.

The upper portion of the guide surface 75*b* is hidden by another member and is not shown in FIG. 14. Actually, the guide surface 75*b* extends in substantially parallel with the guide surface 76*a* to a position directly below the feed roller 63A (see FIG. 33A).

The belt-type conveying unit 800 according to this example embodiment is different from the belt-type conveying unit 8 according to the above-described example with reference to FIGS. 2 through 8A and 8B in the following points and subsequently described characteristics. That is, the belt-type conveying unit 800 according to this example embodiment includes multiple separate units (three in this example embodiment) discontinuously in a sheet width direction Y. In addition, a biasing method of the three belt-type conveying units 800 is different from that of the belt-type-conveying unit 8 according to the above-described example with reference to FIGS. 2 through 8A and 8B.

For example, the roller-type pulley 84 disposed on an upstream side in the sheet travel direction may be located at a position shown in FIG. 14 in a rotatable but not slidable manner. Alternatively, respective springs 77 (see FIG. 15) such as a coil spring or a leaf spring, each serving as a biasing member or an elastic member may be employed to bias the pulley shaft 84*a* of the pulley 84 at both ends thereof.

Figure 21A:
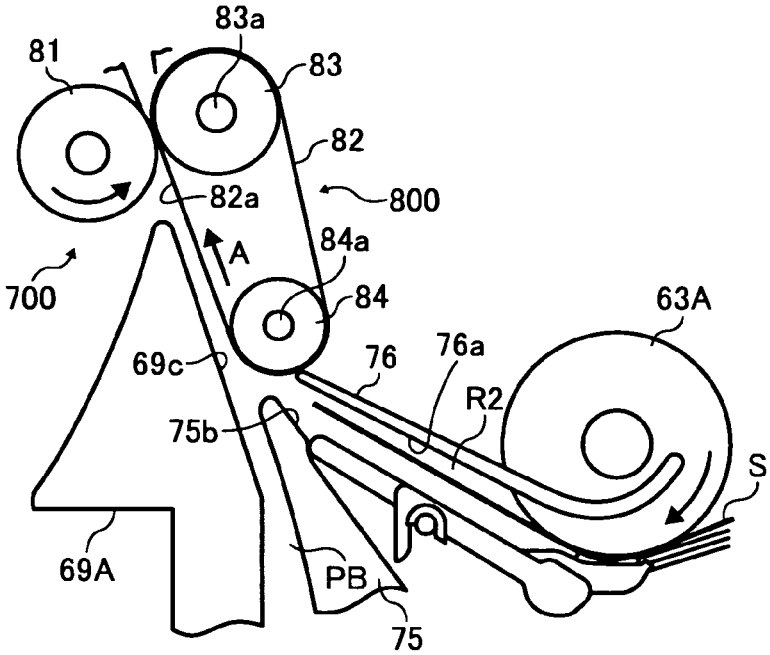
FIG. 21A is a drawing showing a step of a sheet transfer operation from a manual sheet feeding tray via the manual sheet feeding path to the second conveying unit.
Figure 21B:
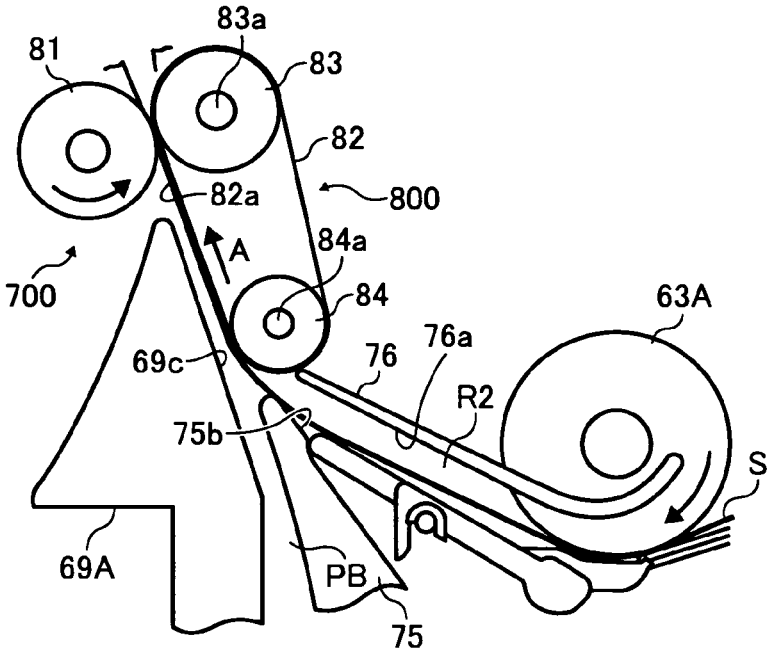
FIG. 21B is a drawing showing another step of the sheet transfer operation of FIG. 21A.

For example, with reference to FIGS. 21A and 21B, when the belt-type conveying units 800 are not held in contact with the sheet S, the biasing force or elastic force of the springs 77 may cause the pulley shaft 84*a* of the pulleys 84 disposed on the upstream side in the sheet travel direction to stay at the position shown in FIG. 21A. By contrast, when the sheet S is conveyed from the manual sheet feeding tray 67 and contact the surface of the conveyor belt 82 to apply a contact pressure greater than a given pressure via the conveyor belt 82 as shown in FIG. 21B, the pulleys 84 may move or retreat about the pulley shaft 83*a* in a diagonally upward right direction in FIG. 21B, against the biasing force of the springs 77.

The roller-type pulleys 83 may also be biased by a biasing force of bearing members, not shown, and biasing members, not shown, via the pulley shaft 83*a* in a direction to which a given amount of nip pressure is applied between the pulleys 83 and the corresponding grip rollers 81.

The conveyor belts 82 of the belt-type conveying units 800 respectively include the roller-type pulleys 83 with the pulley shaft 83*a* rotatably supported by the opening and closing guide 79A (see FIG. 14) and the roller-type pulleys 84 with the pulley shaft 84*a* also rotatably supported by the opening and closing guide 79A. That is, each of the conveyor belts 82 of the belt-type conveying units 800 is integrally and rotatably mounted with the pulleys 83 and 84.

Each of the belt-type conveying unit 800 includes components such as the conveyor belt 82, the roller-type pulleys 83 and 84, and the pulley shafts 83*a* and 84*a*, and the like. The materials of the components are same as those of the belt-type conveying unit 8 according to the above-described examples of the present patent application. Further, the distance, shape, and sizes of the pulley shafts 83*a* and 84*a* applying a given tension to the conveyor belt 82 are set appropriately according to the above-described example with reference to FIGS. 2 through 8A and 8B.

The roller-type pulley 84 spanning the conveyor belt 82 may be disposed toward or on the side of the feed roller 63A. The grip roller 81 may be connected to the sheet feeding motor 23 of the driving mechanism 22A via the above-described gear array to rotate in a counterclockwise or left-hand side direction in FIGS. 14, 21A, and 21B.

The roller-type pulley 83 may also wrap the conveyor belt 82 around the substantially part of the circumferential surface thereof. The conveyor belt 82 and the grip roller 81 may be disposed to contact with each other to form a nip contact. Therefore, the belt conveyor units 800 may rotate with the respective grip rollers 81 in a clockwise or right-hand direction, which is a direction indicated by arrow A in FIG. 14.

The guide surface 76*a* of the conveying guide member 76 may form the inner side of the manual sheet conveying path R2. The guide surface 76*a* may be disposed to have a specific positional relation with respect to the pulleys 83 and 84, the conveyor belt 82, and the feed roller 63A, as shown in FIG. 16 through 19.

Figure 16:
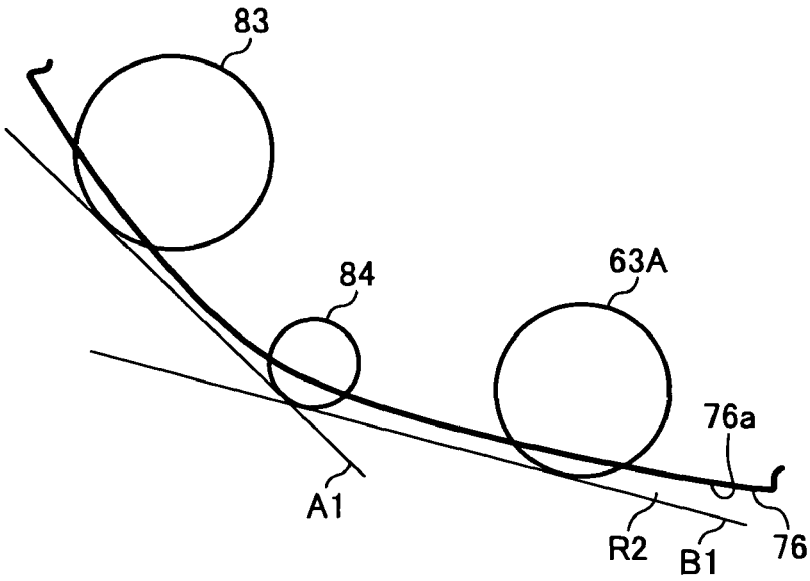
FIG. 16 is a drawing showing a positional relation of rollers in the sheet conveying device according to an example embodiment of the present patent application.

For example, as shown in FIG. 16, a line connecting a distal end of the pulley 83 and a distal end of the pulley 84, located on the center or outer side of the manual sheet conveying path R2, is defined as a tangent line A1 and a line connecting the distal end of the pulley 84 located on the center or outer side of the manual sheet conveying path R2 and a distal end of the feed roller 63A is defined as a tangent line B1. In such a case, it may be useful that the guide surface 76*a* forming the manual sheet conveying path R2 is more medially located than the tangent lines A1 and B1.

Figure 18:
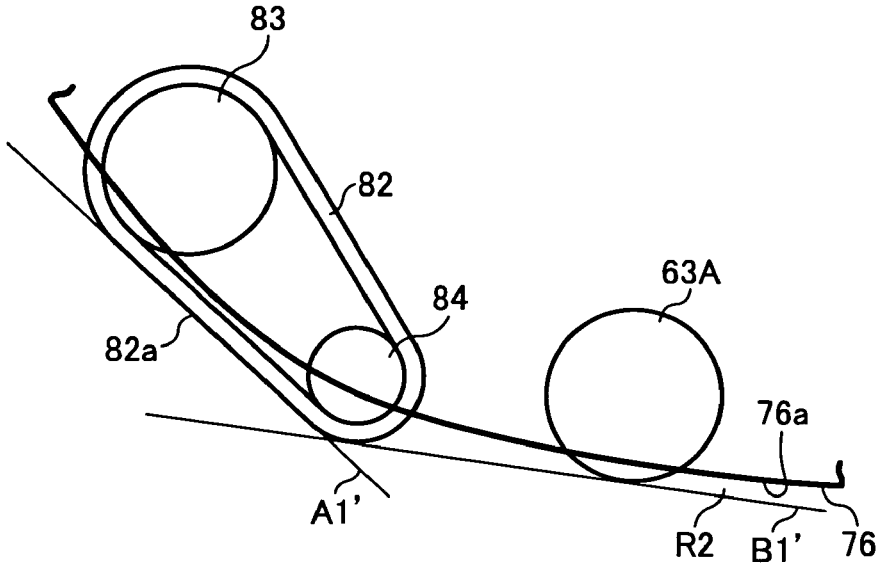
FIG. 18 is a drawing showing another positional relation of the rollers in the sheet conveying device according to an example embodiment of the present patent application.

Further, as shown in FIG. 18, a line connecting a point on a circumferential surface of the conveyor belt 82 substantially supported by the pulley 83 and another point of the circumferential surface of the conveyor belt 82 substantially supported by the pulley 84 is defined as a tangent line A1' and a line connecting the point of the circumferential surface of the conveyor belt 82 substantially supported by the pulley 84 and the distal end of the feed roller 63A is defined as a tangent line B1'. In such a case, it may also be useful that the guide surface 76*a* forming the manual sheet conveying path R2 is more medially located than the tangent lines A1' and B1'.

Further, as shown in FIG. 15, each of the belt-type conveying units 800 may cause the pulley 84 to be moved or displaced by the biasing force of the spring 77 toward the outer or center direction of the manual sheet conveying path R2. In such a case, as the tangent lines A1, A1', B1, and B1' are defined as described above, it may be advantageous that the maximum displacement position of the pulley 84, which corresponds to the maximum movement position to the inside of the guide surface 76*a*, is more medially located than the tangent lines A1, A1', B1, and B1'.

When the above-described conditions shown in FIGS. 16 and 18 are met, the pulley 84 or the circumferential surface of the conveyor belt 82 substantially supported by the pulley 84 may be disposed in a projecting manner from the guide surface 76*a* forming the manual sheet conveying path R2 outwardly, which is in a direction toward the center of the manual sheet conveying path R2.

Figure 20A:
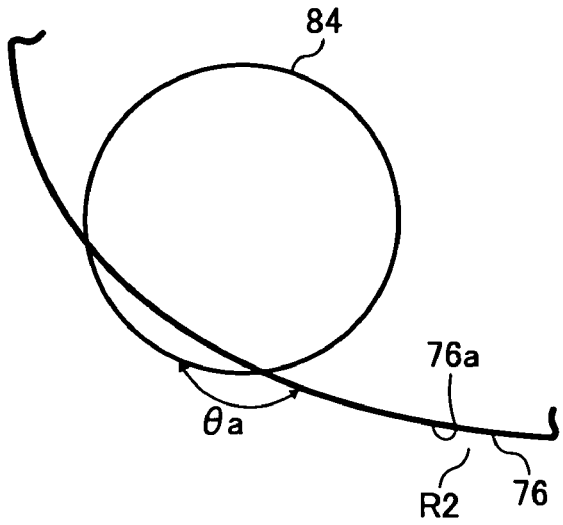
FIG. 20A is a drawing showing a desired angle between a point on a roller and a guide surface of a manual sheet conveying path in the sheet conveying device according to an example embodiment of the present patent application.
Figure 20B:
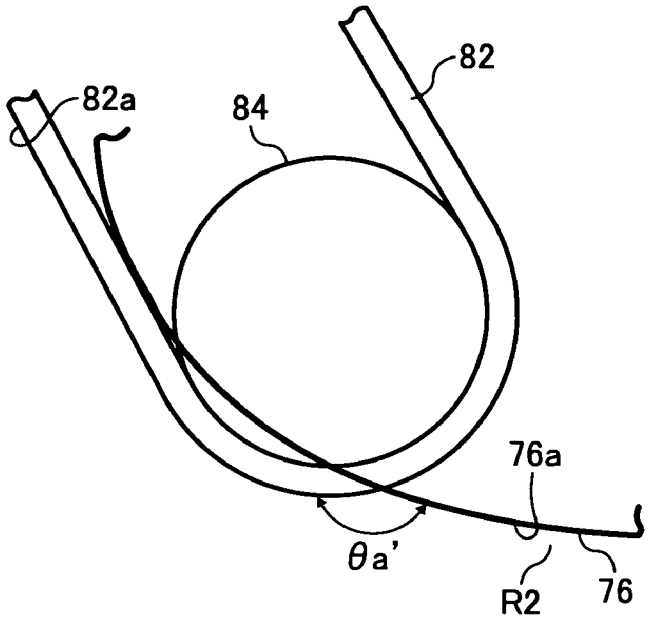
FIG. 20B is a drawing showing another desired angle between a surface of a conveyor belt and the guide surface of the manual sheet conveying path in the sheet conveying device according to an example embodiment of the present patent application.

At this time, as shown in FIG. 20A, a smaller angle between the distal end of the pulley 84 and the guide surface 76*a* forming the manual sheet conveying path R2 (or simply referred to as the "manual sheet conveying path R2") is defined as an angle θ*a*. In such a case, the pulley 84 and the guide surface 76*a* may be located to cause the angle θa to form an obtuse angle.

Further, as shown in FIG. 21B, another smaller angle between the point of the circumferential surface of the conveyor belt 82 substantially supported by the pulley 84 and the guide surface 76*a* forming the manual sheet conveying path R2 is defined as an angle θa'. In such a case, the circumferential surface of the conveyor belt 82 substantially supported by the pulley 84 and the guide surface 76*a* may be located to cause the angle θa' to form an obtuse angle.

Next, a description is given of a sheet transfer operation based on the above-described configuration, with reference to FIGS. 21A, 21B, 22A, 22B, and 22C. The sheet transfer operation may correspond to a transfer operation of the sheet S to travel from the manual sheet feeding tray 67 via the manual sheet conveying path R2 and pass the second conveying unit 700.

When a driving mechanism, not shown, drives the feed roller 63A, the sheet S placed on top of multiple sheets accumulated on the manual sheet feeding tray 67 may be separated by the feed roller 63A and the friction pad 68A (see FIG. 14). Then, as shown in FIG. 21A, the sheet S is guided by and conveyed through the manual sheet conveying path R2 formed by the guide surfaces 76*a* and 75*b*. At this time, the leading edge of the sheet S may be directed upward as shown in FIGS. 21A and 21B. However, the angle θa (see FIG. 20B) between the conveyor belt 82 and the manual sheet conveying path R2 is an obtuse angle and the conveyor belt 82 rotates in the downstream direction as indicated by arrow A. Therefore, even when the leading edge of the sheet S contacts or abuts against the circumferential surface or conveying surface 82*a* of the conveyor belt 82, the sheet S may be guided to the downstream direction without being bent or buckled. The above-described circumferential surface of the conveyor belt 82 is, in other words, a local part of the outer circumferential surface thereof disposed back on to the corresponding local part of the inner circumferential surface thereof contacting the pulley 84.

Then, the sheet S may be further conveyed to reach the guide surface 69*c* of the conveying guide member 69A. At this time, the conveying force of the feed roller 63A may cause the sheet S to move to an upward direction along a sloping surface of the guide surface 69*c*.

When the sheet S is a small or regular sheet, on reaching the guide surface 69*c* of the conveying guide member 69A, the direction of the leading edge of the sheet S may be changed to direct in an upward direction as shown in FIG. 21B, and be guided to the nip contact of the second conveying unit 700 along the guide surface 69*c*.

Further, the surface of the sheet S contacts the outer circumferential surface or the conveying surface 82*a* of the conveyor belt 82 so that the conveying force with respect to the sheet S can be supplied. However, when compared with a relatively rigid sheet S described below, the contact pressure to the outer circumferential surface or the conveying surface 82*a* of the conveyor belt 82 is smaller, and therefore, an amount of the supplemental conveying force with respect to the sheet S may be reduced.

Figure 22A:
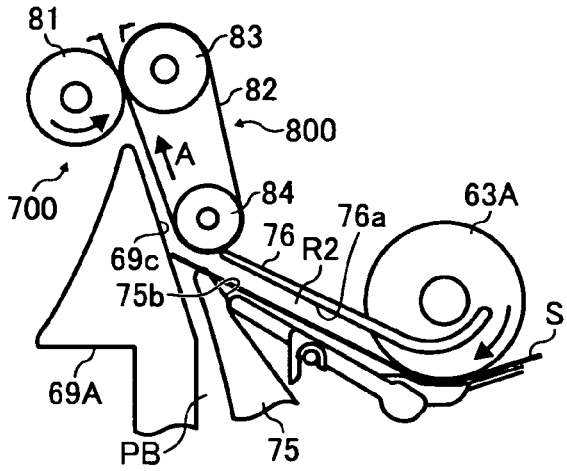
FIG. 22A is a drawing showing a progress of a sheet from a manual sheet feeding tray via the manual sheet feeding path to the second conveying unit according to an example embodiment of the present patent application.
Figure 22B:
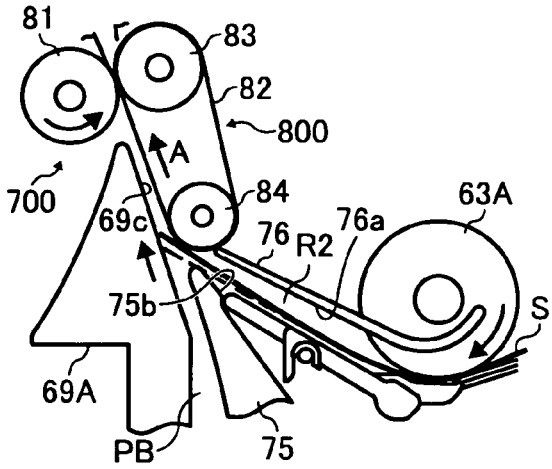
FIG. 22B is a drawing showing another progress of the sheet after FIG. 22A.

In a case in which the sheet S is a relatively rigid sheet such as a cardboard recording paper, when the leading edge of the sheet S reaches the guide surface 69*c* as shown in FIG. 22A, the leading edge of the sheet S may be guided upward along the guide surface 69*c*. At the same time, the sheet S on the partial area or entire area taking up a range in a downward direction from the nip contact formed between the feed roller 63A and the friction pad 68A may be changed to direct to the upward direction, as shown in FIG. 22B. Therefore, the surface of the sheet S contacts the local part of the inner circumferential surface of the conveyor belt 82, which is held in contact with the outer circumferential surface of the pulley 84. Accordingly, the conveyor belt 82 rotated with the grip roller 81 while contacting with the surface of the sheet S can transfer the sheet S to the downstream direction.

At this time, the manual sheet conveying path R2 has a positional relation with respect to the pulleys 83 and 84, the conveyor belt 82, and the feed roller 63A as shown in FIGS. 16 and 18. Therefore, the surface of the sheet S may contact the conveyor belt 82 without contacting the guide surface 76*a* in the manual sheet conveying path R2. This may reduce a conveyance load caused by contacting the surface of the sheet S with the guide surface 76*a* forming the manual sheet conveying path R2 and the conveying force of the conveyor belt 82 may be added to the conveying force of the feed roller 63A, thereby achieving a stable sheet conveyance.

In FIG. 22B, a solid line indicates the relatively rigid sheet S and a dotted line indicates the regular or small sheet S.

Figure 17:
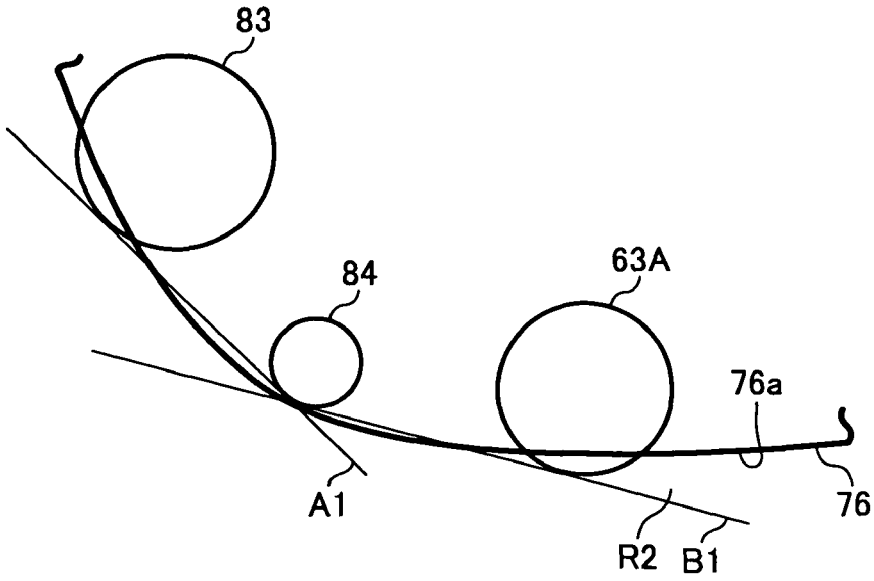
FIG. 17 is a drawing showing another positional relation of the rollers in the sheet conveying device according to an example embodiment of the present patent application.
Figure 19:
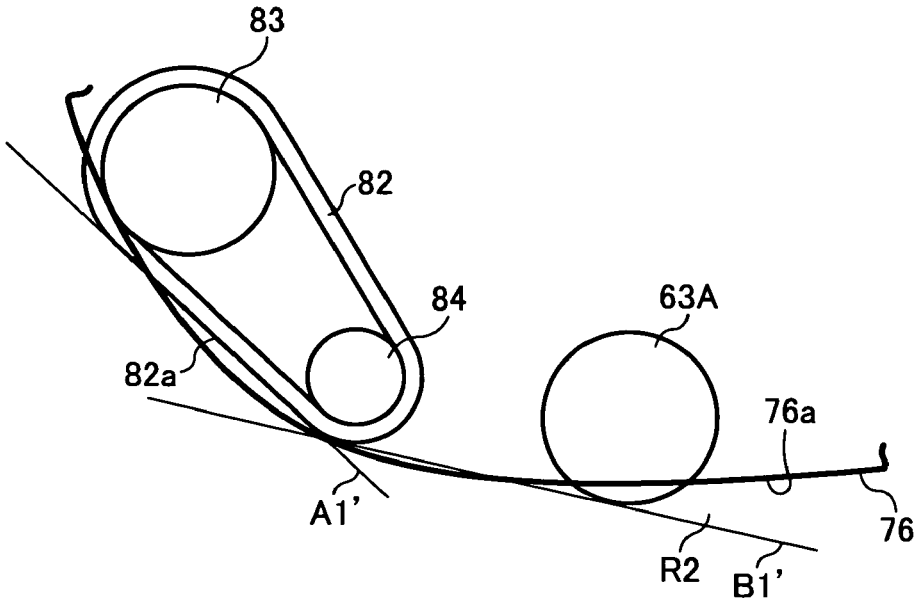
FIG. 19 is a drawing showing another positional relation of the rollers in the sheet conveying device according to an example embodiment of the present patent application.

By contrast, when the sheet S and the related rollers have a positional relation as shown in FIGS. 17 and 19, the surface of the sheet S may rustle or scrape the guide surface 76*a*, which may, as a result, cause damage to the surface of the sheet S.

Further, when the pulley 84 and the feed roller 63A have a relation shown in FIGS. 17 and 19, the surface of the sheet S may contact the guide surface 76*a* forming the manual sheet conveying path R2 during the sheet transfer shown in FIG. 22B. This may make it difficult to surely supply the conveying force of the conveyor belt 82.

Figure 22C:
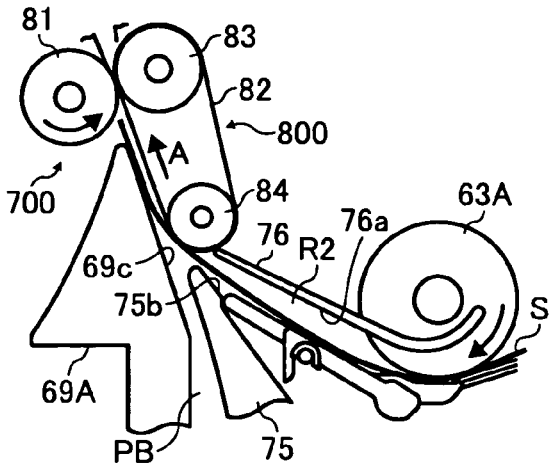
FIG. 22C is a drawing showing another progress of the sheet after FIG. 22B.

Furthermore, the leading edge of the sheet S may be guided to the nip contact of the second conveying unit 700, as shown in FIG. 22C, while receiving the supplemental conveying force of the conveyor belt 82.

Regarding the design of a sheet feeding device, when a sheet feeding device causes the grip roller 81, for example, to be disposed at a horizontal conveying part located immediately after a manual feed roller 63A, for example, the size of the sheet feeding device may increase. In order to achieve a smaller size or dimension, a sheet feeding device may generally cause the grip roller 81 to be disposed at a turn or curved section of a sheet conveying path after the horizontal conveying part.

There is a slight difference between the feed roller 63A and the grip roller 81 in a slip ratio of a sheet. That is, the relation of the sheet slip ratio may satisfy "grip roller<feed roller." Therefore, the sheet S may be pulled by the grip roller 81. This may cause the sheet S to rub or firmly touch the guide surface 76*a* of the conveying guide member 76 forming an upper part of the manual sheet conveying path R2, causing scratch and wrinkle on the sheet S. To avoid such damage, the sheet feeding device may further include a rotated roller with no motor at the center of the turn or curved section of the sheet conveying path. The rotated roller may be disposed at a position where the guide surface 76*a* does not project over a line connecting the distal end of the nip contact of the grip roller 81 and the tangent point or line of the rotated roller and the distal end of the feed roller 63A.

However, when a rotational resistance of the rotated roller increases with age, the rotated roller provided in a general sheet conveying device may rub the sheet S, thereby causing the above-described inconvenience.

By contrast, in the sheet conveying device 500 according to this example embodiment of the present patent application, the conveyor belt 82 is provided instead of the above-described rotated roller. Since the conveyor belt 82 constantly rotates with the grip roller 81 at a same revolution speed, the conveyor belt 82 may not rub the sheet S. In addition, while the above-described rotated roller includes a resin material with high hardness for the purpose of cost reduction, the conveyor belt 82 includes an elastic member, for example, of EP rubber, EPDM rubber, and so forth, which can avoid the above-described inconvenience. Further, since the conveyor belt 82 also serves as a rotated roller, the size of the sheet conveying device can be reduced.

In the above description, the belt-type conveying unit 800 is used in the manual sheet conveying path R2 formed by the manual sheet feeding tray 67. However, it is to be understood that the present patent application is not intended to be limited to this example embodiment. For example, similar to the belt-type conveying unit 8 employed to describe the above-described examples, the belt-type conveying unit 800 can be applied in the sheet feeding device 3, from the feed roller 63 of the first conveying unit 6 to the inner area of the first sheet conveying path PA of the second conveying unit 700 or to an inner area of a position to change the sheet conveying direction such as an inner area of such a position in the reverse conveying path R3 and an inner area of such a position in an automatic document feeder (ADF) or automatic reversing document feeder (ARDF).

Further, in the above description, the conveyor belt 82 is disposed in an oblique manner to the left side of FIG. 14. However, it is to be understood that the present patent application is not intended to be limited to this example embodiment. For example, the conveyor belt 82 can be disposed in a substantially vertically upward direction as described in the examples with reference to FIGS. 2 through 8A and 8B and FIGS. 10 through 13. By so doing, the angle of approach from the pulley 84 supporting the conveyor belt 82 to the guide surface 69*c* may be sharp. Therefore, the conveyor belt 82 may further be sure to contact the surface of the sheet S. In this case, it may be advantageous that the manual sheet conveying path R2 has the positional relation as shown in FIGS. 16 and 18, with respect to the pulleys 83 and 84, the conveyor belt 82, and the feed roller 63A.

In FIG. 14, the opening and closing guide 79A is further provided to a part of the sheet conveying device 500 or the main body 2 of the copier 1. The opening and closing guide 79A can be opened and closed with respect to the sheet conveying device 500 and/or the main body 2 of the copier 1. The functions of the opening and closing guide 79A are substantially same as the functions of the opening and closing guide 79 according to the above-described examples with reference to FIGS. 2 through 8A and 8B and FIGS. 10 through 13.

The configuration of a belt conveying unit is not limited to the above-described belt-type conveying unit 800. For example, the present patent application is applicable to the belt-type conveying unit 8 according to the above-described examples with reference to FIGS. 2 through 8A and 8B and FIGS. 10 through 13 of the present patent application or the belt-type conveying unit 810 (to be described later) according to an example embodiment of the present patent application.

Figure 24B:
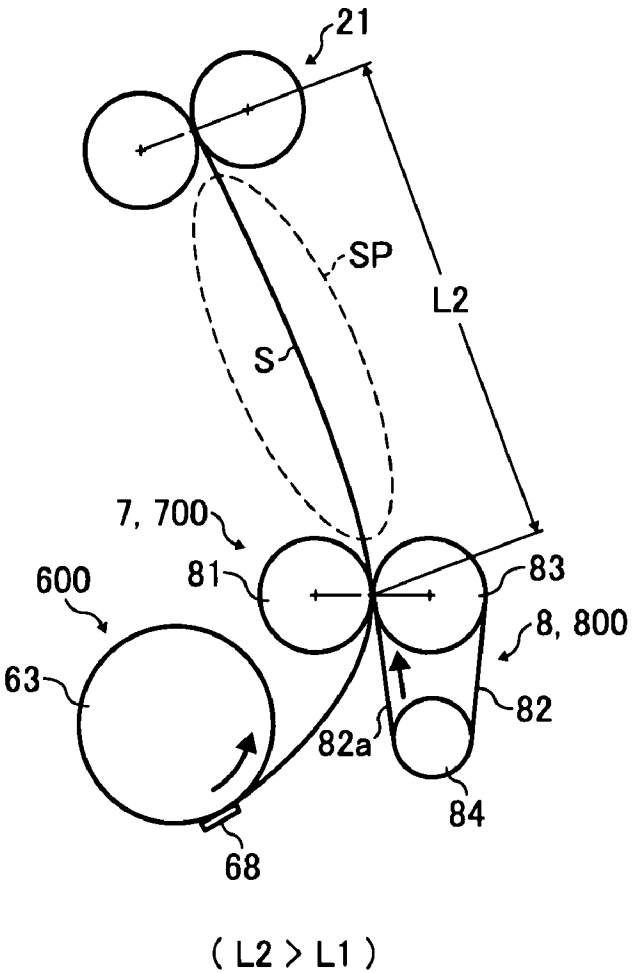
FIG. 24B is a drawing showing another state of the sheet conveying path from a first conveying unit to a pair of registration rollers of the sheet conveying device of FIG. 23.
Figure 24A:
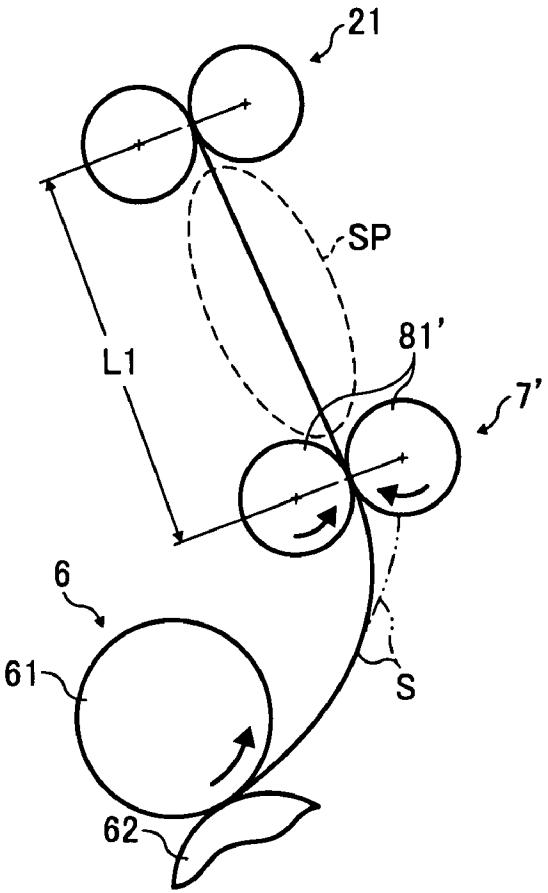
FIG. 24A is a drawing showing a state of a sheet conveying path from a first conveying unit to a pair of registration rollers of the sheet conveying device of FIG. 23.

Next, referring now to FIGS. 23, 24A, and 24B, schematic configurations of a sheet conveying device 510 are described, according to an example embodiment of the present patent application.

As previously described, elements having the same functions and shapes are denoted by the same reference numerals throughout the specification and redundant descriptions are omitted.

The sheet conveying device 510 is primarily different from the sheet conveying device 5 shown in FIGS. 2 through 8A and 8B in the following points and subsequently described characteristics.

Instead of the sheet conveying device 5 including the first conveying unit 6 and the second conveying unit 7' on the upper side, and the first conveying unit 6 and the second conveying unit 7 on the lower side in the sheet feeding device 3, the sheet conveying device 510 of this example embodiment includes a first conveying unit 600 and the second conveying unit 7 on the upper side and a first conveying unit 600 and the second conveying unit 7' on the lower side in the sheet feeding device 3.

Specifically, the sheet conveying device 510 of this example embodiment with reference to FIGS. 23, 24A, and 24B is primarily different from the sheet conveying device 5 of the above-described example with reference to FIGS. 2 through 8A and 8B in the following points and subsequently described characteristics.

In addition, as previously described, the sheet conveying device 500 according to this example embodiment is different from a sheet conveying device 510 (see FIG. 23) according to another example embodiment in the following points and subsequently described characteristics.

Different from the sheet conveying device 500 according to an example embodiment shown in FIGS. 14 and 15, the sheet conveying device 510 according to this example embodiment shown in FIG. 23 includes the first conveying unit 6A on the upper stage of the sheet feeding device 3 shown in FIG. 23. Further, the sheet conveying device 510 according to this example embodiment shown in FIG. 23 includes the driving mechanism 22 while the sheet conveying device 500 according to this example embodiment shown in FIGS. 14 and 15 includes a driving mechanism 22A.

The sheet conveying device 510 employs the first conveying unit 600 performing a sheet separation method with a friction pad to separate sheets accommodated in the upper and lower sheet feeding cassettes in the sheet feeding device 3, while the sheet conveying device 5 employs the FRR sheet separation method. This change has reduced the space shown in FIG. 23 in the horizontal direction or width direction of the sheet feeding device 3, not shown.

The location of the belt-type conveying unit 8 serving as a belt-type sheet conveying unit of the second conveying unit 7 has changed from the lower sheet feeding cassette 51 to the upper sheet feeding cassette 51. The entire position of the belt-type conveying unit 8 (especially, the conveying surface 82*a* of the conveyor belt 82) is rearranged so as to convey the sheet S in a left oblique direction, at a position closer to the first conveying unit 600.

According to the above-described change of the belt-type conveying unit 8, the third conveying path PC, which is a sheet conveying path, from the second conveying unit 7 including the belt-type conveying unit 8 to the pair of registration rollers 21 has shifted to the left side in FIGS. 23 and 24B. Therefore, a fourth conveying path PD serving as a common conveying path that meets and merges with the reverse conveying path R3 of the sheet reversing device 42 is shifted to the left side in FIGS. 23 and 24B.

The sheet conveying device 510 of this example embodiment of the present patent application has similar structure and functions to the sheet conveying device 5 of the above-described example with reference to FIGS. 2 through 8A and 8B, except the above-described structure.

Regarding a sheet separation mechanism, the feed roller 61 and the reverse roller 62 shown in FIGS. 2, 24A, and 36 are removed and a sheet separation mechanism using friction pads is employed for the upper and lower sheet feeding cassettes 51. As shown in FIGS. 20 and 21B, the friction pad sheet separation mechanism for each of the upper and lower sheet feeding cassettes 51 includes a feed roller 63, a friction pad 68, and a spring (compression spring) 68B.

The feed roller 63 serves as a rotary sheet feeding member and a first opposed transfer member, and is rotatably supported via a shaft 63*a* in a sheet feeding direction.

The friction pad 68 serves as a frictionally resisting member to abut against the feed roller 63. The friction pad 68 is also referred to as a separation pad.

The spring 68B serves as a biasing or pressing member to press the friction pad 68 to the feed roller 63. The spring 68B may be a compression spring.

The sheet separation mechanism using a friction pad or the friction pad sheet separation mechanism separates a sheet S, which is placed on top of a stack of sheets in the sheet feeding cassette 51, one by one from the other sheets therein and feed the separated sheet by actions of the feed roller 63 in rotation and the friction pad 68.

That is, in the friction pad sheet separation mechanism, the spring 68B may provide a separation force via a slider, not shown, to the friction pad 68 that abuts against the feed roller 63 at a given separation angle. This abutment of the friction pad 68 against the feed roller 63 may form a nip contact therebetween, so that the sheet S can pass the nip contact when the sheet S is conveyed. Therefore, when two or more sheets are picked up at the same time, the picked-up sheets other than a top sheet may receive the resistance from the friction pad 68 greater than the resistance from the friction with the other picked-up sheets. This can prevent the movement of the picked-up sheets beyond the nip contact.

On the other hand, the top sheet may receive the resistance from the feed roller 63 greater than the resistance from the other picked-up sheets and the resistance from the friction pad 68. Accordingly, only the top sheet can be conveyed in the sheet conveying direction.

When the FRR sheet separation mechanism is employed as shown in the sheet conveying device 5 in FIGS. 2 and 23, the reverse roller or separation roller 62 is provided for separating and feeding a sheet one by one to the downstream side of the pickup roller 60. Therefore, the space in the sheet conveying device 5 increases in the width direction or the horizontal direction in FIGS. 2 and 23.

By contrast, when the friction pad sheet separation mechanism using the friction pad 68 is employed as shown in the sheet conveying device 510 in FIGS. 23 and 24B, the reverse roller 62 may not be necessarily provided and can be removed. Therefore, the space in the sheet conveying device 510 may not increase in the width direction or the horizontal direction and the sheet conveying device 510 can reduce the size.

However, when compared to the FRR sheet separation mechanism, the conveying force of the friction pad sheet separation mechanism may be smaller. In addition, the conveying path from the feed roller 63 to the grip roller 81 is shorter, a relatively rigid sheet such as a cardboard recording paper can be stopped before the grip roller 61.

Further, in the friction pad sheet separating mechanism, the locations of the feed roller 63, the friction pad 68, and a base plate, not shown, are designed so that the feed roller 63 can contact the top sheet S and the friction pad 68 at respective points J and K on the outer circumferential surface of the feed roller 63 as shown in FIG. 23, for example. The points J and K are spaced apart by a given angle of the center angle of the feed roller 63. As shown in FIG. 23, a cassette type sheet feeding unit such as the sheet feeding cassette 51, in which the base plate thereof moves in an obliquely upward direction with respect to the horizontal surface of the sheet conveying device 510 and a large amount of sheets, such as some hundreds of sheets, are loaded therein. When such a cassette type sheet feeding unit is used, the leading edge of the top sheet S on the base plate moving obliquely upward and the outer circumferential surface of the feed roller 63 may contact. As a result, the sheet feeding property may deteriorate and the number of sheets to be loaded in the sheet feeding cassette 51 may be limited.

The above-described effect of action by the sheet separation mechanism with friction pads is also applicable to the example embodiment with reference to FIGS. 14 through 22C of the present patent application.

In FIG. 23, the sheet conveying device 510 includes a conveying guide member 74 as well as the conveying guide members 69 and 75.

The conveying guide member 69 may be disposed at a position to provide the outer side of the first sheet conveying path PA. The conveying guide member 69 includes guide surfaces 69*a*, 69*b*, and 69*c*. The guide surface 69*a* may be provided to guide the sheet S conveyed by the first conveying unit 600 to the conveying surface 82*a* of the conveyor belt 82 at the downstream side of the first conveying unit 600. The guide surface 69*b* may be provided to form the second sheet conveying path PB. The guide surface 69*c* may be disposed spaced apart from the conveying surface 82*a* of the conveyor belt 82 in a substantially parallel manner.

The conveying guide member 74 may be disposed at a position to provide the inner side of the first sheet conveying path PA. The conveying guide member 74 includes a guide surface 74*a* that is disposed facing the guide surface 69*a* of the conveying guide member 69 with a given interval. The guide surface 74*a* of the conveying guide member 74 may be provided as a curved surface protruding in a substantially downward direction toward the conveying guide member 69 across a line connecting the nip contact in the first conveying unit 600 and the nip contact in the second conveying unit 7. The degree of protrusion or curvature of the curved surface 74*a* is determined so that the leading edge of the sheet S can surely reach the conveying surface 82*a* of the conveyor belt 82.

The conveying guide member 75 may be disposed facing the conveying guide member 69 to form the second sheet conveying path PB. The conveying guide member 75 includes a guide surface 75*a* that is provided to form the second sheet conveying path PB to convey the sheet S conveyed from the lower sheet feeding cassette 51 to the third conveying path PC via the conveying surface 82*a* of the conveyor belt 82.

As shown in FIG. 23, the conveying surface 82*a* of the conveyor belt 82 in the belt-type conveying unit 8 may be disposed along the outer side of the merged portion serving as a common conveying path, which is located before or at the upstream side of the second conveying unit 7 at which the first sheet conveying path PA and the second sheet conveying path PB meet and merge. This configuration corresponds to the configuration previously described in the example with reference to FIGS. 10 through 12.

Further, similar to the belt-type conveying unit 8 in the above-described examples with reference to FIGS. 2 through 8A and 8B and FIGS. 10 through 12, the belt-type conveying unit 8 is disposed to contact the conveying surface 82*a* of the conveyor belt 82, except the portions where the leading edge of the sheet S is held by the pulleys 83 and 84.

When dropping a perpendicular line from the lower end of the conveying guide member 69 in a vertical direction, the belt-type conveying unit 8 may be disposed in an inclined or slanted manner so that the nip section or nip contact in the second conveying unit 7 can be positioned on the left side of the perpendicular line. In this case, when the conveying guide member 69 has the same shape as the conveying guide member 69 provided to the above-described examples with reference to FIGS. 2 through 8A and 8B and FIGS. 10 through 12, a collision angle θ, not shown, of the leading edge of the sheet S may become closer to a right angle with respect to the inclined conveying surface 82*a* of the conveyor belt 82. Therefore, similar to the above-described examples with reference to FIGS. 2 through 8A and 8B and FIGS. 10 through 12, the shape of the conveying guide member 69 in this example embodiment has been changed so that the collision angle θ of the leading edge of the sheet S with respect to the inclined conveying surface 82*a* of the conveyor belt 82 may be arranged to form an acute angle.

An opening and closing guide 79B is attached to the sheet conveying device 510 and the copier 1 so as to freely open and close with respect to a part of the main body of the sheet conveying device 510 and the main body of the copier 1. The opening and closing guide 79B shown in FIG. 23 has the substantially same function as the opening and closing guide 79 described in the above-described examples with reference to FIGS. 2 through 8A and 8B and FIGS. 10 through 13.

As described above, this example embodiment with reference to FIGS. 23, 24A, and 24B applies the above-described belt-type conveying unit 8. However, the belt-type conveying unit 800 of the above-described example embodiment with reference to FIGS. 14 through 22C can also be applied, for example, as an alternative to the above-described belt-type conveying unit 8. Therefore, both reference numerals "8" and "800" are shown in FIGS. 23 and 24B. As a matter of course, reference numerals "7" and "700" are also shown in FIGS. 23 and 24B. Further, the belt-type conveying unit 810, which will be described later with reference to FIGS. 27 through 30, can also be applied.

Further, by inclining the belt-type conveying unit 8 or 800 to the left side of the sheet conveying device 510 and consequently shifting the third conveying path PC to the left side of the sheet conveying device 510 in FIG. 23, the fourth conveying path PD serving as the common conveying path merging the reverse conveying path R3 of the sheet reversing device 42 is also shifted to the left side thereof in FIG. 23.

However, the present patent application can apply a configuration in which the sheet reversing device 42 is not included. That is, such a device may not be necessarily provided. Accordingly, a further description of the above-described configuration is omitted.

According to this example embodiment with reference to FIGS. 23 and 24B, the belt-type conveying unit 8 or 800 may be disposed so that the sheet S can be fed from the upper sheet feeding cassette 51, the conveying surface 82*a* of the conveyor belt 82 may be disposed in a left oblique direction, and the second conveying unit 7 including the grip roller 81 and the belt-type conveying unit 8 may be shifted toward the first conveying unit 600 (to the left-sided direction in FIGS. 23 and 24B). Therefore, a distance L2 ranging from the nip contact between the grip roller 81 and the belt-type conveying unit 8 of the second conveying unit 7 to the nip contact of the pair of registration rollers 21 can be formed longer than a distance L1 ranging from a nip contact of a pair of grip rollers 81' in the sheet conveying unit 7' to the nip contact of the pair of registration rollers 21 shown in FIG. 24A. Therefore, the distance L2 ranging from the nip contact between the grip roller 81 and the belt-type conveying unit 8 of the second conveying unit 7 to the nip contact of the pair of registration rollers 21 can be formed longer than the distance L1 ranging from a nip contact of a pair of grip rollers 81' in the sheet conveying unit 7' to the nip contact of the pair of registration rollers 21 shown in FIG. 24A. Therefore, a space SP for forming a given amount of bend at the leading edge of the sheet S may be increased at the third conveying path PC arranged before the pair of registration rollers 21, as shown in FIGS. 24A and 24B. As a result, skew and/or other defects can be surely corrected.

Further, by disposing the conveying surface 82*a* of the conveyor belt 82 in a diagonally downward left direction, the curvature radius from the feed roller 63 to the second conveying unit 7 or 700 may become smaller. In addition, the conveyor belt 82 may cause the leading edge of various types of the sheets S to surely be directed and guided to the nip contact of the second conveying unit 7 or 700.

Further, by inclining the belt-type conveying unit 8 or 800 to the left side of the sheet conveying device 510 and consequently shifting the third conveying path PC to the left side of the sheet conveying device 510 in FIG. 23, the third conveying path PC or the fourth conveying path PD may be moved. That is, when compared with the above-described examples with reference to FIGS. 2 through 8A and 8B and FIGS. 10 through 12, a greater space can be obtained on the right side of the third conveying path PC or the fourth conveying path PD serving as the common conveying path merging the reverse conveying path R3 of the sheet reversing device 42 can be shifted to the left side thereof in FIG. 23. As a result, the size of the sheet conveying device 510 can be reduced in the width direction thereof.

Further, as described above, the conveyor belt 82 of the belt-type conveying unit 8 or 800 of the sheet conveying devices 5, 5A, 5B, 500, and 510 described with reference to FIGS. 2 through 8A and 8B, FIGS. 10 through 12, FIG. 13, FIGS. 14 through 22, and FIG. 23 may have a width in the sheet width direction "Y" that is at least substantially equal to the width of a maximum-size sheet to be conveyed. That is, the belt width of the conveyor belt 82 continuously extends across the entire width of the sheet, so as to be at least substantially equal to or greater than the width of a maximum-size sheet to be conveyed. The sizes in the sheet width direction or axial lengthwise direction of the pulleys 83 and 84 around which the conveyor belt 82 is stretched and the grip roller 81 facing and contacting the conveyor belt 82 are continuously formed to be equal to or larger than the above-described belt width of the conveyor belt 82. Hence, it is ensured that the entire width of the sheet S sent out from the first conveying unit 6 contacts the conveyor belt 82, so that the contact area therebetween can be increased. Accordingly, it is possible to increase the conveying and propelling force for conveying the sheet S in conveying direction. The conveying and propelling force may constantly be transmitted to the sheet S from the conveyor belt 82 moving in the sheet conveying direction.

Next, referring to FIGS. 25 through 33, schematic configurations of a copier 1A including a sheet conveying device 520 are described, according to an example embodiment of the present patent application.

As previously described, elements having the same functions and shapes are denoted by the same reference numerals throughout the specification and redundant descriptions are omitted.

Figure 32A:
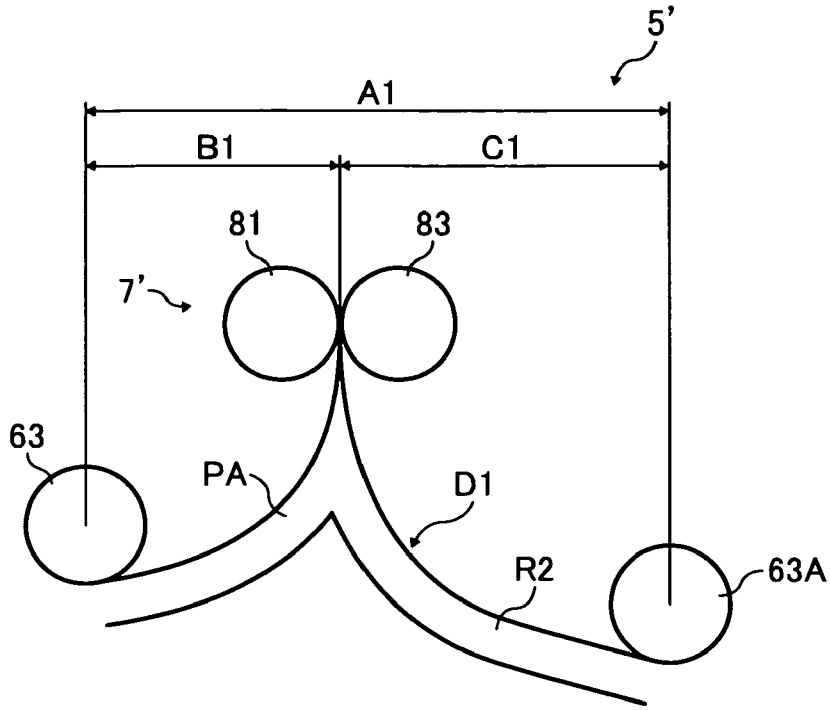
FIG. 32A is a drawing of a conceptual model to explain a position of the rollers of the second conveying unit according to an example embodiment of the present patent application.
Figure 32B:
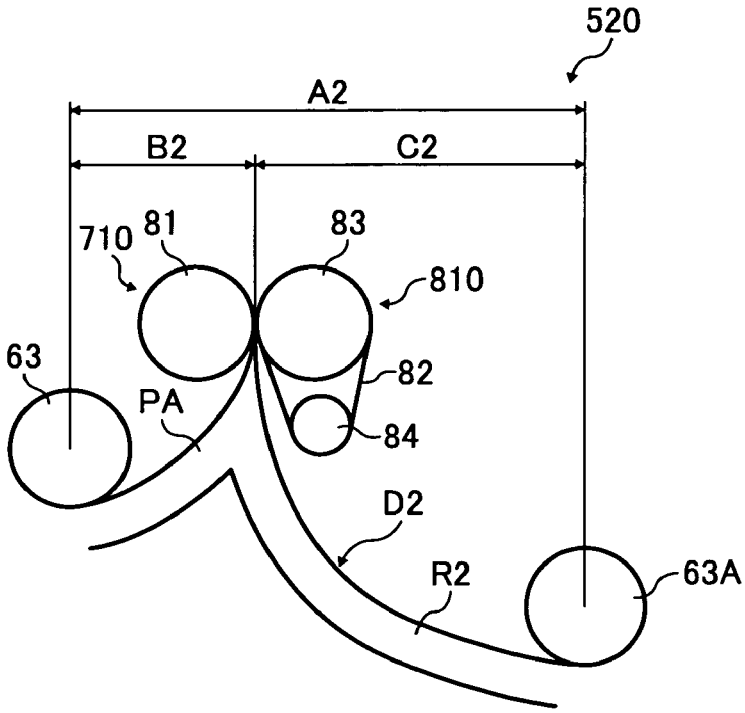
FIG. 32B is a drawing of a conceptual model to explain a positional difference from the position shown in the drawing of FIG. 32A.

First, with reference to FIGS. 32A and 32B, differences of basic layouts in respective structures of two different sheet conveying devices are described. FIG. 32A shows a structure of the sheet conveying device 5' as an example, and FIG. 32B shows a structure of the sheet conveying device 520 of the present patent application. The structures of the sheet conveying devices 5' and 520 shown in FIGS. 32A and 32B are conceptual models to explain the positional difference between the rollers of the second conveying units.

It is noted that the left and right direction in FIGS. 32A and 32B corresponds to the width direction of the main body of each of the sheet conveying device 5' and the sheet conveying device 520.

Each of the sheet conveying devices 5' and 520 in FIGS. 32A and 32B may include the first sheet conveying path PA that serves as the first conveying path through which the sheet S is conveyed and the manual sheet conveying path R2 that serves as a second conveying path facing the first sheet conveying path PA, through which the sheet S is also conveyed. Hereinafter, the first sheet conveying path PA is also referred to as a "left conveying path" in FIGS. 32A and 32B and the manual sheet conveying path R2 is also referred to as a "right conveying path" in FIGS. 32A and 32B. By causing the left and right conveying paths to merge before the second conveying unit 7' or 710, the left and right conveying paths may meet and merge to form a merged portion or a common conveying path.

FIG. 32A shows the positions of the rollers in the second conveying unit 7' including the grip roller 81 and the roller-type pulley 83, also a rotated roller 83, disposed facing the grip roller 81. FIG. 32B shows the positions of the rollers in the second conveying unit 710 including the grip roller 81 and the belt-type conveying unit 810.

In the second conveying unit 7' shown in FIG. 32A, "B1" represents a distance in the horizontal direction between the center of axis of the feed roller 63 in the left conveying path and the center of nip contact between the grip roller 81 and the rotated roller 83, "C1" represents a distance in the horizontal direction between the center of axis of the feed roller 63A in the right conveying path and the center of nip contact between the grip roller 81 and the rotated roller 83, "A1" represents an axial distance in the horizontal direction between the feed roller 63 in the left conveying path and the feed roller 63A in the right conveying path, and "D1" represents a curvature radius of the manual sheet conveying path R2 or the right conveying path.

For example, in the second conveying unit 7', the meter basis weight of the sheet S to pass through the right conveying path or the manual sheet conveying path R2 is greater than the meter basis weight of the sheet S to pass through the left conveying path or the first sheet conveying path PA. Therefore, the curvature radius of the right conveying path is caused to be greater than a curvature radius of the left conveying path.

By contrast, in the second conveying unit 7 shown in FIG. 32B, "B2" represents a distance in the horizontal direction between the center of axis of the feed roller 63 in the left conveying path and the center of nip contact between the grip roller 81 and the rotated roller 83 of each of the belt-type conveying units 810, "C2" represents a distance in the horizontal direction between the center of axis of the feed roller 63A in the right conveying path and the center of nip contact between the grip roller 81 and the rotated roller 83 of each of the belt-type conveying unit 810, "A2" represents an axial distance in the horizontal direction between the feed roller 63 in the left conveying path and the feed roller 63A in the right conveying path, and "D2" represents a curvature radius of the manual sheet conveying path R2 or the right conveying path.

For example, similar to the above-described example embodiment with reference to FIGS. 23 through 24B, in the second conveying unit 7, the belt-type conveying unit 810 is disposed at a position corresponding to the outer area of the left conveying path or the first sheet conveying path PA. In other words, the belt-type conveying unit 810 is disposed in an outer area of the merged portion or the common conveying path with respect to the left conveying path and in an inner area of the merged portion or the common conveying path with respect to the right conveying path. Therefore, various types of sheets can be conveyed even when the curvature radius of the left conveying path is reduced. As a result, the distance B2 in FIG. 32B may be set smaller than the distance B1 shown in FIG. 32A.

By reducing the distance in the horizontal direction between the center of axis of the feed roller 63 in the left conveying path and the center of nip contact between the grip roller 81 and the rotated roller 83 from the distance B1 to the distance B2, the distance A2 shown in FIG. 32B may also be set smaller than the distance A1 in FIG. 32A. Alternatively, the distance A2 in FIG. 32B may be set same as the distance A1 in FIG. 32A. When the distance A2 is set equal to the distance A1, the curvature radius D2 along the right conveying path in FIG. 32B can be set greater than the curvature radius D1 along the right conveying path in FIG. 32A, thereby conveying the sheet S in a further stable manner.

Further, as described in the above-described example embodiment with reference to FIGS. 14 through 22C, the belt-type conveying unit 800 is disposed at the position corresponding to the inner area of the right conveying path. Therefore, compared to the second conveying unit 7' shown in FIG. 32A, various types of sheets can be conveyed even when the curvature radius D2 along the right conveying path is small.

Accordingly, the curvature radius D2 along the right conveying path in FIG. 32B can be formed smaller than the curvature radius D1 along the right conveying path in FIG. 32A. As a result, the distance C2 in FIG. 32B may be set smaller than the distance C1 in FIG. 32A.

As described above, by disposing the belt-type conveying units 810 to the second conveying unit 7 where the left and right conveying paths meet, the size of a sheet conveying device can be reduced and various types of sheets can be transferred from the left and right conveying paths. Alternatively, even when the width size of the sheet conveying device 520 is same as the sheet conveying device 5', the curvature radius of either one of the left and right conveying paths may be formed greater than the other, thereby conveying various types of sheets in a further stable manner.

Next, detailed descriptions are given of the configuration shown in FIG. 32B of the sheet conveying device 520 and the copier 1A including the sheet conveying device 520 according to an example embodiment, with reference to FIGS. 25 through 31, and 33.

The copier 1A including the sheet conveying device 520 according to this example embodiment is primarily different from the copier 1 shown in FIGS. 2 through 8A and 8B according to the above-described example with reference to FIGS. 2 through 8A and 8B in the following points and subsequently described characteristics.

Instead of the sheet conveying device 5 including the first conveying unit 6 and the second conveying unit 7' on the upper side and the first conveying unit 6 and the second conveying unit 7 on the lower side in the sheet feeding device 3, the sheet conveying device 520 of this example embodiment with reference to FIGS. 25 through 33 includes the first conveying unit 600 and the second conveying unit 710 on the upper side, the first conveying unit 600 and the second conveying unit 7' on the lower side, and the manual sheet feeding device and the like in the sheet feeding device 3.

For example, the sheet conveying device 520 of this example embodiment shown in FIGS. 25 through 33 is primarily different from the sheet conveying device 5 of the example shown in FIGS. 2 through 8A and 8B in the following points and subsequently described characteristics.

The sheet conveying device 520 of this example embodiment shown in FIGS. 25 through 33 employs the first conveying unit 600 performing a sheet separation method with a friction pad to separate sheets accommodated in the upper and lower sheet feeding cassettes 51, while the sheet conveying device 5 of the example shown in FIGS. 2 through 8A and 8B employs the FRR sheet separation method. This change has reduced the space in the horizontal direction or width direction of the sheet feeding device 3 in FIG. 2.

The manual sheet feeding tray 67 serving as a manual sheet feeding device has also used the friction pad sheet separation mechanism. This change has shifted the location of the manual sheet feeding tray 67 to the left side of the sheet feeding device 3 in FIG. 2.

The sheet conveying device 520 employs the belt-type conveying unit 810 in the second conveying unit 7 for the sheet feeding cassette 51 of the upper stage, while the sheet conveying device 5 employs the belt-type conveying unit 8 provided to the second conveying unit 7.

The entire position of the belt-type conveying unit 810 (especially, the conveying surface 82*a* of the conveyor belt 82) is rearranged so as to convey the sheet S in a left oblique direction, at a position closer to the first conveying unit 600.

Figure 25:
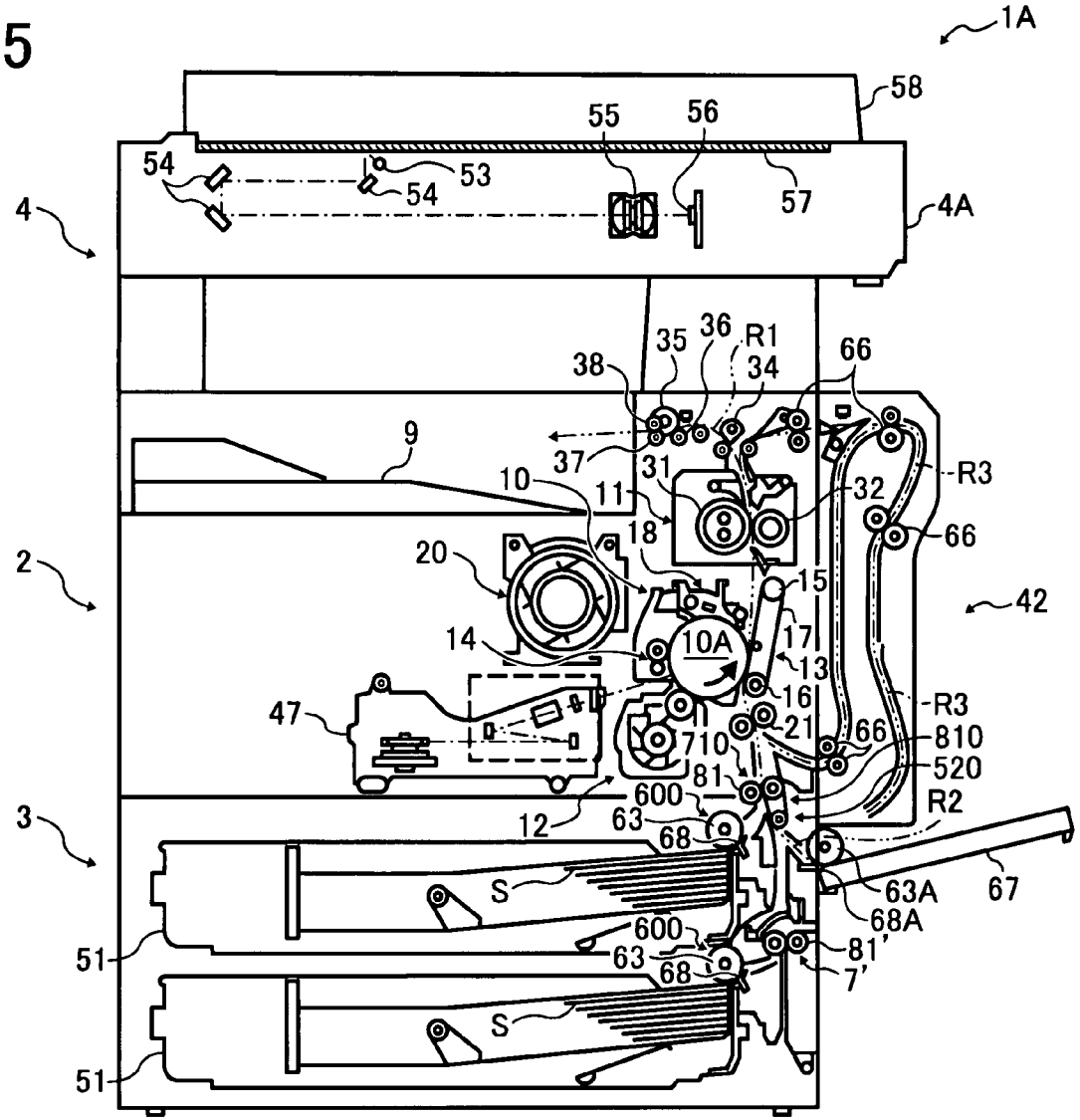
FIG. 25 is an elevation view of a schematic entire configuration of an image forming apparatus including a sheet conveying device according to an example embodiment of the present patent application.
Figure 26:
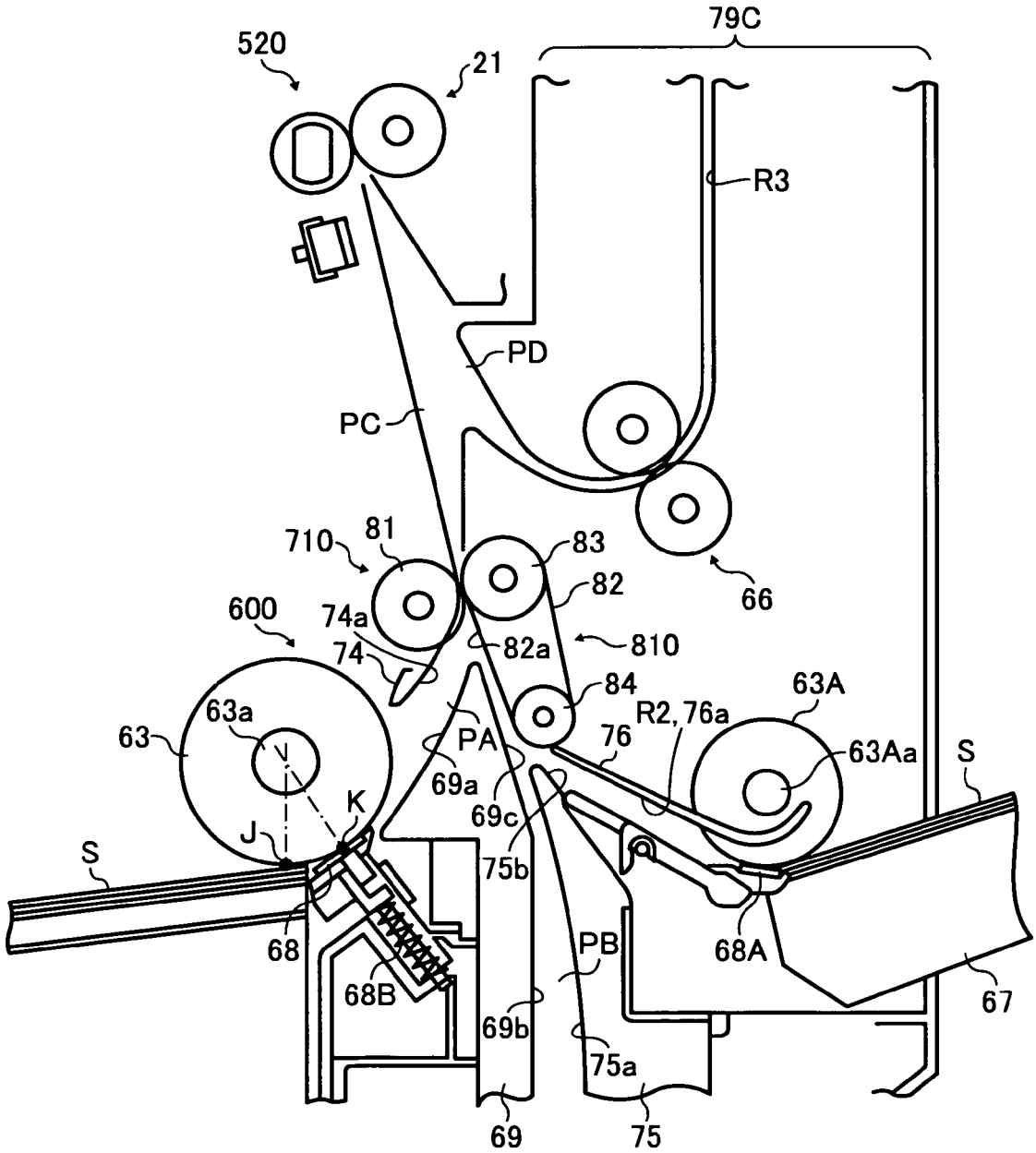
FIG. 26 is a cross-sectional view of a sheet conveying device of the image forming apparatus of FIG. 25.

According to the above-described change of the belt-type conveying unit 810, the third conveying path PC, which is a sheet conveying path, from the second conveying unit 7 including the belt-type conveying units 810 to the pair of registration rollers 21 has shifted to the left side in FIGS. 25 and 26. Therefore, the fourth conveying path PD serving as a common conveying path that meets and merges with the reverse conveying path R3 of the sheet reversing device 42 is shifted to the left side in FIGS. 25 and 26.

The conveying surface 82*a* of the conveyor belt 82 of the belt-type conveying unit 810 is disposed along the inner side of the manual sheet conveying path R2 through which the sheet S fed from the manual sheet feeding tray 67 is conveyed.

The sheet conveying device 520 of this example embodiment of the present patent application has similar structure and functions to the sheet conveying device 5 of the above-described example with reference to FIGS. 2 through 8A and 8B, except the above-described structure.

From another point of view, the sheet conveying device 520 of this example embodiment may be a combination of the sheet conveying device 500 of the above-described example embodiment with reference to FIGS. 14 through 22C and the sheet conveying device 510 of the above-described example embodiment with reference to FIGS. 10 through 12. That is, the sheet conveying device 520 of this example embodiment with reference to FIGS. 25 through 33 is primarily different from the sheet conveying device 5 according to the above-described example embodiment with reference to FIGS. 14 through 22C and the sheet conveying device 510 according to the above-described example embodiment with reference to FIGS. 23 through 24B in the following two points and subsequently described characteristics.

A downstream end formed by the guide surfaces 69*a* and 69*c* of the conveying guide member 69 of the sheet conveying device 520 according to this example embodiment shown in FIG. 26, which is illustrated as upwardly directing in FIG. 26, may be disposed same as the sheet conveying device 510 according to the above-described example embodiment shown in FIG. 23 and different from the sheet conveying device 500 according to the above-described example embodiment shown in FIG. 14. That is, the downstream end formed by the guide surfaces 69*a* and 69*c* of the conveying guide member 69 of the sheet conveying device 520 may be disposed a position lower than the downstream end of the conveying guide member 69A of the sheet conveying device 500 so that the leading edge of the sheet S transferred through the first sheet conveying path PA can reach and enter the conveying surface 82*a* of the conveyor belt 82 of the belt-type conveying unit 810.

Further, different from the sheet conveying device 500 according to the example embodiment shown in FIG. 14 and the sheet conveying device 510 according to the above-described example embodiment shown in FIG. 23, the conveying guide member 69 of the sheet conveying device 520 according to this example embodiment shown in FIG. 26 may include a conveying guide on the inner side of the sheet conveying device 500 and the outer side of the sheet conveying device 510.

Further, the curvature radius of the first sheet conveying path PA to which the sheet S is conveyed from the feed roller 63 maybe set smaller than the curvature radius of the manual sheet conveying path R2 to which the sheet S is conveyed from the feed roller 63A.

Furthermore, the pair of registration rollers 21 may be disposed on the downstream side of the second conveying unit 710, and the reverse conveying path R3 located on the upper side of the second conveying unit 710 may meet the fourth conveying path PD before the pair of registration rollers 21.

The sheet conveying device 520 is also different from the sheet conveying device 5 according to the above-described example with reference to FIGS. 2 through 8A and 8B, the sheet conveying device 5A according the above-described example with reference to FIGS. 10 through 12, and the sheet conveying device 5B according the above-described example with reference to FIG. 13. However, the different points are common to those described for the sheet conveying device 500 according to the above-described example embodiment with reference to FIGS. 14 through 22C and the sheet conveying device 510 according to the above-described example embodiment with reference to FIGS. 23 through 24B. Therefore, the descriptions of these different points are omitted.

As shown in FIGS. 25 and 26, the sheet conveying device 520 includes the first sheet conveying path PA through which the sheet S is conveyed, the manual sheet conveying path-R2 to which the sheet S is also conveyed from the side of the belt-type conveying units 810, and the common conveying path PM where the first sheet conveying path PA and the manual sheet conveying path R2 meet and merge. The sheet conveying device 520 further includes the belt-type conveying units 810 along the manual sheet conveying path R2 and the common conveying path PM, which is the opposite side of the first sheet conveying path PA.

Next, a detailed description is given of schematic structure and functions of the belt-type conveying unit 810 with reference to FIGS. 27 through 30.

The sheet conveying device 520 having the belt-type conveying units 810 according to this example embodiment shown in FIGS. 27 through 30 is different from the sheet conveying device 5 of the belt-type conveying unit 8 according to the above-described example shown in FIGS. 2 through 5 and FIGS. 8A and 8B in the following points and subsequently described characteristics.

The belt-type conveying units 810 are three separate units that are initially built in a housing case 105 together with the common pulley shafts 83*a* and 84*a*, which configure a belt unit 104 that is detachably attached to an opening and closing guide 79C shown in FIG. 26 or a main body 78 including a housing 80. Furthermore, the sheet conveying device 520 includes the conveying guide member 76 instead of the conveying guiding member 72. Apart from these differences, the belt-type conveying units 810 of the sheet conveying device 520 shown in FIGS. 27 through 30 are the same as the belt-type conveying unit 8 of the sheet conveying device 500 according to the example embodiment shown in FIGS. 2 through 5 and FIGS. 8A and 8B.

The outer edges of the pulleys 83 and the conveyor belts 82 at the outermost sides in the sheet width direction Y may be positioned so as to be within the width of the minimum-size sheet S or the sheet size in the sheet width direction Y used in the copier 1 provided with the sheet conveying device 520 shown in FIG. 25. Similarly, the outer edges of the grip rollers 81, not shown in FIG. 27 through 30, at the outermost sides in the sheet width direction Y may be positioned so as to be within the width of the minimum-size sheet S or the sheet size in the sheet width direction Y used in the copier 1A provided with the sheet conveying device 520.

The pulleys 83 and 84 of the belt-type conveying units 810 are made of a resin material such as polyacetal resin that has good lubricity, abrasion resistance, and durability, and are thus light-weight. The pulleys 83 and 84 are fabricated in such a manner that the pulley shaft 83*a* can be inserted through the pulley 83 and the pulley shaft 84*a* can be inserted through the pulley 84. The pulleys 83 and 84 are rotatably attached to and/or supported by the pulley shafts 83*a* and 84*a*, respectively. Each of the pulley shafts 83*a* and 84*a* is a single shaft inserted through respective through-holes, not shown, of the three upper pulleys 83 and three lower pulleys 84, respectively.

The housing case 105 is also a single component made of a resin material such as polyacetal resin that has good lubricity, abrasion resistance, and durability, and is thus light-weight. The housing case 105 includes the following components combined together, which are a holder section 105*a* also acting as a bearing, belt supporting sections 105*b* for partitioning and supporting the pulleys 83 and the conveyor belts 82, a main unit 105*c* by which the holder section 105*a* and the belt supporting sections 105*b*, etc., are integrally combined, attached, and operated, protrusions 105*d* used as references in the sheet width direction Y for attaching the components, and a pair of left and right spring stages 105*e* for latching one end of each spring 106 (pressing spring) shown in FIG. 30 acting as forcing units/forcing members or elastic members. The belt supporting sections 105*b* on both sides of the belt-type conveying units 810 in the sheet width direction Y in the housing case 105 have through holes 105*f* through which the pulley shaft 84*a* is inserted.

Figure 30:
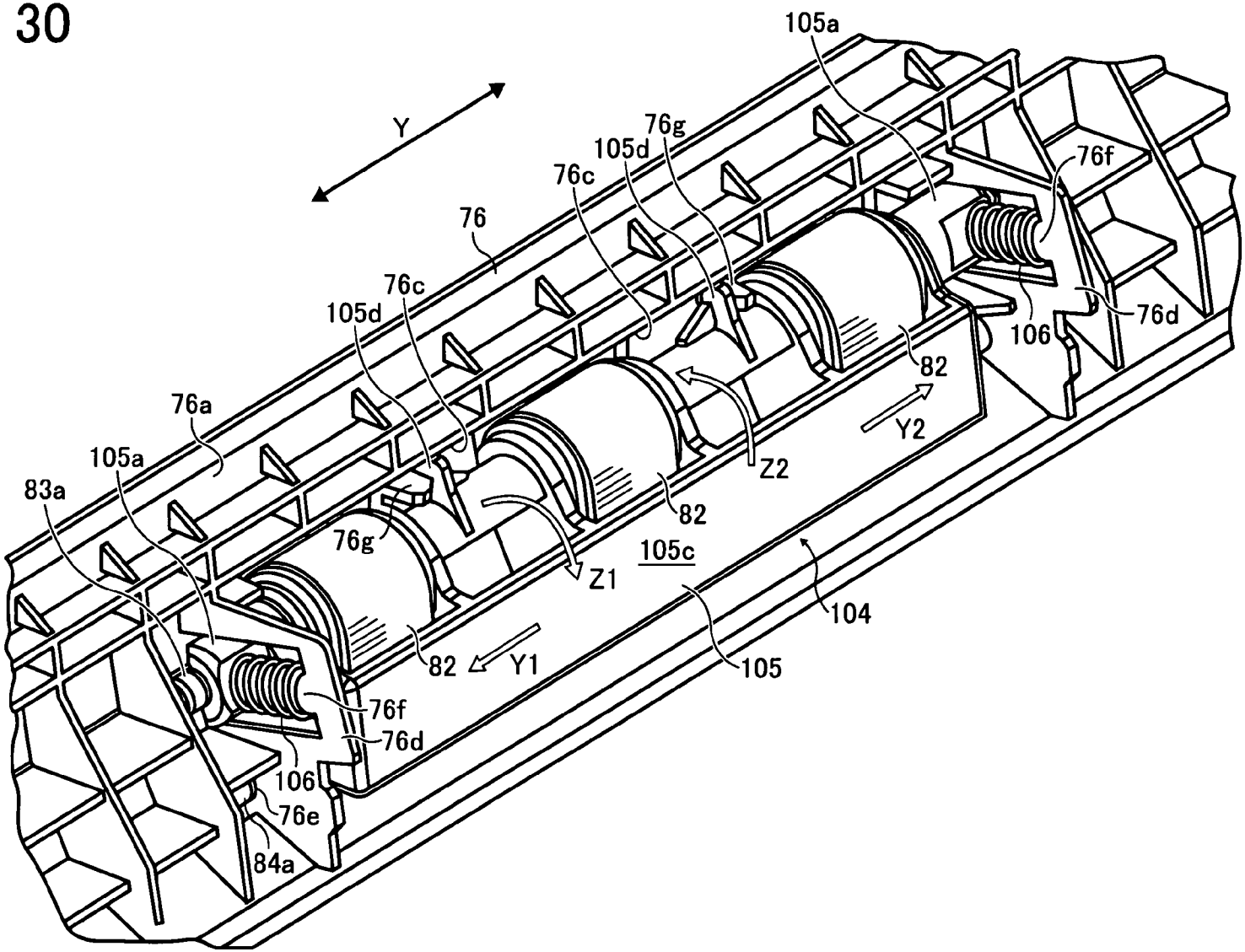
FIG. 30 is a perspective view of relevant parts around the belt unit of the sheet conveying device of FIG. 26, where the belt unit is attached to a conveying guide member, viewed from behind the conveying guide member.

As shown in FIG. 30, the conveying guide member 76 includes a guide surface 76*a*, spring latching sections 76*f*, a pair of left and right ribs 76*d*, and a pair of left and right restricting sections 76*g*.

The spring latching sections 76*f* may be provided on the back wall of the conveying guide member 76 for acting as reinforcing components and for latching the other ends of the springs 106.

The pair of left and right ribs 76*d* includes slots for attaching components such as the springs 106.

The pair of left and right restricting sections 76*g* may contact the protrusions 105*d* and act as references in the sheet width direction Y when attaching the belt unit 104. These components may be integrally formed with an appropriate resin material.

Furthermore, the conveying guide member 76 includes openings 76*c* and through holes 76*e* integrally mounted thereon.

The openings 76*c* may be provided so that the conveying surfaces 82*a* of the conveyor belts 82 of the belt unit 104 can be exposed to the first sheet conveying path PA and the second sheet conveying path PB from the guide surface 76*a*, when the belt unit 104 is attached to the sheet conveying device 520.

The through holes 76*e* may be provided in each of the ribs 76*d* so that the pulley shaft 84*a* can be inserted therethrough.

Next, a brief description is given of the procedure of attaching the belt unit 104 to the opening and closing guide 79C shown in FIG. 26.

Figure 28:
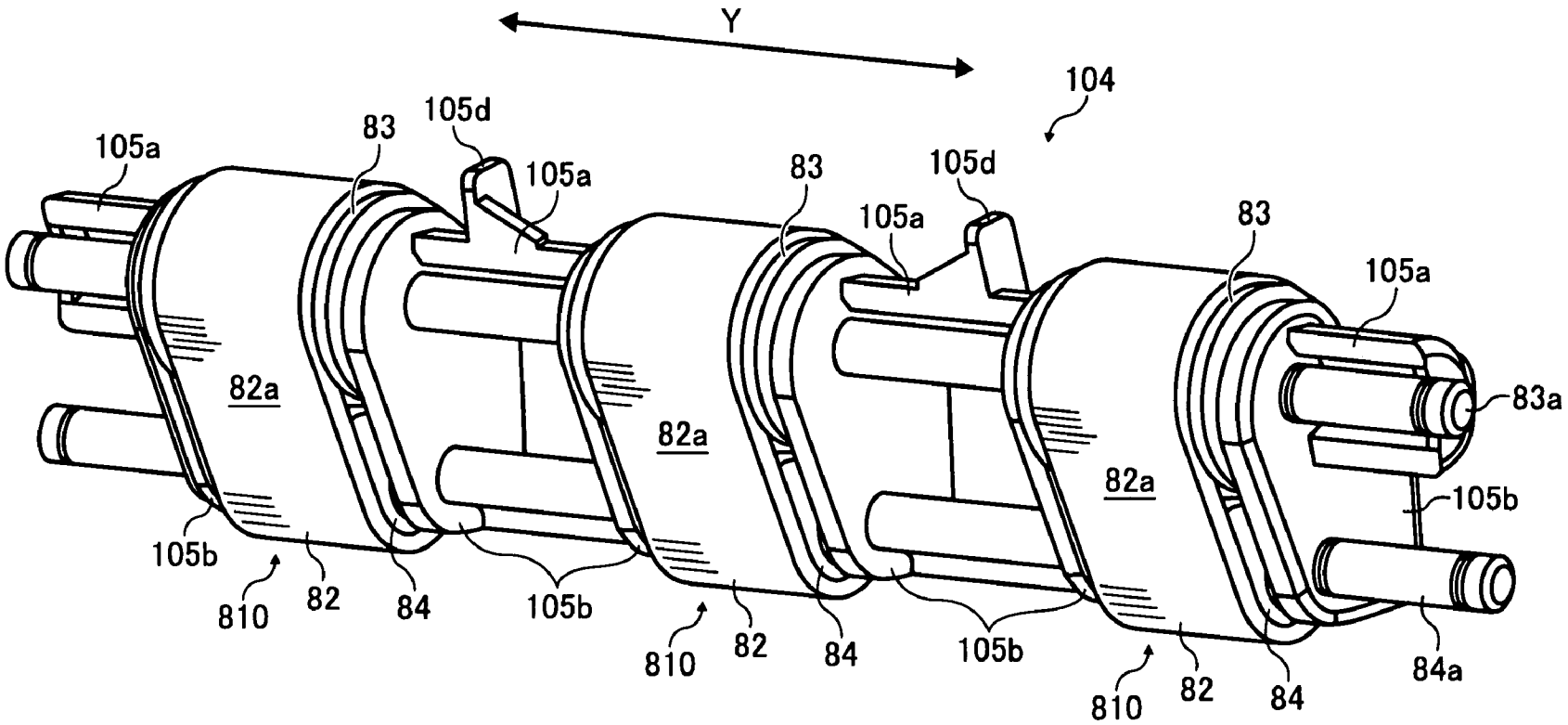
FIG. 28 is a perspective view of relevant parts around the belt unit of the sheet conveying device of FIG. 26, viewed from a grip roller side.
Figure 29:
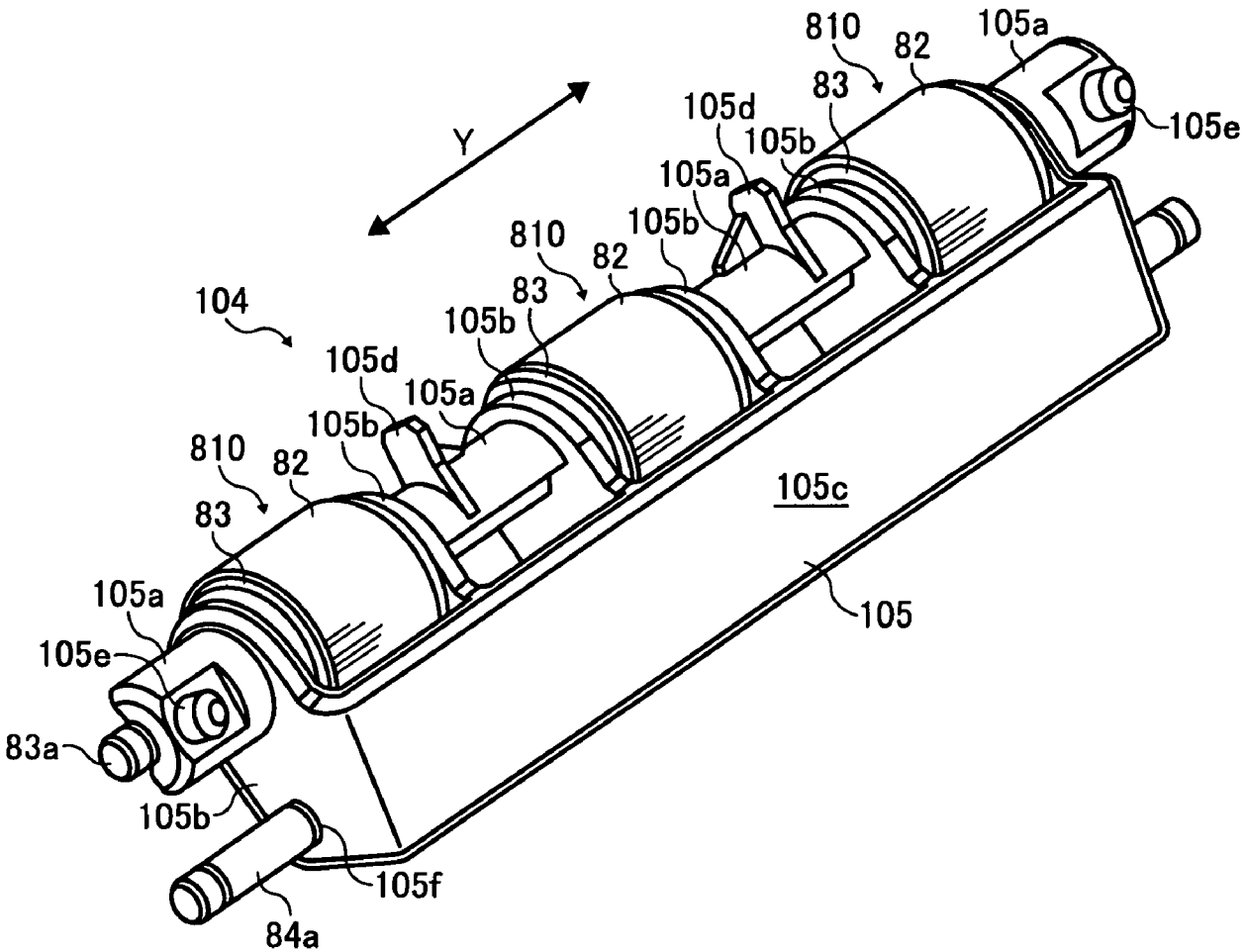
FIG. 29 is a perspective view of relevant parts around the belt unit of the sheet conveying device of FIG. 26, viewed from behind a conveying guide member.

First, each of the conveyor belts 82 is stretched around the pulleys 83 and 84. Next, the pulley shaft 83*a* is inserted through the pulleys 83, and the pulley shaft 84*a* is inserted through the through holes 105*f* of the belt supporting sections 105*b* in the housing case 105 and the pulleys 84. Thus, the conveyor belts 82 are stretched around the pulleys 83 and 84. The conveyor belts 82 are made to have a given tension as the axes of the pulleys 83 and 84 are spaced apart by a given distance. Furthermore, the pulleys 83 and 84, the conveyor belts 82, and the pulley shafts 83*a* and 84*a* are detachably attached to the housing case 105, so that the belt unit 104 is configured as shown in FIGS. 28 and 29.

At this point, retaining rings, not shown, are attached on the pulley shaft 83*a* protruding outside from the left and right sides of the holder section 105*a*, so that the pulley shaft 83*a* can be attached and supported and also prevented from moving in the sheet width direction Y in the holder section 105*a* of the housing case 105.

Next, with reference to FIG. 30, the belt unit 104 is attached to the conveying guide member 76 of the opening and closing guide 79C as follows. The left end of the pulley shaft 84*a* protruding from the left side of the leftmost belt supporting section 105*b* as viewed in FIG. 30 is moved from the right side to the left side in a direction indicated by arrow Y1 as viewed in FIG. 30 to be inserted in the through hole 76*e* in the left rib 76*d* in the conveying guide member 76. At this point, the belt unit 104 is rotated so that the protrusions 105*d* of the belt unit 104 can move in a direction indicated by arrow Z1 from the positions illustrated in FIG. 30 to tilted positions, so as not to be obstructed by the restricting sections 76*g* of the conveying guide member 76.

While the protrusions 105*d* of the belt unit 104 are kept at the tilted positions, the right end of the pulley shaft 84*a* protruding from the right side of the rightmost belt supporting section 105*b* as viewed in FIG. 30 may be moved from the left side to the right side in a direction indicated by arrow Y2 as viewed in FIG. 30 to be inserted in the through hole 76*e* in the right rib 76*d* in the conveying guide member 76.

Then, the belt unit 104 is rotated so that the protrusions 105*d* of the belt unit 104 can move in a direction indicated by arrow Z2. Accordingly, the left and right protrusions 105*d* contact or fit in the left and right restricting sections 76*g*, so that the belt unit 104 can be prevented from moving in the sheet width direction Y.

Next, the springs 106 are attached to the spring stages 105*e* and the spring latching sections 76*f* on the left and right. Then, retaining rings, not shown, are attached to both ends of the pulley shaft 84*a* protruding outside from the left and right ribs 76*d* of the conveying guide member 76, so that the pulley shaft 84*a* can be attached and supported by the left and right ribs 76*d* of the conveying guide member 76 and prevented from moving in the sheet width direction Y of the conveying guide member 76.

As described above, the belt unit 104 is arranged at a position in such a manner that the conveying surfaces 82*a* of the conveyor belts 82 protrude from the openings 76*c* of the conveying guide member 76 by a given amount or step height. Furthermore, the pressing force of the pair of left and right springs 106 presses the belt unit 104 in such a direction that the upper pulleys 83 pivot in a counterclockwise direction about the pulley shaft 84*a*. Accordingly, the conveying surfaces 82*a* are pressed against the grip rollers 81, not shown in FIG. 30, via the pulleys 83 by a given pressure level.

As shown in FIG. 27, the sheet conveying device 520 further includes pairs of ribs 76*b* formed in a protruding manner from the guide surface 76*a* facing the first sheet conveying path PA and the second sheet conveying path PB of the conveying guide member 76, so as to reinforce the conveying guide member 76. The size of each of the pairs of ribs 76*b* that protrude toward the first sheet conveying path PA and the second sheet conveying path PB is smaller than a given step height of the conveying surface 82*a* protruding from the guide surface 76*a*. Therefore, the pairs of ribs 76*b* may not interfere the sheet S when the conveying surfaces 82*a* of the conveyor belts 82 guide and convey the sheet S.

According to this example embodiment, the basic effects of the belt-type conveying units 810 can be achieved, and the following additional advantages and effects can also be achieved.

The pulleys 83 and 84, the conveyor belts 82, and the pulley shafts 83*a* and 84*a* may be detachably attached to the housing case 105. Thus, the belt unit 104 may be configured to be easily attachable to and detachable from the opening and closing guide 79C. As the sheet conveying device 520 can easily be attached and detached, maintenance and cleaning of the sheet conveying device 520 are facilitated. Moreover, assembling errors between the conveyor belts 82 can be reduced compared to the examples shown in FIGS. 2 through 5, 13, and 14.

As a matter of course, the relevant configurations of the previously described belt-type conveying units 8 or 800 are applicable to the belt-type conveying unit 810 of the sheet conveying device 520 as shown in FIGS. 25 and 26.

Figure 31A:
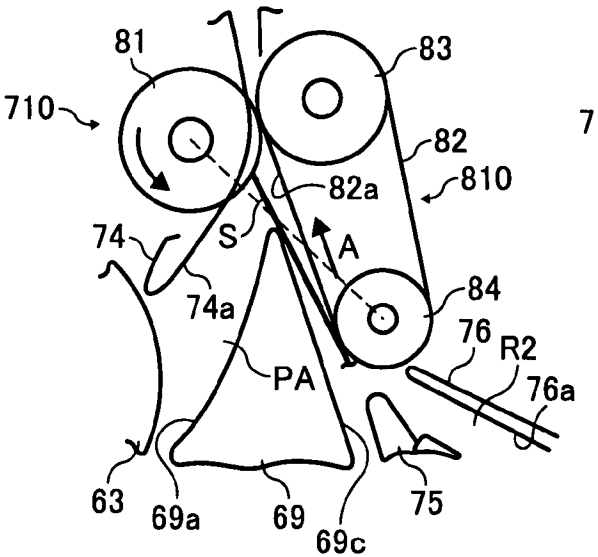
FIG. 31A is a drawing showing a progress of a sheet conveyed via the manual sheet feeding path to the conveying guide member according to an example embodiment of the present patent application.
Figure 31B:
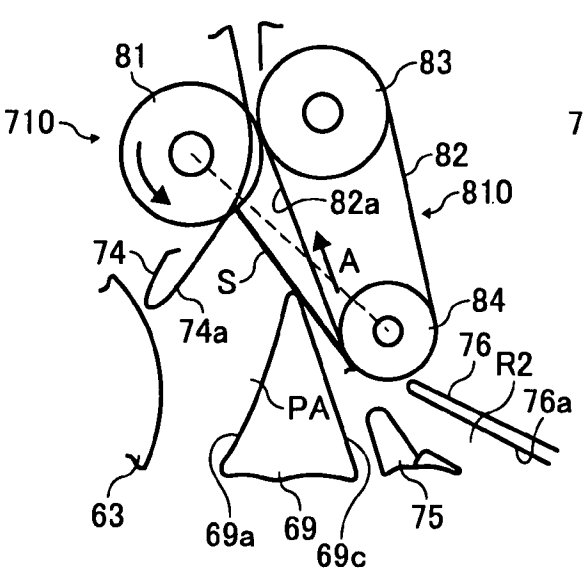
FIG. 31B is a drawing showing another progress of the sheet after FIG. 31A.
Figure 31C:
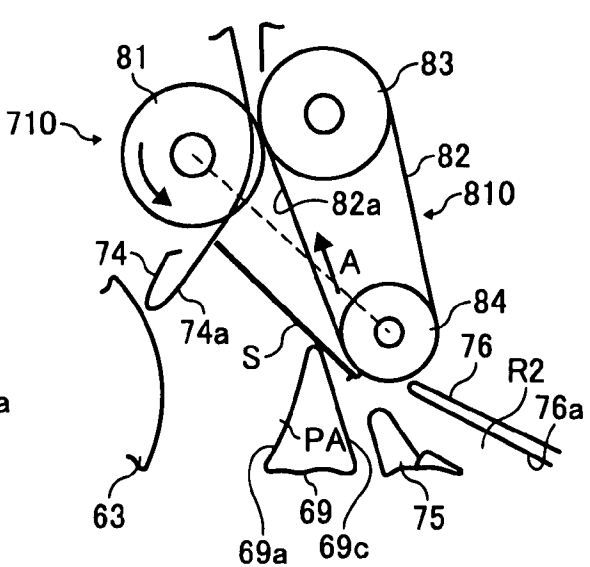
FIG. 31C is a drawing showing another progress of the sheet after FIG. 31B.

Next, with reference to FIGS. 31A, 31B, and 31C, an additional description is given of the travel of the sheet S conveyed via the manual sheet conveying path R2 along the conveying guide member 69.

FIGS. 31A, 31B, and 31C show differences of the position of the leading edge of the sheet S when the height and position of the downstream end of the conveying guide member 69 is changed.

In FIG. 31A, the conveying guide member 69 is relatively large or the largest among the conveying guide members 69 shown in FIGS. 31A, 31B, and 31C, and the grip roller 81 is disposed at an extension of a line connecting the downstream end of the conveying guide member 69 and a given point on the conveying belt 82 at which the inner surface thereof contacts the circumference or circumferential surface of the pulley 84. With the above-described configuration, the leading edge of the sheet S from the manual sheet conveying path R2 may pass the downstream end of the conveying guide member 69 as shown in FIG. 31A. At this time, the sheet S may reach or abut against the circumferential surface of the grip roller 81 as shown in FIG. 31A, on which the leading edge of the sheet S is located at a downstream side from a dotted line connecting a center axis of the grip roller 81 and a center axis of the pulley 84. Therefore, the rotation force of the grip roller 81 may cause the leading edge of the sheet S to be guided and conveyed to the nip contact of the second conveying unit 7.

Next, in FIG. 31B, the conveying guide member 69 is smaller than the conveying guide member 69 in FIG. 31A and the grip roller 81 is disposed at an extension of a line connecting the downstream end of the conveying guide member 69 and a given point on the conveying belt 82 at which the inner surface thereof contacts the circumference or circumferential surface of the pulley 84. The above-described positional relation is same as the configuration shown in FIG. 31A. However, the configuration in FIG. 31B is different from the configuration in FIG. 31A in the position of the leading edge of the sheet S abutting against the circumferential surface of the grip roller 81. With the above-described configuration in FIG. 31B, when the leading edge of the sheet S passes the downstream end of the conveying guide member 69, the sheet S may reach or abut against the circumferential surface of the grip roller 81 as shown in FIG. 31B, on which the leading edge of the sheet S is located at an upstream side from a dotted line connecting the center axis of the grip roller 81 and the center axis of the pulley 84. At this time, similar to FIG. 31A, the leading edge of the sheet S can be conveyed by the rotation force of the grip roller 81 toward the downstream side in the sheet travel direction. However, since the surface of the sheet S is conveyed by the belt-type conveying unit 810 toward the downstream side in the sheet travel direction, a part of the sheet S downstream from which the surface of the sheet S contacts the belt-type conveying unit 810 may ripple or be wavy. As a result, the leading edge of the sheet S may be guided to the nip contact of the second conveying unit 710 with the configuration with the conveying guide member 69 having a smaller size as shown in FIG. 31B, and it is more advantageous to provide the configuration with the conveying guide member 69 shown in FIG. 31A.

Then, in FIG. 31C, the conveying guide member 69 is further smaller than the conveying guide member 69 in FIGS. 31A and 31B, and the guide surface 74*a* of the conveying guide member 74 is located at an extension of the line connecting the downstream end of the conveying guide member 69 and the point on the conveying belt 82 at which the inner surface thereof contacts the circumference or circumferential surface of the pulley 84. The guide surface 74*a* of the conveying guide member 74 is located upstream of the grip roller 81 or is located at an upstream side from a dotted line connecting the center axis of the grip roller 81 and the center axis of the pulley 84.

With the above-described configuration, when the leading edge of the sheet S passes the downstream end of the conveying guide member 69, the sheet S may reach or abut against the surface of the guide surface 74*a* of the conveying guide member 74, as shown in FIG. 31C. The guide surface 74*a* in the configuration shown in FIG. 31C is not generally used to guide the leading edge of the sheet S to the nip contact of the second conveying unit 710. Therefore, the conveying force of the feed roller 63A may need to be increased to guide the leading edge of the sheet S to the nip contact of the second conveying unit 710.

Further, when the sheet S is not a relatively rigid paper, the leading edge of the sheet S may bow toward the left downward direction in FIG. 31C, and it may be difficult to guide the leading edge of the sheet S to the nip contact of the second conveying unit 710. Accordingly, so as not to increase the conveying force, it is advantageous to provide the configuration with the conveying guide member 69 shown in FIG. 31A.

As described above, according to this example embodiment of the present patent application, the belt-type conveying unit 810 may be disposed on the inner side of the merged portion from the manual sheet conveying path R2, which is the outer side of the merged portion from the first sheet conveying path PA. Accordingly, various types of sheets can be conveyed via both the first sheet conveying path PA and the manual sheet conveying path R2.

Further, by disposing the belt-type conveying unit 810 as described above, one of the first sheet conveying path PA and the manual sheet conveying path R2 may be designed more flexibly. For example, the main body of the copier 1A may include an outside panel 2*a* as shown in FIG. 33A.

Figure 33A:
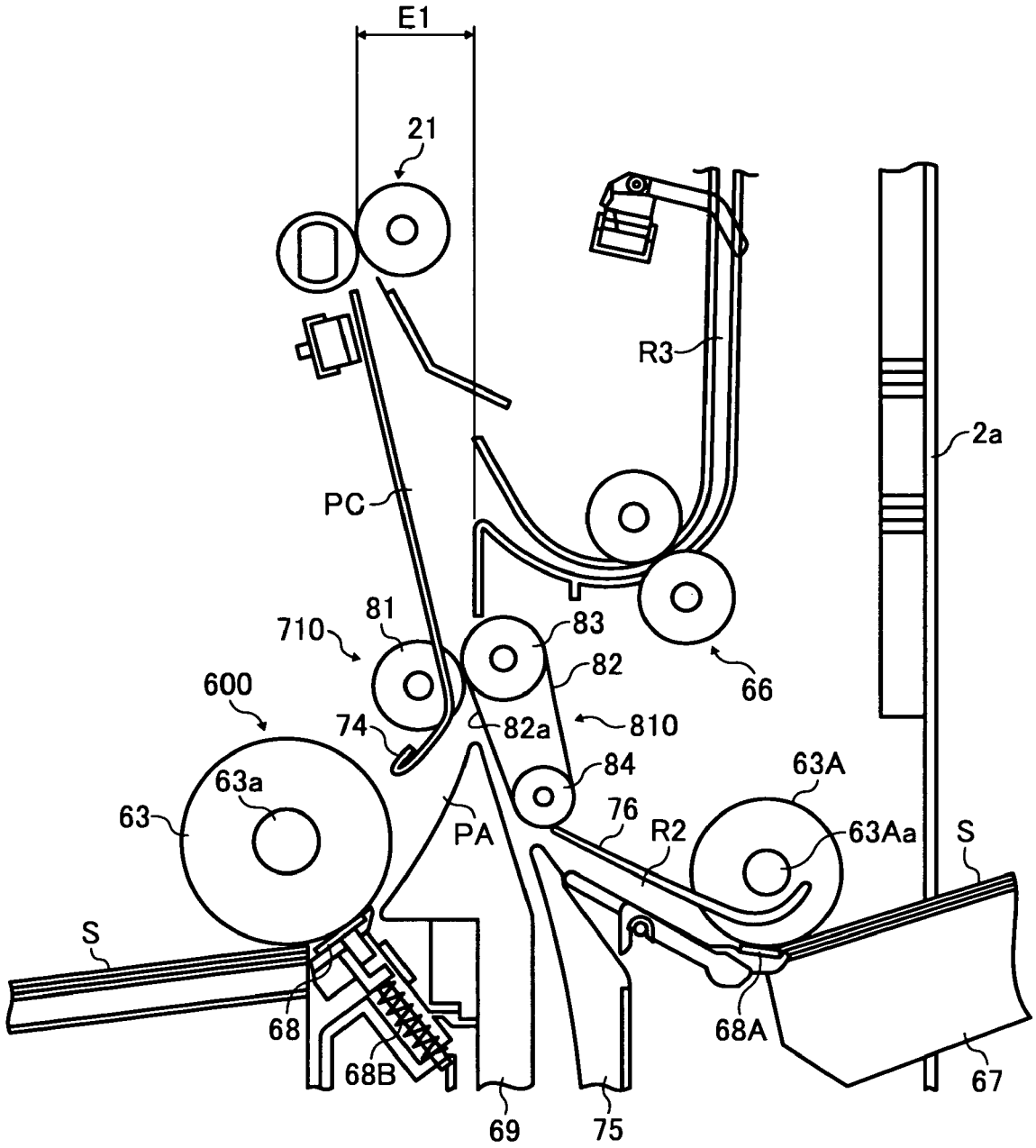
FIG. 33A is a drawing showing an example of a size reduction of the sheet conveying device according to an example embodiment of the present patent application.

As shown in FIG. 33A, the outside panel 2*a* may be provided on the side of the manual sheet feeding unit in the main body 2 of the copier 1A. The manual sheet feeding tray 67 can be rotated about a rotary shaft, not shown, from the respective positions shown in FIG. 33A toward the outside panel 2*a* to be put in the outside panel 2*a*.

In FIG. 33A, the belt-type conveying unit 810 according to this example embodiment of the present patent application includes the second conveying unit 710 and is disposed in an inclined manner toward the left side in FIG. 33A so as to guide the sheet S conveyed via the first sheet conveying path PA to bend in the sheet travel direction. By so doing, the third conveying path PC and the pair of registration rollers 21 both located at the downstream side of the belt-type conveying unit 810 may be moved or shifted by a distance E1 to the left side in the horizontal direction. According to the above-described movement of the third conveying path PC and the pair of registration rollers 21, the reverse conveying path R3 and the outside panel 2*a* located downstream of the belt-type conveying unit 810 may also be moved or shifted by the distance E1, thereby reducing the width of the entire body of an image forming apparatus by the distance E1 and making the entire body of the copier 1A more compact than the copier 1 in FIG. 2.

Figure 33B:
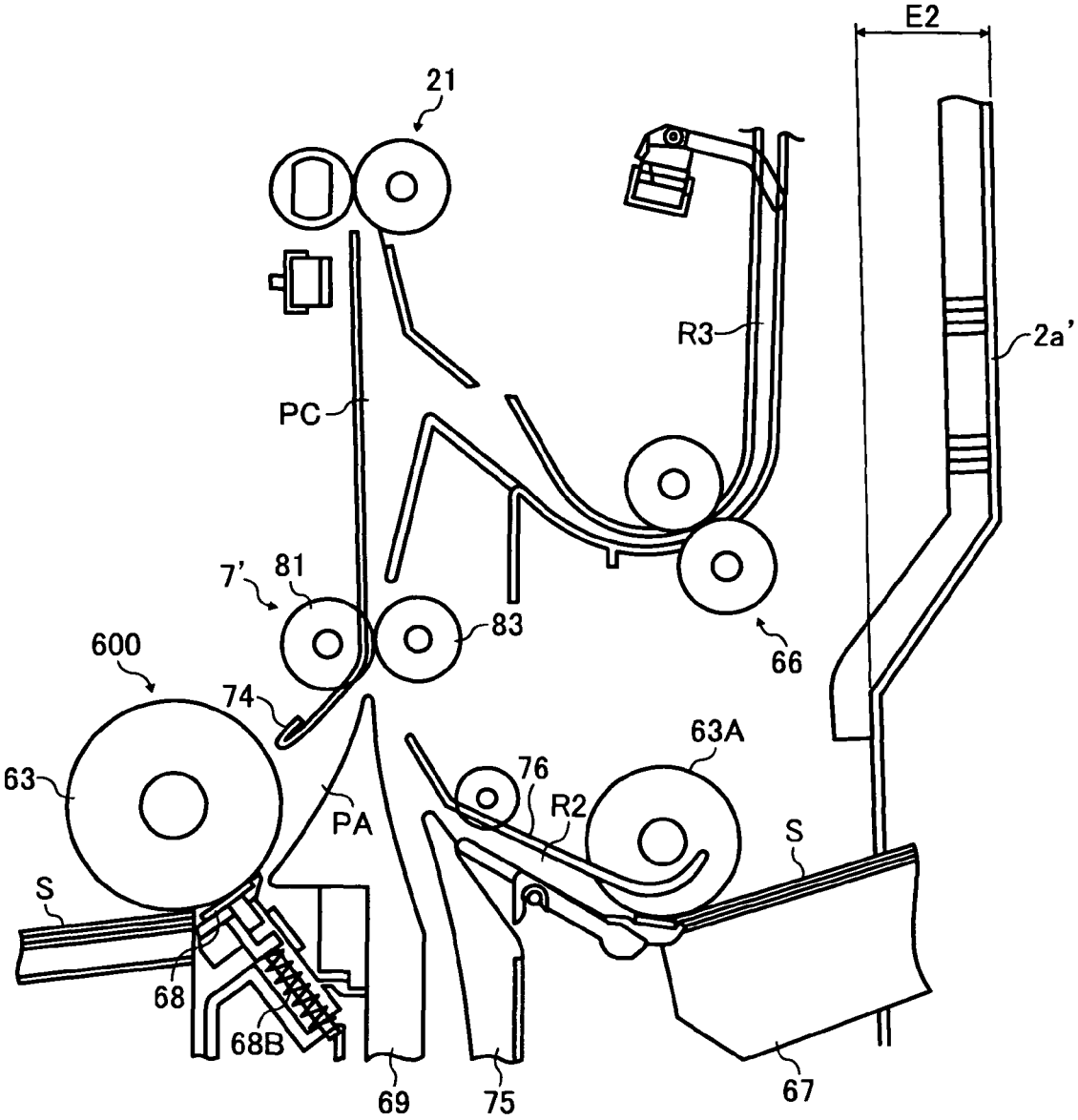
FIG. 33B is a drawing showing another example of a size reduction of the sheet conveying device according to an example embodiment of the present patent application.

By contrast, as shown in FIG. 33B, the third conveying path PC located downstream of the second conveying unit 7' including the grip roller 81 and the roller-type pulley 83 extends to a substantially vertical upward direction. With this configuration, the reverse conveying path R3 and an outside panel 2*a*' are located in a projecting manner by a distance E2, which is equal to the distance E1, to the right side in FIG. 33B.

To reduce the size of an image forming apparatus, it is common to provide a merged conveying path in the space before the pair of registration rollers 21 by merging the reverse conveying path R3 thereto. In this example embodiment shown in FIG. 33A, the curvature radius of the reverse conveying path R3 may be determined based on a gap between the position of the pair of registration rollers 21 and the duplex conveying guide member (not shown, in the vicinity of the right portion of the outside panel 2*a*). Therefore, the reverse conveying path R3 can be shifted to the left side in FIG. 33A while keeping the curvature radius of the reverse conveying path R3, which may be the quality in transfer of a duplex sheet. That is, the greater curvature radius increases the quality in transfer. Accordingly, when the distance E2 is equal to the distance E1, the size of the image forming apparatus can be reduced by the distance E1.

Further, as previously described, this example embodiment corresponds to a combination of the above-described example embodiments with reference to FIGS. 14 through 22C and FIGS. 23 through 24B. Therefore, it is advantageous to achieve the above-described effect. That is, the belt-type conveying unit 810 may be the belt-type conveying unit 8 or 800.

In the above description, the belt-type conveying unit 810 (or the belt-type conveying unit 8 or 800) is used in the manual sheet conveying path R2 formed by the manual sheet feeding tray 67. However, it is to be understood that the present patent application is not intended to be limited to this example embodiment. For example, similar to the belt-type conveying unit 800 of the above-described example embodiment with reference to FIGS. 14 through 22C, the belt-type conveying unit 810 can be applied in the sheet feeding device 3, from the feed roller 63 of the first conveying unit 600 to the inner area of the first sheet conveying path PA of the second conveying unit 7 or to an inner area of a position to change the sheet conveying direction such as an inner area of such a position in the reverse conveying path R3 and an inner area of such a position in an automatic document feeder (ADF) or automatic reversing document feeder (ARDF).

Figure 34:
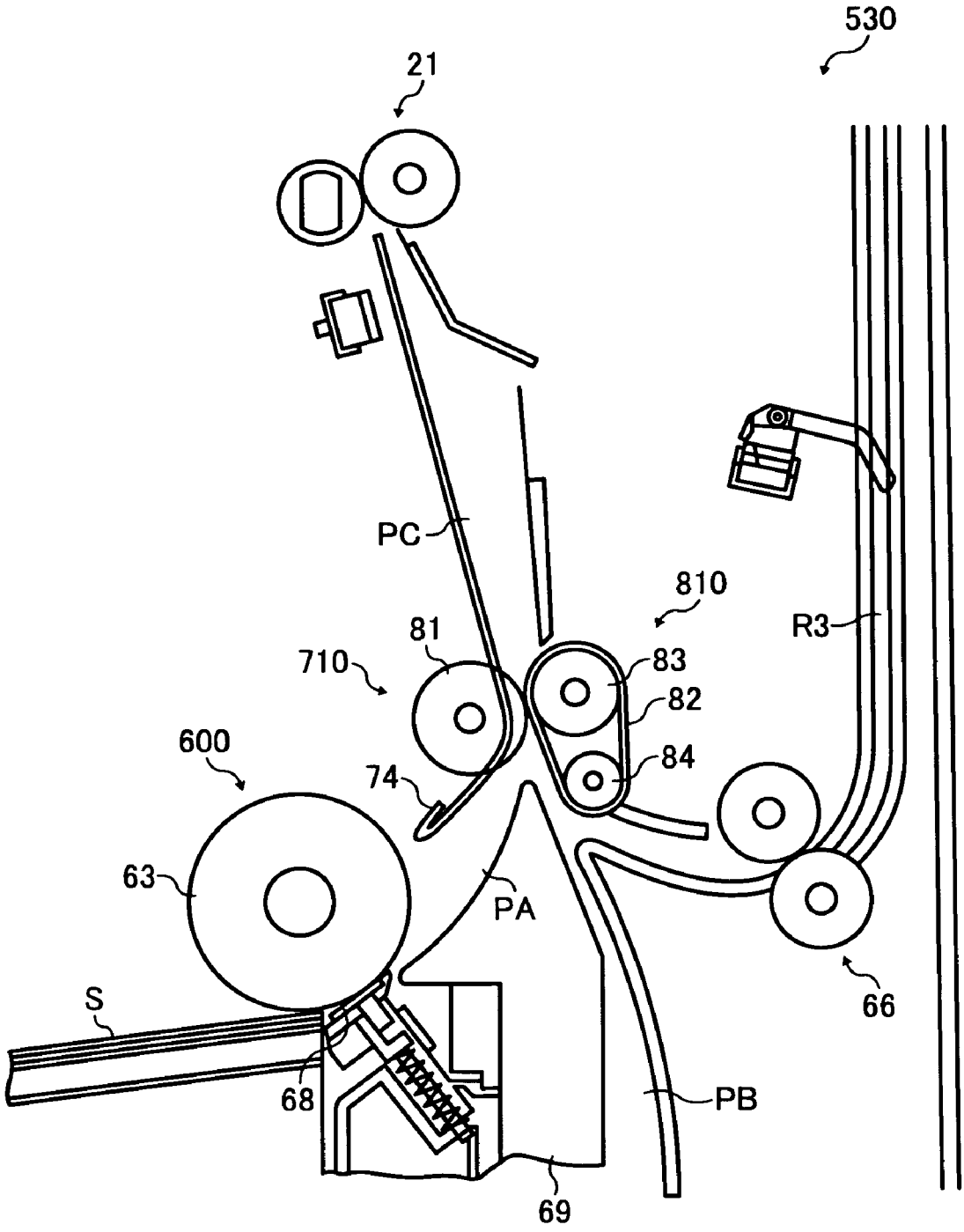
FIG. 34 is a cross-sectional view of a sheet conveying device according to an example embodiment of the present patent application.

Next, referring to FIG. 34, a schematic configuration of a sheet conveying device 530 included in the copier 1A is described, according to an example embodiment of the present patent application.

As previously described, elements having the same functions and shapes are denoted by the same reference numerals throughout the specification and redundant descriptions are omitted.

Instead of the sheet conveying device 520 according to the previously described example embodiment shown in FIGS. 25 and 26, the sheet conveying device 530 shown in FIG. 34 is employed.

For example, the sheet conveying device 530 according to this example embodiment shown in FIG. 34 is primarily different from the sheet conveying device 520 according to the example embodiment shown in FIGS. 25 and 26 in the following points and subsequently described characteristics.

The manual sheet conveying path R2, the conveying guide member 76, and the manual sheet feeding section are removed from the sheet conveying device 530.

Instead of the configuration in which the downstream edge of the reverse conveying path R3 is connected and disposed to the fourth conveying path PD located downstream of the belt-type conveying unit 810, the downstream edge of the reverse conveying path R3 is connected and disposed so as to merge the second sheet conveying path PB located upstream of the belt-type conveying unit 810.

The sheet conveying device 530 of this example embodiment of the present patent application has similar structure and functions to the sheet conveying device 520 of the copier 1A of the above-described example embodiment with reference to FIGS. 25 through 33, except the above-described structure.

According to this example embodiment of the present patent application, the sheet conveying device 530 may include the reverse conveying path R3 having a large curvature radius. This may reduce transfer failures and/or paper jam, thereby achieving a stable sheet transfer from the reverse conveying path R3.

Figure 35:
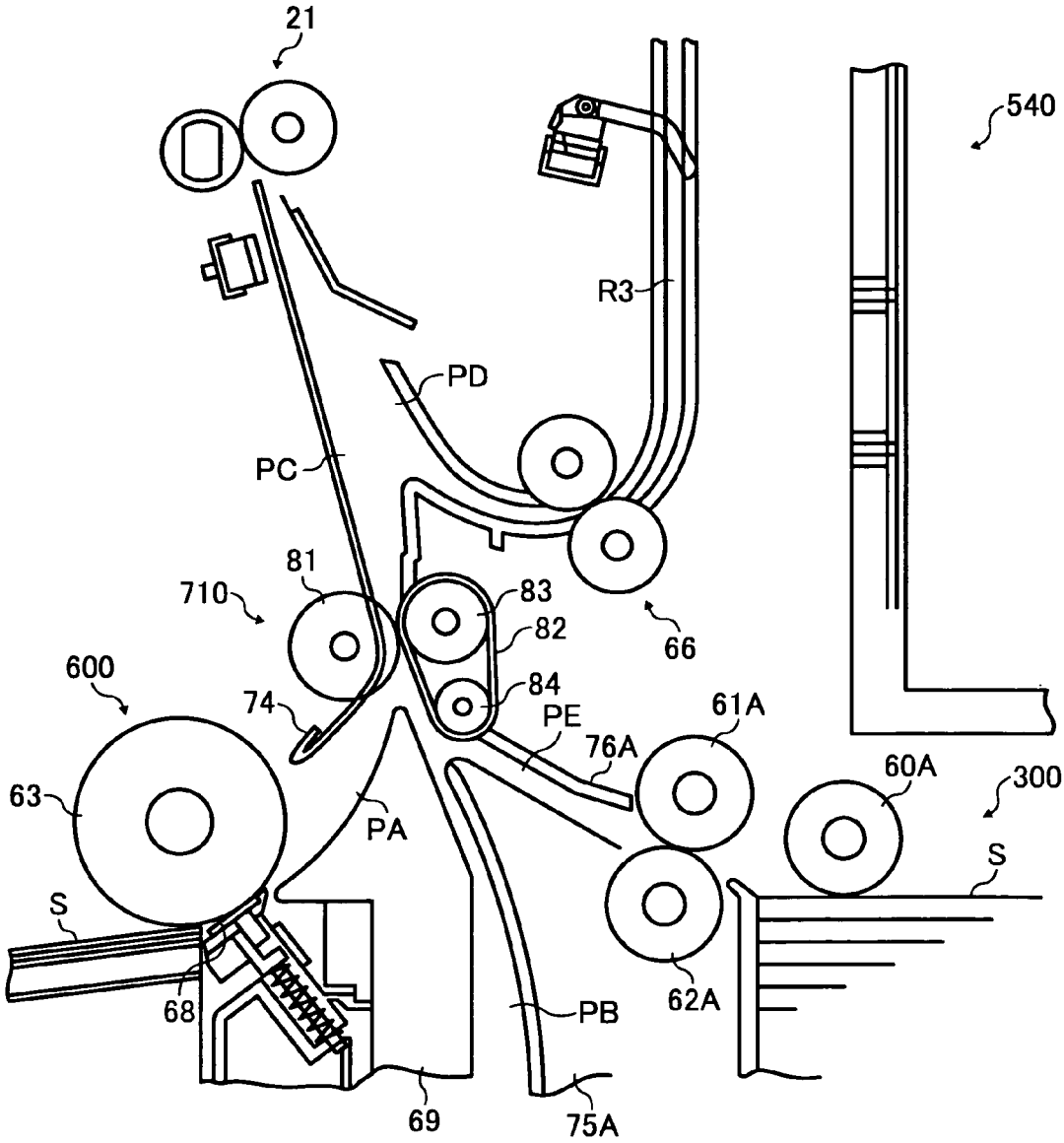

Next, referring to FIG. 35, a schematic configuration of a sheet conveying device 540 included in the copier 1A is described, according to an example embodiment of the present patent application.

As previously described, elements having the same functions and shapes are denoted by the same reference numerals throughout the specification and redundant descriptions are omitted.

The sheet conveying device 540 according to this example embodiment shown in FIG. 35 is primarily different from the sheet conveying device 520 according to the previously described example embodiment shown in FIGS. 25 and 26 in the following points and subsequently described characteristics.

Instead of the sheet conveying device 520 according to the above-described example embodiment shown in FIGS. 25 and 26, the sheet conveying device 540 shown in FIG. 34 is employed.

Instead of the manual sheet conveying path R2 of the sheet conveying device 520 according to the above-described example embodiment shown in FIGS. 25 and 26, the sheet conveying device 540 according to this example embodiment shown in FIG. 34 uses a sheet feeding path PE for a high-capacity feed unit.

Instead of the conveying guide member 76, the sheet conveying device 540 includes a conveying guide member 76A forming a sheet feeding path PE.

Instead of the manual sheet feeding unit or the manual sheet feeding tray 67, the sheet conveying device 540 includes a high-capacity sheet feeding device 300 serving as a high-capacity sheet feeding unit for conveying papers set therein.

The high-capacity sheet feeding device 300 may be detachably attached to the side of the sheet feeding path PE serving as a second conveying path.

The copier 1A having the sheet conveying device 540 of this example embodiment of the present patent application has similar structure and functions to the copier 1 having the sheet conveying device 520 of the above-described example embodiment shown in FIG. 25, except the above-described structure.

The high-capacity sheet feeding device 300 can be any known high-capacity sheet feeding device. For example, the high-capacity sheet feeding device 300 may be disposed on one side of the main body of the copier 1A so as to convey sheets stored therein to the main body of the copier 1A.

In FIG. 35, the high-capacity sheet feeding device 300 includes a sheet feeding roller 60A, a pair of separation rollers 61A and 62A, and a conveying guide member 75A.

The sheet feeding roller 60A may feed the sheet S placed on top of a stack of sheets stored in a sheet feeding tray, not shown, of the high-capacity sheet feeding device 110.

The pair of separation rollers 61A and 62A may separate the sheet S as one sheet from the stack of sheets in the sheet feeding tray and convey the separated sheet S to the main body of the copier 1A.

The conveying guide member 75A may have one part to form the sheet conveying path PE and another part to form the second sheet conveying path PB.

The sheet feeding roller 60A and the pair of separation rollers 61A and 62A may serve as a sheet feeding unit of the high-capacity sheet feeding device 300. When the high-capacity sheet feeding device 300 is integrally and detachably attached to the main body of the copier 1A, the sheet feeding roller 60A and the pair of separation rollers 61A and 62A may appropriately be disposed on the side of the main body or on the side of the high-capacity sheet feeding device 300.

With the above-described configuration of the sheet feeding device 540 according to this example embodiment, various types of multiple sheets can sequentially be conveyed more stably from the sheet feeding path PE serving as a second conveying path.

The above-described examples and example embodiments include multiple advantageous techniques that may achieve various effective sheet feeding operations. Brief descriptions are given of these techniques referring to the above-described example embodiment shown in FIGS. 14 through 22C.

For example, the above-described configuration of the sheet conveying device 500 according to the above-described example embodiment, with reference to FIGS. 14 through 22C, of the present patent application includes a hold and transfer unit, disposed at a downstream side of a first sheet conveying path having a curved section, to form a sheet holding section or nip contact to hold and convey a sheet.

The hold and transfer unit includes two different units, which are a rotary feed driving unit and a belt-type sheet conveying unit. The rotary feed driving unit may rotate to transmit a driving force. The belt-type sheet conveying unit may be disposed along an inner side of the first sheet conveying path and includes a belt that rotates with the rotary feed driving unit and contacting a surface of the sheet to increase an amount of a conveying force with respect to the sheet.

At least a part of the first sheet conveying path is formed by the belt conveying unit and a guide member disposed opposite to the belt conveying unit.

In the sheet conveying device 500, the belt conveying unit includes a first rotary belt holding member and at least one second rotary belt holding member around which the belt thereof is extendedly wound.

The first rotary belt holding member is disposed facing the rotary feed driving member unit via the belt sandwiched therebetween and rotates with the rotary feed driving member.

The at least one second rotary belt holding member is disposed at an upstream side of the first rotary belt holding member in a second sheet conveying path.

The first sheet conveying path includes a guide member having a guide surface to guide the sheet along an inner area thereof.

The second sheet conveying path is disposed at an upstream side of the at least one second rotary belt holding member and includes a second feeding member.

The guide surface of the guide member is more medially located than a tangent line connecting a distal end of the first rotary belt holding member and a distal end of the second rotary belt holding member and a tangent line connecting the distal end of the second belt holding and rotating member and a distal end of the second feeding member.

As a different example, in the sheet conveying device 500, the circumferential surface of the second rotary belt holding member and the guide surface of the guide member are located to form an obtuse angle.

As described above, the belt-type conveying units 8, 800, and 810 of the respective sheet conveying devices 5, 510 through 540 each serves as a belt-type sheet conveying unit for moving and guiding the sheet S toward the nip contact or sheet holding section formed with the grip roller 81 while keeping the leading edge or a leading edge section (the leading edge section has a broad meaning including the leading edge, the face at the leading edge, and the corners and edges at the leading edge) of the sheet S in contact with one member of the pair of rollers of the second conveying unit 7 or a hold and transfer unit, and gradually increasing the contact surface with the sheet S according to the rigidity of the sheet S. The moving and guiding unit is not limited to the belt-type conveying units 8, 800, and 810 as long as it has the above-described effects can be achieved.

In the above-described examples with reference to FIGS. 2 through 8B, FIGS. 10 through 13 and the above-described example embodiments with reference to FIGS. 14 through 35, the present patent application is applied to a sheet conveying device for conveying and feeding a sheet from a sheet storing unit (e.g., sheet feeding cassette 51) provided in the copier 1, serving as an image forming apparatus, to the main body 2 of the copier 1 as shown in FIG. 2 or the copier 1A as shown in FIG. 25, etc.

However, the present patent application is not limited thereto. That is, the present patent application is applicable to a sheet conveying device in which the leading edge of a sheet S is ejected substantially upward from the top of the fixing device 11 of the main body 2 of the copier 1 or 1A, and then ejected from the main body 2 to the sheet eject tray 9 in a substantially horizontal direction, as shown in FIG. 36B, for example.

The present patent application is also applicable to a sheet conveying device in which a sheet S placed on the substantially horizontal manual sheet feeding tray 67 provided outside the main body 2 of the copier 1 or 1A by a user is guided inside the main body 2 while maintaining its horizontal direction, and then the sheet S changes its direction upward to be conveyed into a vertical conveying path that extends to the image forming section in the main body 2 of the copier 1 or 1A.

In the above-described examples with reference to FIGS. 2 through 13 and the above-described example embodiments with reference to FIGS. 14 through 35, the sheet may change its direction from a substantially horizontal direction to a vertically upward direction or substantially directly upward direction. However, the present patent application is not limited thereto.

Figure 36A:
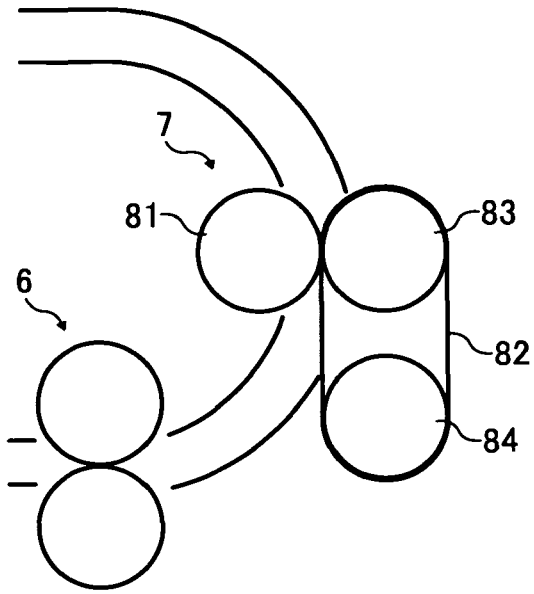
FIG. 36A is a schematic front view of conveying units applicable to the above-described sheet conveying devices.
Figure 36B:
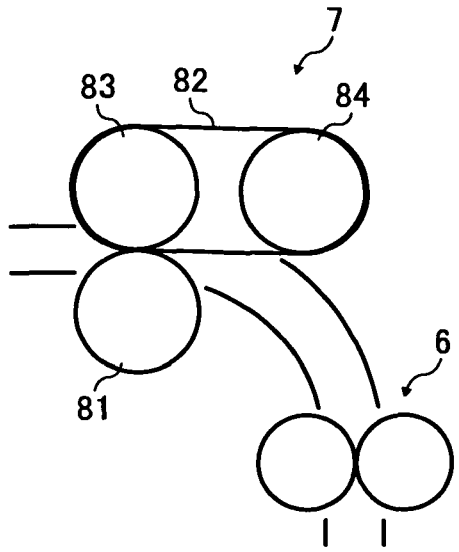
FIG. 36B is a schematic front view of different conveying units applicable to the above-described sheet conveying devices.

For example, the sheet can change its direction from a substantially horizontal direction to a vertically downward direction or substantially directly downward direction, or from a vertically downward or upward direction to a substantially horizontal direction, as shown in FIG. 36A, for example, or from an oblique direction to another oblique direction.

In the above-described examples with reference to FIGS. 2 through 13 and the above-described example embodiments with reference to FIGS. 25 through 35, both the first conveying unit 6 or 600 and the second conveying unit 7, 700, or 710 are hold and transfer units. However, depending on the conveying direction of each of the first and second conveying units 6 (600) and 7 (700 or 710), if it is only needed to support the bottom face of the conveying object while being conveyed, the first and second conveying units 6 (600) and 7 (700 or 710) may not need to be the hold and transfer units including nip contacts formed by members facing each other. In the above-described example embodiment with reference to FIGS. 14 through 22C, at least the second conveying unit 700 may be a hold and transfer unit.

The members of the first conveying unit 6 (600), the second conveying unit 7 (700 and 710), and the pickup roller 60 are not limited to the above. The members can be a substantially extended cylindrical roller or member with a given length in the axial lengthwise direction of the rotational axis, or a short cylindrical roller or member. Furthermore, multiple rollers can be disposed along a single rotational shaft with given equal intervals therebetween.

In the conveying paths according to the above-described example embodiments, several guiding members can be provided along the outer side or the inner side in the spaces in which rollers are not disposed so as to form guide surfaces. As long as such guide surfaces are symmetrically arranged in an orderly manner with respect to a conveying center line, the guide surfaces can be band-like guide surfaces or substantially linear guide surfaces or a combination thereof.

In the above-described example embodiments with reference to FIGS. 14 through 34, a friction pad may be used for a sheet separation mechanism. However, the sheet separation method is not limited to the above-described method or mechanism. The present patent application can apply any sheet separation method in which, when multiple sheets are picked up from a sheet feeding cassette, one sheet is frictionally separated from the other sheets. For example, a separator or a separating claw can be applied, instead of the friction pad.

The present patent application is not limited to the copiers 1 and 1A having a monochrome printing method. That is, the sheet conveying device according to the present patent application is also applicable to a color copier or an image forming apparatus connected to a printer such as a monochrome laser printer, an inkjet printer, or an ink ribbon printer.

The present patent application is similarly applicable to a color printer such as a direct transfer type tandem type color image forming apparatus in which images are sequentially transferred and superimposed onto a sheet being conveyed by a transfer member, and a tandem type image forming apparatus in which images are sequentially transferred onto an endless intermediate transfer belt serving as an intermediate transfer member and then transferred onto a sheet at once as a overlaid toner image or a color toner image.

The present patent application is also applicable to an image forming apparatus including a single, endless belt type photoconductor.

The present patent application is not limited to an image forming apparatus that employs an in-body paper eject type, that is, a sheet eject tray is located within the main body of the image forming apparatus, between an image forming unit and a scanner. Specifically, the present patent application is also applicable to an image forming apparatus with a paper eject tray provided on the side of the main body of the image forming apparatus.

In the above-described examples with reference to FIGS. 2 through 13 and the above-described example embodiments with reference to FIGS. 25 through 35, the present patent application is not limited to a conveying path for conveying a sheet extracted from the sheet feeding device 3 substantially vertically or directly upward toward the top of the main body 2 of the copier 1 or 1A. That is, the present patent application is also applicable to an image forming apparatus in which the conveying path from the sheet feeding device to the sheet eject tray is not substantially vertically or directly upward.

The present patent application is also applicable to a sheet conveying device provided in a printing machine including stencil printing machines, for conveying a sheet from a sheet storing unit or sheet feeding cassette to a printing machine main unit.

In the above-described copiers 1 and 1A serving as the image forming apparatus, an original document to be scanned may be manually set. However, in the above-described examples with reference to FIGS. 2 through 13 and the above-described example embodiments with reference to FIGS. 23 through 35, the image forming apparatus can be a copier or a printing machine provided with an automatic document feeder or ADF for automatically scanning multiple original documents or sheets, and the sheet conveying device according to the present patent application can be provided in the ADF.

The image forming apparatus is not limited to a copier. That is, the image forming apparatus can be a facsimile machine, a printer, an inkjet recording device, or an image scanning device, provided with a scanner for scanning an image from an original document, and a multifunction peripheral combining at least two of the above. In any of the above-described apparatuses or devices, an optimum sheet conveying device can be provided for changing the sheet conveying direction in conveying various types of sheets, while saving space in the sheet conveying path.

The present patent application is not limited to providing respective sheet conveying devices to multiple sheet feeding stages. For example, the present patent application is applicable to a case in which the top sheet feeding cassette 51, the first conveying unit 600, and the second conveying unit 7' are removed from the sheet feeding device 3 shown in FIGS. 2 and 25, so that the sheet feeding device 3 can include a single sheet feeding cassette 51, one first conveying unit 600, one second conveying unit 7 (700 or 710), and one pair of registration rollers 21.

That is, the present patent application is applicable to an image scanning device provided with the sheet conveying device according to an example embodiment of the present patent application, and to an image forming apparatus provided with the sheet conveying device and/or the image scanning device according to an example embodiment of the present patent application. The image forming apparatus according to an example embodiment of the present patent application can be any one of a copier, a facsimile machine, a printer, a printing machine, and an inkjet recording device, or a multifunction peripheral combining at least two of the above.

Although the invention has been described with respect to a specific embodiment for a complete and clear disclosure, the appended claims are not to be limited as shown in the above-described example embodiments with reference to FIGS. 14 through 35 but are to be construed as embodying all modifications and alternative constructions that may occur to one skilled in the art that fairly fall within the basic teaching herein set forth.

The above-described example embodiments are illustrative, and numerous additional modifications and variations are possible in light of the above teachings. For example, elements and/or features of different illustrative and example embodiments herein may be combined with each other and/or substituted for each other within the scope of this disclosure and appended claims. It is therefore to be understood that within the scope of the appended claims, the disclosure of this patent specification may be practiced otherwise than as specifically described herein.

Example embodiments being thus described, it will be obvious that the same may be varied in many ways. Such variations are not to be regarded as a departure from the spirit and scope of the present patent application, and all such modifications as would be obvious to one skilled in the art are intended to be included within the scope of the following claims.

What is claimed is:

1. A sheet conveying device, comprising:

a hold and transfer unit, at a downstream side of a curved feed turning portion of a sheet conveying path, the curved feed turning portion configured to change a direction of feeding of the sheet in the sheet conveying path, including a holding section to hold and transfer the sheet, the hold and transfer unit including:

a rotary feed driving member provided outside of the curved feed turning portion of the sheet conveying path, the rotary feed driving member defining an outer side of the sheet conveying path and configured to rotate to transmit a driving force;

a belt-type sheet conveying unit, including at least two rollers with a belt bridged facing the rotary feed driving member and defining an inner side of the curved feed turning portion of the sheet conveying path, provided with a belt to rotate with the rotary feed driving member and to contact a surface of the sheet to increase a conveying force on the sheet, the belt-type conveying unit being disposed facing the rotary feed driving member to form a nip portion therebetween; and a guide member at an upstream side of the curved feed turning portion of the sheet conveying path with respect to the rotary feed driving member and the belt-type sheet conveying unit, the guide member facing the belt-type sheet conveying unit and on an outer side of the curved feed turning portion of the sheet conveying path, the belt facing a guide surface of the guide member on the outer side of the curved feed turning portion of the sheet conveying path, the belt defining an inner side of the curved feed turning portion of the sheet conveying path, the at least two rollers defining the inner side of the curved feed turning portion of the sheet conveying path via the belt, wherein the guide member and the belt-type sheet conveying unit are disposed to form an inner circumference of a curve, a conveying surface of the belt is linearly arranged between the at least two rollers, at least a part of the sheet conveying path includes the belt-type sheet conveying unit and the guide member, and at least a portion of the rotary feed driving member and belt-type sheet conveying unit are at a downstream side of the curved feed turning portion of the sheet conveying path with respect to the guide member.

2. An image forming apparatus, comprising:

a sheet conveying device including at least one sheet feeding path and a belt-type sheet conveying unit, the at least one sheet feeding path including, a first sheet conveying path, having a curved feed turning portion, to feed and convey a sheet therethrough;

a second sheet conveying path, having a curved feed turning portion and different from the first sheet conveying path, to feed and convey the sheet therethrough; and a third sheet conveying path provided from a confluence of the first sheet conveying path and the second sheet conveying path; and the belt-type sheet conveying unit including at least two rollers with a belt bridged, facing a rotary feed driving member and defining an inner side of the curved feed turning portion of the sheet conveying paths, the belt-type sheet conveying unit provided with the belt to rotate with the rotary feed driving member and to contact a surface of the sheet to increase a conveying force on the sheet, the belt-type conveying unit being disposed facing the rotary feed driving member to form a nip portion therebetween; and a guide member at an upstream side of the curved feed turning portion of the sheet conveying path with respect to the rotary feed driving member and the belt-type sheet conveying unit, the guide member facing the belt-type sheet conveying unit and on an outer side of the curved feed turning portion of the sheet conveying path, the belt facing a guide surface of the guide member on the outer side of the curved feed turning portion of the sheet conveying path, the belt defining an inner side of the curved feed turning portion of the sheet conveying path, and the at least two rollers defining the inner side of the curved feed turning portion of the sheet conveying path via the belt, wherein the guide member and the belt-type sheet conveying unit are disposed to form an inner circumference of a curve, a conveying surface of the belt is linearly arranged between the at least two rollers, at least a portion of the rotary feed driving member and belt-type sheet conveying unit are at a downstream side of the curved feed turning portion of the sheet conveying path with respect to the guide member.

3. The image forming apparatus according to claim 2, further comprising a manual sheet conveying device, mounted on one side of the image forming apparatus, to feed the sheet loaded therein to the main body thereof, the manual sheet conveying device disposed on a side of the image forming apparatus where the second sheet conveying path is provided.

4. The image forming apparatus according to claim 2, further comprising:

an image forming device, provided in the main body at a downstream side of the belt-type sheet conveying unit, to form an image on the sheet conveyed via the belt-type sheet conveying unit; and a reverse conveying path to reverse surfaces of the sheet having the image formed thereon by the image forming device, the reverse conveying path merging with the second sheet conveying path.

5. The image forming apparatus according to claim 2, wherein the belt-type sheet conveying unit is disposed to guide the sheet conveyed thereto via the first sheet conveying path to bend back along a sheet travel direction.

6. The image forming apparatus according to claim 5, further comprising:

an image forming device provided in the main body at a downstream side of the belt-type sheet conveying unit to form an image on the sheet conveyed via the belt-type sheet conveying unit; and a reverse conveying path to reverse surfaces of the sheet having the image formed thereon by the image forming device, the reverse conveying path merging with the third sheet conveying path provided downstream of the belt-type sheet conveying unit.

7. The image forming apparatus according to claim 2, further comprising a high-capacity sheet conveying device, disposed on one side of the image forming apparatus, to feed the sheet therefrom to the image forming apparatus, the high-capacity sheet conveying device provided on a side of the image forming apparatus where the second sheet conveying path is provided.

8. The image forming apparatus according to claim 2, wherein the sheet conveying device further comprises:

a hold and transfer unit, at a downstream side of the at least one sheet feeding path, the curved feed turning portion configured to change a direction of feeding of the sheet in the sheet conveying path, including a holding section to hold and transfer the sheet, the hold and transfer unit including, the rotary feed driving member to rotate to transmit a driving force; and the belt-type sheet conveying unit, wherein at least a part of the sheet feeding path includes the belt-type sheet conveying unit and the guide member.

9. A sheet conveying device, comprising:

a hold and transfer unit at a downstream side of a curved feed turning portion of a sheet conveying path, the curved feed turning portion of the hold and transfer unit configured to change a direction of feeding of the sheet in the sheet conveying path and including a holding section to hold and transfer the sheet, the hold and transfer unit including:

a rotary feed member, provided outside of the curved feed turning portion of the sheet conveying path to rotate to transmit a driving force;

a belt-type sheet conveying unit, including at least two rollers with a belt bridged, facing the rotary feed member and defining an inner side of the curved feed turning portion of the sheet conveying path, and provided with the belt to contact a surface of the sheet to increase a conveying force on the sheet, the belt-type conveying unit being disposed facing the rotary feed driving member to form a nip portion therebetween; and a guide member at an upstream side of the curved feed turning portion of the sheet conveying path with respect to the rotary feed driving member and the belt-type sheet conveying unit, the guide member facing the belt-type sheet conveying unit and on an outer side of the curved feed turning portion of the sheet conveying path, the belt facing a guide surface of the guide member on the outer side of the curved feed turning portion of the sheet conveying path, the belt defining an inner side of the curved feed turning portion of the sheet conveying path, the at least two rollers arranged to define the inner side of the curved feed turning portion of the sheet conveying path via the belt, wherein the guide member and the belt-type sheet conveying unit are disposed to form an inner circumference of a curve, a conveying surface of the belt is linearly arranged between the at least two rollers, at least a part of the sheet conveying path includes the belt-type sheet conveying unit and the guide member, and at least a portion of the rotary feed driving member and belt-type sheet conveying unit are at a downstream side of the curved feed turning portion of the sheet conveying path with respect to the guide member.

* * * * *